US010995613B1

(12) United States Patent
Sollami

(10) Patent No.: US 10,995,613 B1
(45) **Date of Patent: *May 4, 2021**

(54) DIAMOND TIPPED UNITARY HOLDER/BIT

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 9 days.

This patent is subject to a terminal disclaimer.

(21) Appl. No.: 16/390,466

(22) Filed: Apr. 22, 2019

Related U.S. Application Data

(63) Continuation-in-part of application No. 16/038,416, filed on Jul. 18, 2018, now Pat. No. 10,767,478, which is a continuation-in-part of application No. 14/487,493, filed on Sep. 16, 2014, now Pat. No. 9,909,416, said application No. 16/390,466 is a continuation-in-part of application No. 14/690,679, filed on Apr. 20, 2015, now Pat. No. 10,370,966, and a continuation-in-part of application No. 15/879,078, filed on Jan. 24, 2018, now Pat. No. 10,415,386.

(60) Provisional application No. 61/879,353, filed on Sep. 18, 2013, provisional application No. 61/983,291, filed on Apr. 23, 2014.

(51) Int. Cl.

| | |
|---|---|
| ***E21C 35/18*** | (2006.01) |
| ***E21C 35/19*** | (2006.01) |
| *E21C 35/183* | (2006.01) |

(52) U.S. Cl.
CPC ..... *E21C 35/19* (2013.01); *E21C 35/1831* (2020.05); *E21C 35/1835* (2020.05); *E21C 35/191* (2020.05)

(58) Field of Classification Search
CPC ..... E21C 35/183
See application file for complete search history.

(56) References Cited

U.S. PATENT DOCUMENTS

| | | | |
|---|---|---|---|
| 2,382,947 | A | 7/1944 | Brozek |
| 2,810,567 | A | 10/1957 | Kirkham |
| 3,342,531 | A | 9/1967 | Krekeler |
| 3,342,532 | A | 9/1967 | Krekeler |
| 3,397,012 | A | 8/1968 | Krekeler |
| 3,476,438 | A | 11/1969 | Bower, Jr. |
| 3,519,309 | A | 7/1970 | Engle |
| 3,833,264 | A | 9/1974 | Elders |
| 3,833,265 | A | 9/1974 | Elders |
| 3,865,437 | A | 2/1975 | Crosby |

(Continued)

FOREIGN PATENT DOCUMENTS

| | | |
|---|---|---|
| DE | 102004049710 | 4/2006 |
| DE | 102011079115 | 1/2013 |

(Continued)

*Primary Examiner* — Janine M Kreck
(74) *Attorney, Agent, or Firm* — Mercedes V. O'Connor; Rockman Videbeck & O'Connor

(57) ABSTRACT

A unitary diamond bit/holder, tool, and/or pick assembly that includes a forward extension axially extending from a body of the bit/holder and a tungsten carbide ring mounted in an annular trough at a forward end of the body around the forward extension. A diamond tipped bit tip insert is positioned and brazed in a bore of the forward extension, a forward end of the forward extension extending axially above a base of the bit tip insert.

24 Claims, 26 Drawing Sheets

(56) References Cited

U.S. PATENT DOCUMENTS 4,084,856 A 4/1978 Emmerich
4,247,150 A 1/1981 Wrulich et al.
RE30,807 E 12/1981 Elders
4,310,939 A 1/1982 Iijima
4,453,775 A 6/1984 Clemmow
4,478,298 A 10/1984 Hake
4,489,986 A 12/1984 Dziak
4,525,178 A 6/1985 Hall
4,561,698 A 12/1985 Beebe
4,570,726 A 2/1986 Hall
4,604,106 A 8/1986 Hall
4,632,463 A 12/1986 Sterwerf, Jr.
4,694,918 A 9/1987 Hall
4,702,525 A 10/1987 Sollami
4,763,956 A 8/1988 Emmerich
4,811,801 A 3/1989 Salesky
4,818,027 A 4/1989 Simon
4,821,819 A 4/1989 Whysong
4,844,550 A 7/1989 Beebe
4,915,455 A 4/1990 O'Niell
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A 5/1995 Massa
5,417,475 A 5/1995 Graham et al.
5,458,210 A 10/1995 Sollami
5,484,191 A 1/1996 Sollami
5,492,188 A 2/1996 Smith et al.
5,551,760 A 9/1996 Sollami
5,607,206 A 3/1997 Siddle
5,628,549 A 5/1997 Ritchey
5,720,528 A 2/1998 Ritchey
5,725,283 A 3/1998 O'Neill
5,823,632 A 10/1998 Burkett
5,924,501 A 7/1999 Tibbitts
5,931,542 A 8/1999 Britzke
5,934,854 A 8/1999 Krautkremer et al.
5,992,405 A 11/1999 Sollami
D420,013 S 2/2000 Warren
6,019,434 A 2/2000 Emmerich
6,102,486 A 8/2000 Briese
6,176,552 B1 1/2001 Topka, Jr.
6,196,340 B1 3/2001 Jensen et al.
6,199,451 B1 3/2001 Sollami
6,250,535 B1 6/2001 Sollami
6,331,035 B1 12/2001 Montgomery, Jr.
6,341,823 B1 1/2002 Sollami
6,357,832 B1 3/2002 Sollami
6,371,567 B1 4/2002 Sollami
6,382,733 B1 5/2002 Parrott
6,428,110 B1 8/2002 Ritchey et al.
6,508,516 B1 1/2003 Kammerer
D471,211 S 3/2003 Sollami
6,585,326 B2 7/2003 Sollami
6,592,304 B1 * 7/2003 Kammerer ..... E21C 35/183 407/119
6,685,273 B1 * 2/2004 Sollami ..... E02F 9/2866 299/106
6,692,083 B2 2/2004 Latham
D488,170 S 4/2004 Sollami
6,733,087 B2 5/2004 Hall
6,739,327 B2 5/2004 Sollami
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
3,007,049 A1 8/2011 Fader
7,992,944 B2 8/2011 Hall
7,992,945 B2 8/2011 Hall
7,997,660 B2 8/2011 Monyak et al.
7,997,661 B2 8/2011 Hall
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall
8,292,372 B2 10/2012 Hall
8,414,085 B2 4/2013 Hall
8,449,039 B2 5/2013 Hall
8,485,609 B2 7/2013 Hall
8,500,209 B2 8/2013 Hall
8,540,320 B2 9/2013 Sollami

(56) References Cited

U.S. PATENT DOCUMENTS

| | | | | |
|---|---|---|---|---|
| 8,562,079 | B2 * | 10/2013 | Wang | E21C 35/183 299/111 |
| RE44,690 | E | 1/2014 | Sollami | |
| 8,622,482 | B2 | 1/2014 | Sollami | |
| 8,622,483 | B2 | 1/2014 | Sollami | |
| 8,646,848 | B2 | 2/2014 | Hall | |
| 8,728,382 | B2 | 5/2014 | Hall | |
| 8,740,314 | B2 | 6/2014 | O'Neill | |
| 9,004,610 | B2 | 4/2015 | Erdmann et al. | |
| 9,028,008 | B1 | 5/2015 | Bookhamer | |
| 9,039,099 | B2 | 5/2015 | Sollami | |
| 9,316,061 | B2 | 4/2016 | Hall | |
| 9,518,464 | B2 | 12/2016 | Sollami | |
| 9,879,531 | B2 | 1/2018 | Sollami | |
| 9,909,416 | B1 | 3/2018 | Sollami | |
| 9,976,418 | B2 | 5/2018 | Sollami | |
| 9,988,903 | B2 | 6/2018 | Sollami | |
| 10,072,501 | B2 | 9/2018 | Sollami | |
| 10,105,870 | B1 | 10/2018 | Sollami | |
| 10,107,097 | B1 | 10/2018 | Sollami | |
| 10,107,098 | B2 | 10/2018 | Sollami | |
| 10,180,065 | B1 | 1/2019 | Sollami | |
| 10,260,342 | B1 | 4/2019 | Sollami | |
| 10,323,515 | B1 | 6/2019 | Sollami | |
| 10,337,324 | B2 | 7/2019 | Sollami | |
| 10,370,966 | B1 | 8/2019 | Sollami | |
| 10,385,689 | B1 | 8/2019 | Sollami | |
| 10,415,386 | B1 | 9/2019 | Sollami | |
| 10,502,056 | B2 | 12/2019 | Sollami | |
| 2002/0063467 | A1 | 5/2002 | Taitt | |
| 2002/0074850 | A1 | 6/2002 | Montgomery, Jr. | |
| 2002/0074851 | A1 | 6/2002 | Montgomery, Jr. | |
| 2002/0109395 | A1 | 8/2002 | Sollami | |
| 2002/0167216 | A1 * | 11/2002 | Sollami | E21C 35/197 299/106 |
| 2002/0192025 | A1 | 12/2002 | Johnson | |
| 2003/0011236 | A1 * | 1/2003 | Sollami | E21C 35/183 299/111 |
| 2003/0015907 | A1 | 1/2003 | Sollami | |
| 2003/0047985 | A1 | 3/2003 | Stiffler | |
| 2003/0052530 | A1 * | 3/2003 | Sollami | E21C 35/183 299/111 |
| 2003/0122414 | A1 * | 7/2003 | Sollami | B28D 1/188 299/113 |
| 2003/0209366 | A1 | 11/2003 | McAlvain | |
| 2004/0004389 | A1 | 1/2004 | Latham | |
| 2004/0174065 | A1 | 9/2004 | Sollami | |
| 2005/0212345 | A1 | 9/2005 | Sleep et al. | |
| 2006/0071538 | A1 | 4/2006 | Sollami | |
| 2006/0186724 | A1 | 8/2006 | Stehney | |
| 2006/0261663 | A1 | 11/2006 | Sollami | |
| 2007/0013224 | A1 | 1/2007 | Stehney | |
| 2007/0040442 | A1 | 2/2007 | Weaver | |
| 2007/0052279 | A1 | 3/2007 | Sollami | |
| 2008/0035386 | A1 | 2/2008 | Hall et al. | |
| 2008/0036276 | A1 | 2/2008 | Hall et al. | |
| 2008/0036283 | A1 | 2/2008 | Hall et al. | |
| 2008/0100124 | A1 | 5/2008 | Hall et al. | |
| 2008/0145686 | A1 | 6/2008 | Mirchandani | |
| 2008/0164747 | A1 | 7/2008 | Weaver et al. | |
| 2008/0284234 | A1 | 11/2008 | Hall et al. | |
| 2009/0146491 | A1 | 6/2009 | Fader et al. | |
| 2009/0160238 | A1 | 6/2009 | Hall et al. | |
| 2009/0256413 | A1 * | 10/2009 | Majagi | B28D 1/188 299/100 |
| 2009/0261646 | A1 | 10/2009 | Ritchie et al. | |
| 2010/0045094 | A1 | 2/2010 | Sollami | |
| 2010/0244545 | A1 | 9/2010 | Hall | |
| 2010/0253130 | A1 | 10/2010 | Sollami | |
| 2010/0320003 | A1 | 12/2010 | Sollami | |
| 2010/0320829 | A1 | 12/2010 | Sollami | |
| 2011/0006588 | A1 | 1/2011 | Monyak et al. | |
| 2011/0089747 | A1 | 4/2011 | Helsel | |
| 2011/0175430 | A1 | 7/2011 | Heiderich et al. | |
| 2011/0204703 | A1 | 8/2011 | Sollami | |
| 2011/0254350 | A1 | 10/2011 | Hall | |
| 2012/0001475 | A1 | 1/2012 | Dubay et al. | |
| 2012/0027514 | A1 | 2/2012 | Hall | |
| 2012/0056465 | A1 | 3/2012 | Gerer et al. | |
| 2012/0068527 | A1 | 3/2012 | Erdmann | |
| 2012/0104830 | A1 | 5/2012 | Monyak et al. | |
| 2012/0181845 | A1 | 7/2012 | Sollami | |
| 2012/0242136 | A1 | 9/2012 | Ojanen | |
| 2012/0248663 | A1 | 10/2012 | Hall | |
| 2012/0261977 | A1 | 10/2012 | Hall | |
| 2012/0280559 | A1 | 11/2012 | Watson | |
| 2012/0286559 | A1 | 11/2012 | Sollami | |
| 2012/0319454 | A1 | 12/2012 | Swope | |
| 2013/0169023 | A1 | 7/2013 | Monyak | |
| 2013/0181501 | A1 | 7/2013 | Hall et al. | |
| 2013/0199693 | A1 | 8/2013 | Tank et al. | |
| 2013/0307316 | A1 | 11/2013 | Roetsch et al. | |
| 2014/0035346 | A1 | 2/2014 | Fundakowski et al. | |
| 2014/0110991 | A1 | 4/2014 | Sollami | |
| 2014/0232172 | A1 | 8/2014 | Roth et al. | |
| 2014/0262541 | A1 | 9/2014 | Parsana et al. | |
| 2014/0326516 | A1 | 11/2014 | Haugvaldstad | |
| 2015/0028656 | A1 | 1/2015 | Sollami | |
| 2015/0035343 | A1 | 2/2015 | Ojanen | |
| 2015/0137579 | A1 | 5/2015 | Lachmann et al. | |
| 2015/0198040 | A1 | 7/2015 | Voitic et al. | |
| 2015/0240634 | A1 | 8/2015 | Sollami | |
| 2015/0285074 | A1 | 10/2015 | Sollami | |
| 2015/0292325 | A1 | 10/2015 | Sollami | |
| 2015/0300166 | A1 | 10/2015 | Ries et al. | |
| 2015/0308488 | A1 | 10/2015 | Kahl | |
| 2015/0315910 | A1 | 11/2015 | Sollami | |
| 2015/0354285 | A1 | 12/2015 | Hall | |
| 2016/0102550 | A1 | 4/2016 | Paros et al. | |
| 2016/0194956 | A1 | 7/2016 | Sollami | |
| 2016/0229084 | A1 | 8/2016 | Lehnert | |
| 2016/0237818 | A1 | 8/2016 | Weber et al. | |
| 2017/0089198 | A1 | 3/2017 | Sollami | |
| 2017/0101867 | A1 | 4/2017 | Hall et al. | |

FOREIGN PATENT DOCUMENTS

| | | |
|---|---|---|
| DE | 202012100353 | 6/2013 |
| DE | 102015121953 | 7/2016 |
| DE | 102016118658 | 3/2017 |
| EP | 3214261 | 9/2017 |
| GB | 1114156 | 5/1968 |
| GB | 1218308 | 1/1971 |
| GB | 2483157 | 2/2012 |
| GB | 2534370 | 7/2016 |
| WO | 2008105915 A2 | 9/2008 |
| WO | 2008105915 A3 | 9/2008 |
| WO | 2009006612 | 1/2009 |

* cited by examiner

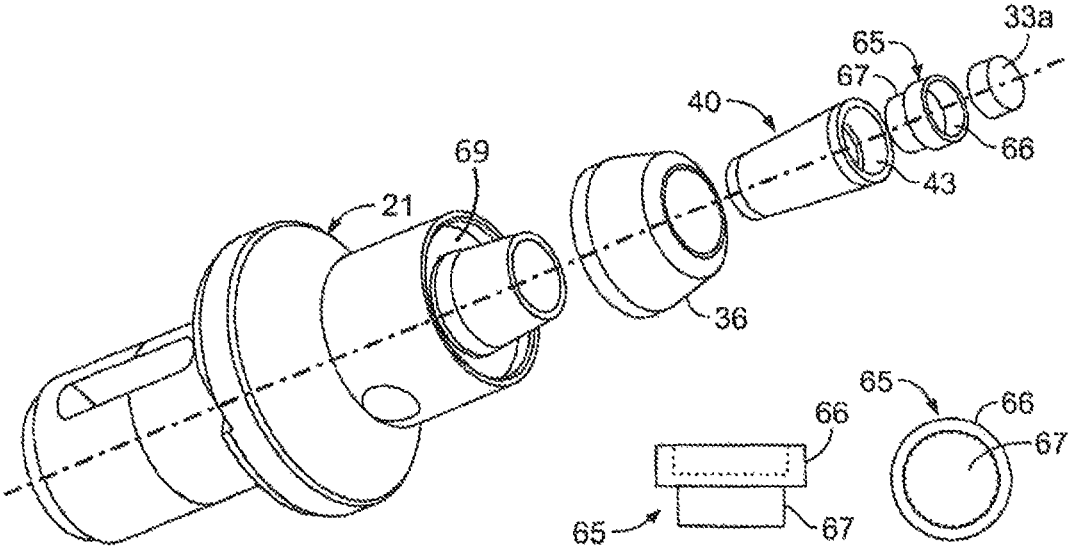
FIG. 6 FIG. 6A FIG. 6B
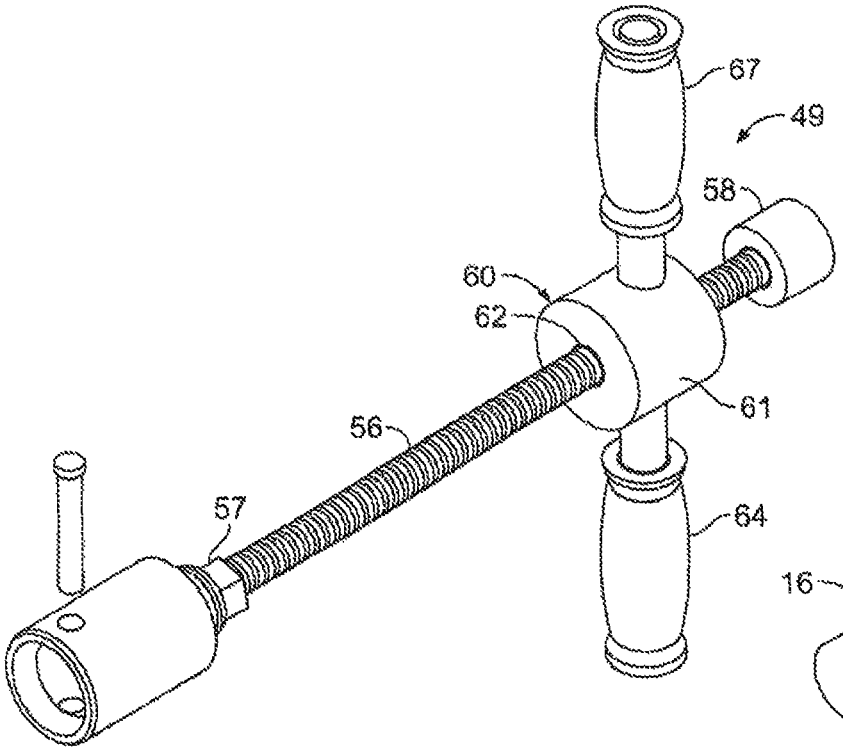
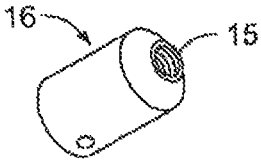
FIG. 7 FIG. 8

SECTION A-A

DIAMOND TIPPED UNITARY HOLDER/BIT

CROSS-REFERENCE TO RELATED APPLICATION(S)

This invention claims priority to U.S. Provisional Application No. 61/879,353, filed Sep. 18, 2013, claims priority to and is a continuation-in-part of U.S. Non-provisional application Ser. No. 14/487,493, filed Sep. 16, 2014, now U.S. Pat. No. 9,909,416, issued Mar. 6, 2018, claims priority to U.S. Provisional Application No. 61/983,291, filed Apr. 23, 2014, claims priority to and is a continuation-in-part of U.S. Non-provisional application Ser. No. 14/690,679, filed Apr. 20, 2015, claims priority to and is a continuation-in-part of U.S. Non-provisional application Ser. No. 15/879,078, filed Jan. 24, 2018, and claims priority to and is a continuation-in-part of U.S. Non-provisional application Ser. No. 16/038,416, filed Jul. 18, 2018, to the extent allowed by law and the contents of which are incorporated herein by reference in their entireties.

TECHNICAL FIELD

This invention relates to combination bit/holders used in road milling, mining and trenching and, more particularly, to diamond coated tungsten carbide inserts and structure for mounting them as part of a unitary bit/holder combination, tool, and/or pick assembly.

BACKGROUND

Road milling bits and bit holders, the design of which, when made in differing sizes, can also be used for trenching machines and mining machines, have benefitted greatly from what has been termed a quick change shank, found in the instant inventor's prior U.S. Pat. Nos. 6,371,567; 6,685,273 and 7,883,155. Additionally, the construction features of the forward end of the advanced bit design found in applicant's U.S. Pat. No. 6,739,327 has been cited in over 70 later issued patents. The Burkett U.S. Pat. No. 5,161,627 disclosed that one could mount a diamond coated insert in a one-piece bit/bit holder body. A similar structure with a diamond coated tip is found at the Sionett U.S. Pat. No. 4,944,559. These diamond coatings have heretofore been formed in a standard process that includes high temperature, high pressure forming of same on a tungsten carbide high impact substrate.

A later version of the present applicant's prior invention of a quick change shank such as found in the U.S. Pat. No. 6,371,567 is provided in combination with a diamond tip and found at the Hall et al U.S. Pat. No. 8,118,371.

With diamond coated tips of road milling machinery, it has been found that the working life of the tip has been greatly increased. As such, it is no longer necessary to provide changeable bits in bit holders. The operating life of bits and bit holders are such that they can be physically combined in a unitary structure.

A need has developed for a lower cost combination diamond coated tip and front portion, formerly used on a removable bit, with a quick change bit holder and improvements in tools for inserting and removing same in their working mountings.

SUMMARY

This disclosure relates generally to unitary bit/bit holder combination, tool, and/or pick assemblies for road milling, mining, and trenching equipment. One implementation of the teachings herein is a tool that includes a body comprising an annular trough and a forward extension axially extending from the annular trough to a forward end of the body; a shank extending axially from a bottom of the body; and an annular ring comprising a ring bore, the forward extension extending through the ring bore and axially above a forward end of the annular ring, and the carbide ring adapted to be seated and brazed in the annular trough of the body.

These and other aspects of the present disclosure are disclosed in the following detailed description of the embodiments, the appended claims and the accompanying figures.

BRIEF DESCRIPTION OF THE DRAWINGS

The features of the present invention which are believed to be novel are set forth with particularity in the appended claims. The invention may best be understood from the following detailed description of currently preferred embodiments thereof taken in conjunction with the accompanying drawings wherein like numerals refer to like parts, and in which:

FIG. 6 is an exploded perspective view of a first modification of the combination bit/holder of FIGS. 1-5 further including an added steel cup into which the tungsten carbide diamond coated tip is inserted which, in turn is inserted in the forward end of the reverse taper tungsten carbide insert, in accordance with implementations of this disclosure;

FIG. 6*a* is an elevational view of the tip receiving cup including the bottom pad shown in FIG. 6 in accordance with implementations of this disclosure;

FIG. 6*b* is a top plan view of the cup of FIG. 6 in accordance with implementations of this disclosure;

FIG. 7 is a top ¼ perspective view of a complete bit/holder removal tool for removing the bit/holder from a bit block in accordance with implementations of this disclosure;

FIG. 8 is a top ¾ perspective view of the female cup of the bit/holder removal tool showing the Acme threaded top bore therein in accordance with implementations of this disclosure;

DETAILED DESCRIPTION

Figure 1:
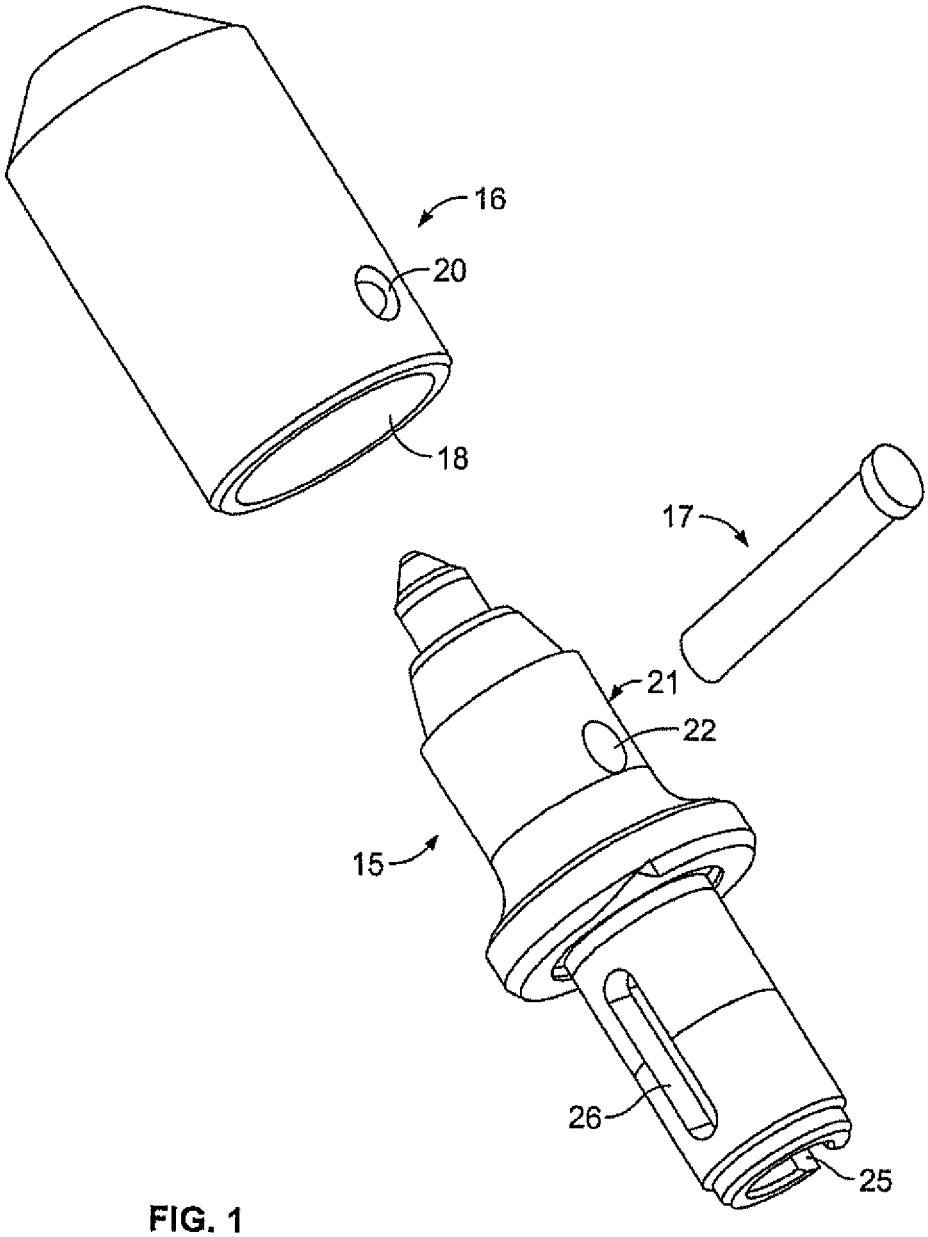
FIG. 1 is an exploded perspective view of a combination diamond coated bit/bit holder, shown together with a drift pin and cup portion of a tool useful for inserting the bit holder in its bit block (not shown), in accordance with implementations of this disclosure.

Referring to FIG. 1, a combined diamond coated bit/holder is shown, generally at 15, in its completed form together with a female cup insertion-removal member 16 and its accompanying drift pin 17, which extends through the hollow open bottom 18 of the female cup member through aperture 20 and through a body 21 of the combined bit/holder at bore 22 for insertion into a bit block (not shown) which, in turn, is mounted on a rotatable drum (not shown).

Figure 2:
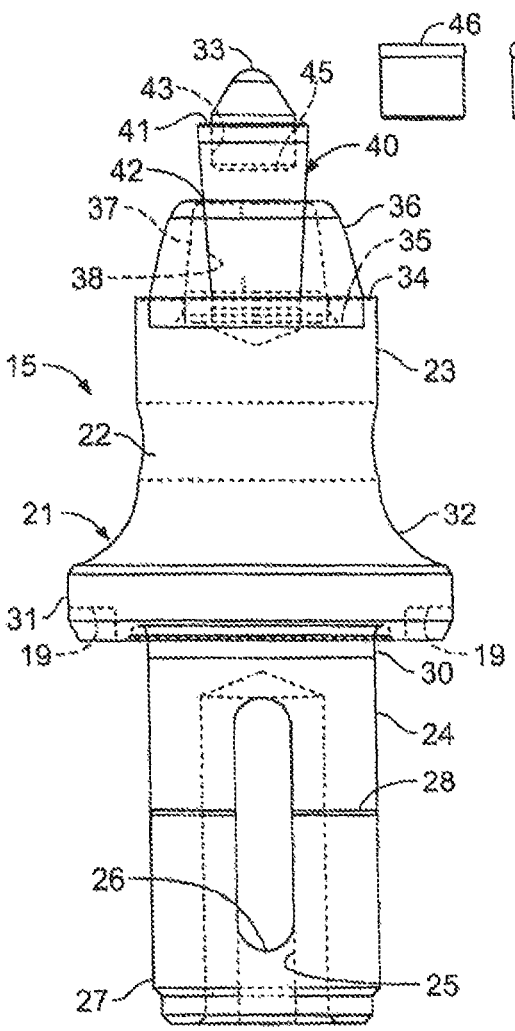
FIG. 2 is a front elevational view of the combination diamond coated tip bit/bit holder of FIG. 1 together with two alternate shape diamond coated tip inserts, showing invisible internal elements in dotted lines, in accordance with implementations of this disclosure.
Figure 3:
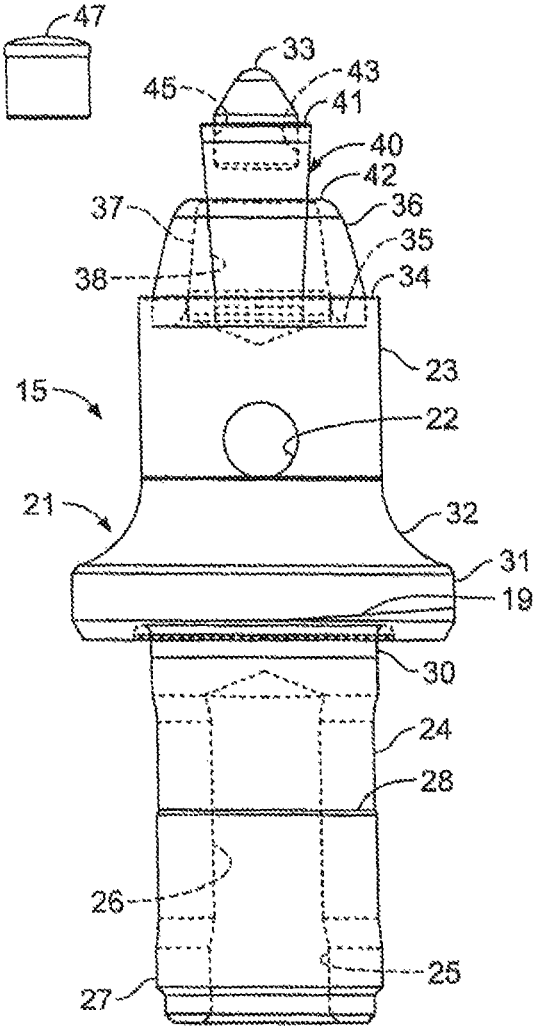
FIG. 3 is a side elevational view of the combination diamond coated tip/bit holder of FIG. 2, showing invisible internal elements in dotted lines, in accordance with implementations of this disclosure.

Referring to FIGS. 1-3, a first embodiment of the combination diamond coated bit/holder 15 includes a holder base 21 having an upper body portion 23 and a lower shank portion 24. The upper and lower shank portion are both made of 4140, 4340, or similar steel. The lower shank portion 24 is a hollow, generally cylindrical member having at least one slot 25 extending axially through the side of the hollow shank from the distal end upwardly toward the top of the shank portion. Alternately, a second, wholly internal slot 26, may be positioned preferably 180 degrees around the shank from the first slot extending in an axial direction similar to the first slot 25, however, starting from a position in spatial relation upwardly from the bottom distal end of the shank as shown at 26 in FIG. 2.

In the preferred embodiment 15, the shank 24 includes a lower resilient bit block bore engaging portion 27, and a millable shank portion 28 which may in this embodiment be a few thousandths of an inch. An uppermost part of the shank 30 immediately adjacent the larger body portion 21 includes a generally cylindrical portion having an annular outer surface sized to be press fit into the top of the bit block bore (not shown). As noted previously in U.S. Pat. Nos. 7,883,155, 6,685,273 and 6,371,567, the interference fit between the bottom shank portion 27 and a bit holder bore is substantially larger than a standard interference fit (0.001-0.003) for a solid shank, extending approximately 0.012 to 0.030 inches for a nominal 1½ inch diameter shank for use in road milling.

The upper or body portion 21 of the holder 15 includes a radially extending annular flange 31 defining the bottom of what is termed in the industry as a tire portion, diametrically the widest segment of a holder (about 2⅝ inch for a road milling holder). The height of the tire portion may approximate ½ inch and includes a pair of opposing wedge shape cutouts or wedge extraction notches 19-19. From the top of the tire portion, the body generally slopes radially inwardly at 32 and upwardly to perform a ramp-like function with the aim of moving material, macadam, concrete, etc. outwardly from the forward tip of the diamond covered leading portion 33 of the bit/holder. In this preferred embodiment, the mid section of the upper body portion of the holder 23 includes a generally cylindrical segment having at the bottom thereof a cross or through hole 22 substantially perpendicular to the longitudinal axis of the holder. This cross hole 22 extends horizontally through the body portion and forms a receiver for a drift pin 17, shown most clearly in FIG. 1 used in connection with the cup portion of a bit/holder insertion tool 16, a part of which is also shown in FIG. 1, and which will be discussed in more detail below.

This upper cylindrical segment 23 of the preferred holder body 21 is, with the exception of the through hole 22 mentioned previously, generally solid and provides a substantial portion adding bulk and toughness to the combination bit/holder 15. As shown most clearly in FIGS. 2 and 3, the upper surface 34 of the holder is also made of the same steel as the remainder of the holder and includes an annular trough 35 in which an annular tungsten carbide sleeve 36 is positioned and brazed in place. The trough provides a retainer for an annular braze disk (not shown) which when melted adheres the base of the annular tungsten carbide ring 36 to the trough bottom. Radially inwardly of the tungsten carbide ring is an annular steel axially extending flange 37 that includes a central tapered cutout portion 38. A reverse taper tungsten carbide insert 40 is fitted into that tapered bore 38 and brazed therein. The top 41 of the tungsten carbide insert 40 extends substantially beyond the top 42 of the steel annular ring 37 and with the exception of a generally cylindrical recess 43 in the top surface thereof is constructed substantially similar to the cutting tool bit shown and disclosed in the present inventor's issued U.S. Pat. No. 6,739,327. The tungsten carbide reverse taper insert 40 provides a toughened insert for holding a commercially available diamond coated tip 44 which has a generally cylindrical tungsten carbide base 45 and a diamond coated tip which may be conical 33, flat 46 or oval 47 in cross section as shown in FIG. 2. Similarly to the tungsten carbide members previously mentioned, the base 45 of the tip insert 33 is brazed into the tungsten carbide reverse tapered insert member 40.

It should be noted that during assembly, only the top part of the bit body 23 is heated by an inductance coil surrounding same to a temperature just slightly over the melting point of the brazing discs used, i.e., about 1300 degrees F. The careful positioning of the inductance coils provides for heating a minimal area of the upper portion 21 of the bit/holder 15, thus minimally affecting the grain structure, hardness, toughness etc. of the holder itself.

Figure 4:
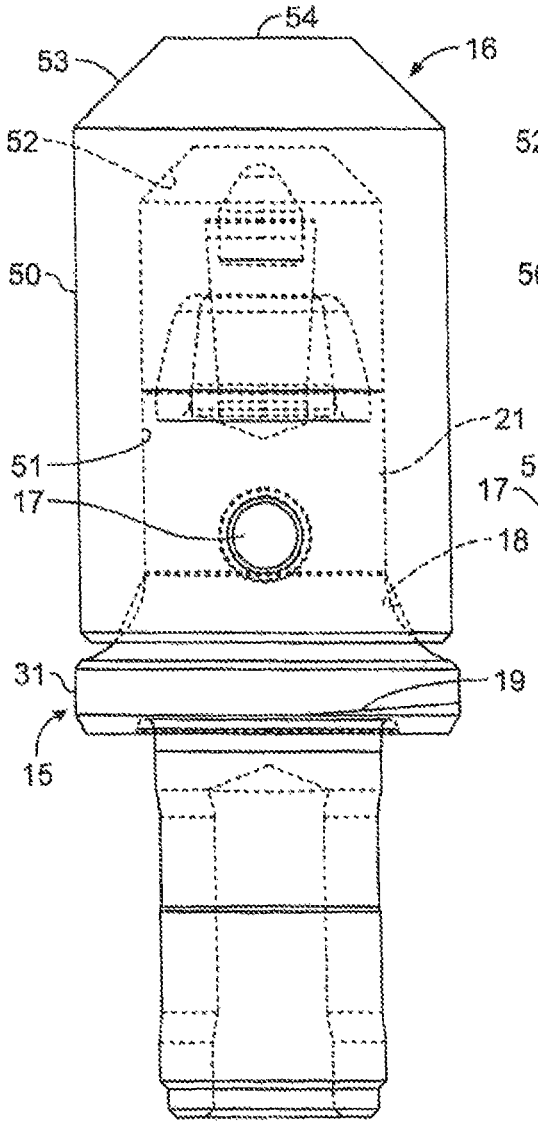
FIG. 4 is a side elevational view of the combination diamond coated bit/bit holder of FIG. 3, with a cross section of the female end of the holder insertion tool of FIG. 1 shown as mounted over the forward end of the bit/holder, showing invisible internal elements in dotted lines, in accordance with implementations of this disclosure.
Figure 5:
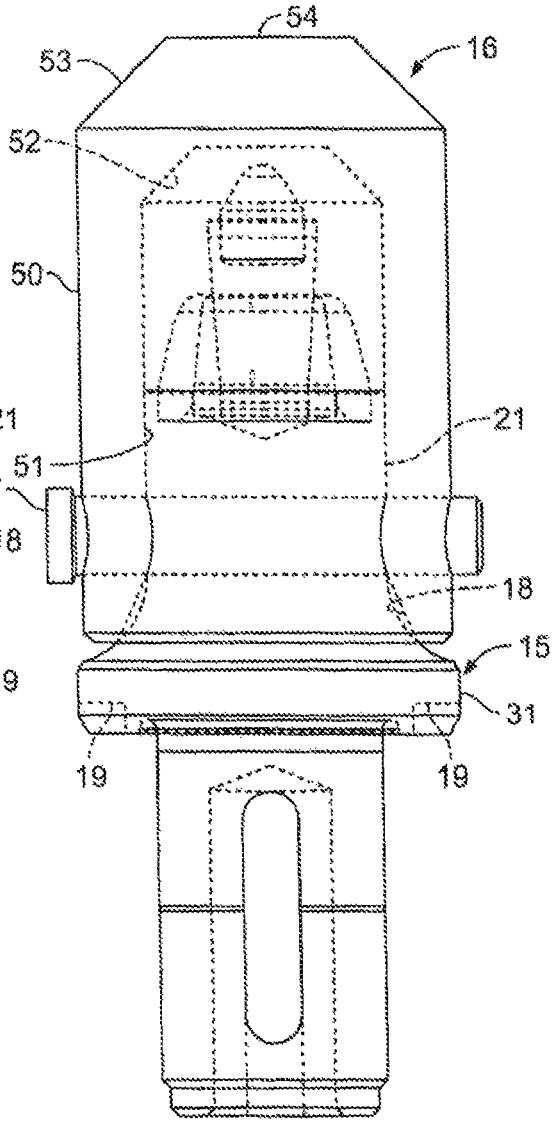
FIG. 5 is a front elevational view of the bit/holder of FIG. 4 with a cross section of the female end of the bit/holder insertion tool of FIG. 4 having the drift pin positioned through both the removal tool and the combination bit/holder, showing invisible internal elements in dotted lines, in accordance with implementations of this disclosure.

Referring to FIGS. 4 and 5, the combination diamond tip bit/holder 15 shown in FIGS. 4 and 5 is exactly the same as that described in FIGS. 1-3. What is shown in FIGS. 4 and 5 is the mounting of the female or cup shape bit portion 16 of a bit insertion/removal tool, generally at 49, (FIG. 7) as it appears mounted on the top or holder body 21 of the combination bit/holder 15 together with the drift pin 17 positioned through the central portion 21 of the holder body and the outer annular wall of the cup or female insertion-removal member 16.

As shown in FIGS. 1, 4 and 5, the female member 16 is generally cup shaped, having an outer cylindrical wall 50 and an inner, generally cylindrical bore 51 or hollow portion sized to rather loosely fit over the outside of the top 21 of the holder body 15 with a generally flared distal portion 18 sized to fit over the sloped segment 32 of the bottom of the holder body upwardly adjacent the tire portion thereof.

A bore 20-20 horizontally through the walls of the female cup member 16 is sized and positioned to align with the through or cross bore 22 in the holder body 16 to allow a drift pin 17 to be loosely (slidably) positioned therethrough. The upper hollow or bored out portion of the cup member body fits over the diamond coated bit 33, tungsten carbide insert 40, and the tungsten annular ring 36 at the recess 35 in the top wall 34 of the holder body 21. The upper portion of the cup is, in this embodiment, tapered to a frustoconical shape 53 having a generally flat upper surface 54.

Referring to FIGS. 7 and 8, the female or cup portion 16, as mentioned previously, includes an upper threaded bore 55 centrally therethrough which is adapted to receive an Acme threaded rod 56 therein as a part of a bit insertion/removal tool 50. In order to maintain the cup 16 on the Acme threaded rod 56, a nut 57 is threaded on the rod and tightened against the upper annular wall of the cupped member 16 to secure same thereon. The Acme threaded rod 56 extends from the female cup member 16 to a distal stop 58 on the opposite end of the Acme threaded rod. In between is slidably mounted a dual handle hammer member 60 having a central annular portion 61 with a central bore 62 therethrough slightly larger than the outer dimension of the Acme thread for sliding along the threaded rod 56. 180 degrees apart on opposite sides of the annular central member are mounted hand holds 63-64 perpendicularly to the bore through the central member 61, each having a form fitting grip on its distal end. In operation, once the female cup member 16 is fitted over the top 21 of the bit/holder 15 and the drift pin 17 positioned therethrough, the double hand hold slider 60 may be quickly moved axially along the Acme threaded rod 56 and rammed onto the stop 58 at the distal end thereof to provide axial hammer type outward force to enable the removal of the bit holder 15 from its respective bit block bore (not shown).

Referring to FIGS. 6, 6*a*, and 6*b*, a first modification of the diamond coated bit/holder 15 of the present invention shown in FIGS. 1-5 is substantially identical to the holder 21, tungsten carbide ring 36, and tip 33 of that embodiment. The only difference being the mounting of a steel receiving cup 65 being about ⅜-1 inch, in height, that is brazed into the forward recess 43 of the reverse taper insert 40.

The diamond coated tip 33, 33*a*, 46 and 47 is brazed into the hollow cup forward portion 66 of the steel cup insert 65. The reasoning behind the addition of the cup shaped thick bottom 67 of the steel insert 65 relates to the ductility of the steel vs. the non-ductility of the tungsten carbide insert 40. The use of a solid bottomed 67 steel cup 65 member allows the ductility of that thick cylindrical bottom pad to cushion the repeated hammer blows received at the diamond coated tip 33*a*. This added ductility to the tip end 33*a* of the bit allows that bit/holder 15 to be used not only in removing MacAdam, but also in removing a concrete and other hardened and non-homogenous materials, thus giving added life and a widened field of use for the bit/holder combination 15 over previously known diamond coated bits. Further, the tungsten carbide to steel to tungsten carbide sequence of the disclosed modification yields substantially stronger bonds than brazing tungsten carbide to tungsten carbide.

Figure 9:
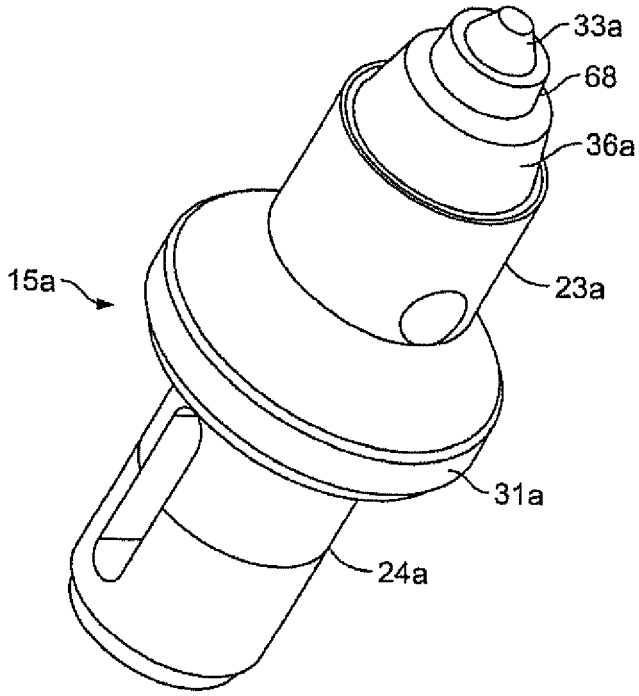
FIG. 9 is a top ¼ perspective view of a second modification of the bit/holder incorporating an annular steel front end of the bit holder adapted to receive the tungsten carbide diamond coated tip insert therein in accordance with implementations of this disclosure.
Figure 10:
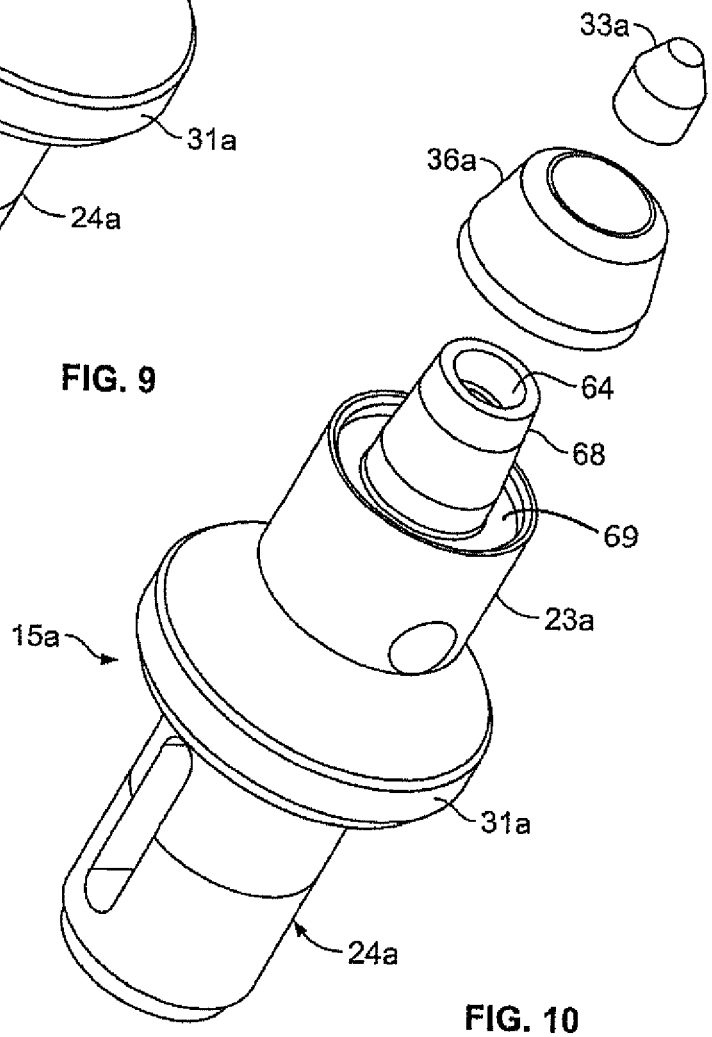
FIG. 10 is an exploded elevation view of the second modification of the bit/holder of FIG. 9 with the annular tungsten carbide ring exploded out of its annular pocket more clearly showing the steel front end of the bit holder of FIG. 9 adapted to receive the tungsten carbide diamond coated insert therein to provide added ductility and shock absorption to the assembly in accordance with implementations of this disclosure.

Referring to FIGS. 9 and 10, a second modification 15*a* of the present invention is generally shown. As with the previous modification, the portion of the holder including the shank 24*a*, tire portion 31*a*, mid and most of the upper body portion 23*a* of the holder 15*a* are identical to that shown in the first embodiment. However, the axially extending upper annular flange 68 of the holder 15*a* immediately inwardly adjacent the tungsten carbide protective ring 36*a* is substantially solid with the exception of a generally cylindrical recess 64 sized for the fitting of the diamond covered commercial insert 33*a* which may be brazed therein. This modification of the uppermost portion of the holder body provides a substantial steel mounting for the diamond coated tungsten carbide body tip 33*a*. This substantial steel upper portion 68 provides added ductility, even more so than the steel thick bottomed cup 65 shown in FIG. 6. This increased ductility acts as a shock absorber for the diamond coated tungsten carbide tip 33, 33*a*, 46 and 47 enabling same to be used in more than just the asphalt or macadam removal, which was a limitation to the use of previously known diamond coated bit tips in road milling. Additionally, the steel to tungsten carbide braze joint between the tip and the holder body is stronger than a tungsten carbide to tungsten carbide braze joint.

Figure 11:
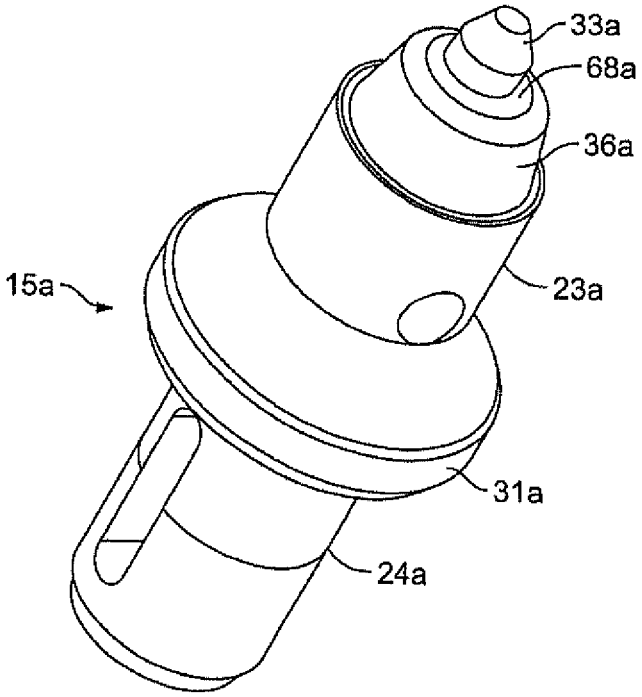
FIG. 11 is a top ¾ perspective of the second modification of the bit/holder of FIG. 9 as it appears when the bit/holder has been in use a short time with an upper distal annular end worn away in accordance with implementations of this disclosure.

Referring to FIG. 11, the bit/holder 15*a* shown in FIGS. 9 and 10 is shown as it appears after use in the field has started. In use, the bit/holder 15*a* wears adjacent its tip insert 33*a*. The steel annular ring 68 which forms the top of the upper body 23*a* of the bit/holder wears away quickly during use, as shown at 68*a* in FIG. 11, somewhat similarly to upper portion 66 of cup 65 shown in FIGS. 6, 6*a*, and 6*b*, to the extent where it generally coincides with the top surface of the tungsten carbide annular ring 36*a* after use.

The purpose of the extended initial portion of the steel annular ring 68 shown in FIGS. 9 and 10 is to seat the diamond tipped insert 33*a* in its recess 64 as shown in FIG. 10. Initially, the tungsten carbide annular ring 36*a* is seated in its recess 69 at the top of the body portion 23*a* with a ring of brazing material between that recess and the bottom of the annular ring 36*a*. A combination of the holder and tungsten carbide annular ring are heated to between 1,650-2,000 degrees F. in the first operation to join those parts of the bit holder together into a unitary structure. The tungsten carbide ring and holder are quenched and tempered to a hardness of RC 40-48, in a separate heat treatment process.

Next, the PCD or diamond insert 33*a* is positioned in recess 64 preferably over a silver brazing disc (not shown). This combination is then heated between 1,000-1,300 degrees F. by an induction heater (not shown) which encircles the upper tip portion of the bit holder 15*a*. The flow of heat through the annular steel ring 68 more effectively magnetically couples to the iron in the steel in the ring 68 to transfer heat to the tungsten carbide. The heat more efficiently goes through the steel to melt the flux and braze material between the insert 33*a* and the recess 64 of the forward tubular portion of the steel ring body 68. These two processes that join both the tungsten carbide annular ring 36*a* and the diamond tip insert 33*a* to the upper body 23*a* and recesses 69 and 64, respectively, of the inner annular ring 68 are made at two differing temperatures to provide a more stable unitary structure in the end-finished bit holder of the present invention.

Figure 12:
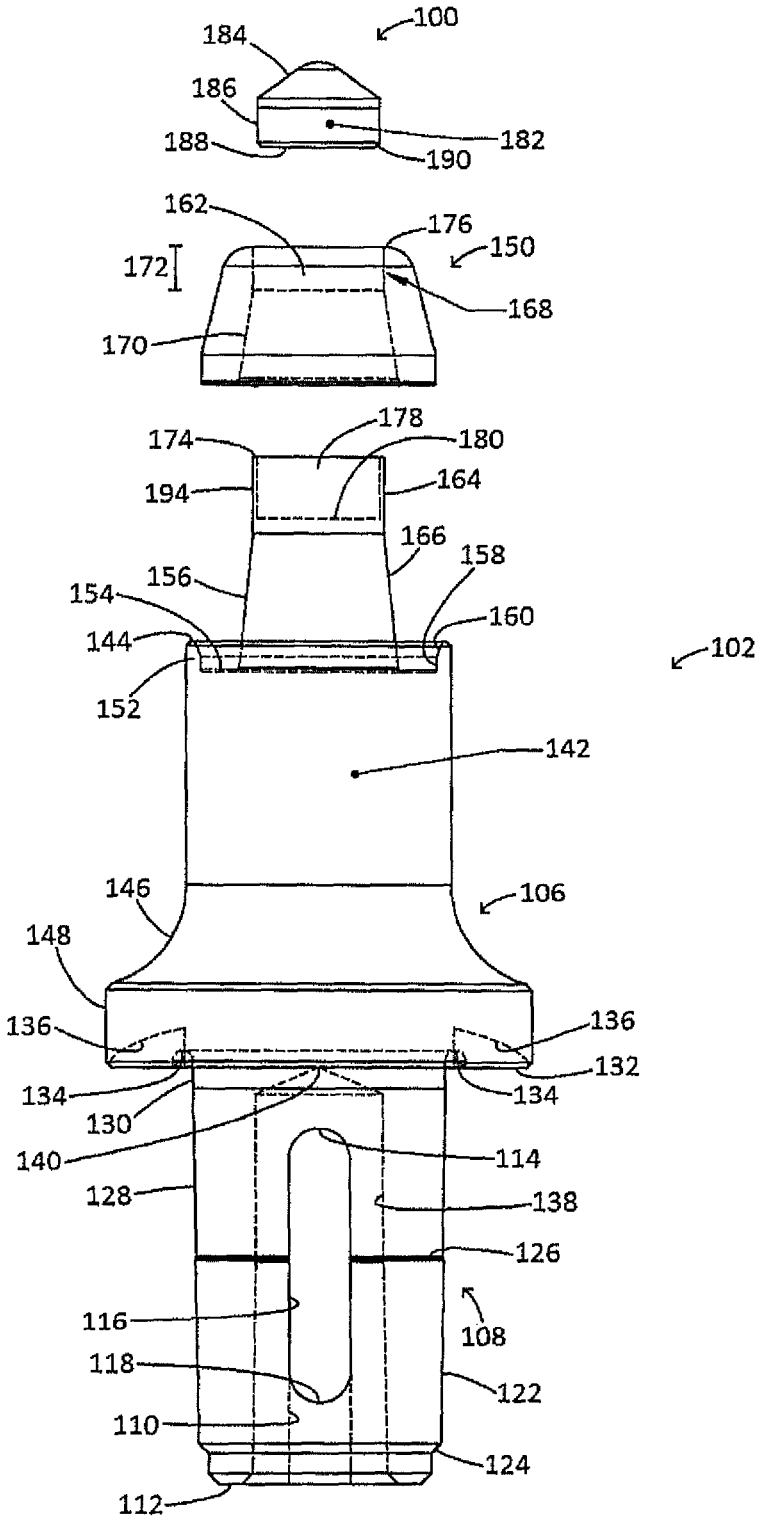
FIG. 12 is an exploded elevation view of a third embodiment of a combination diamond coated bit/holder, showing invisible internal elements in dotted lines, in accordance with implementations of this disclosure.
Figure 13:
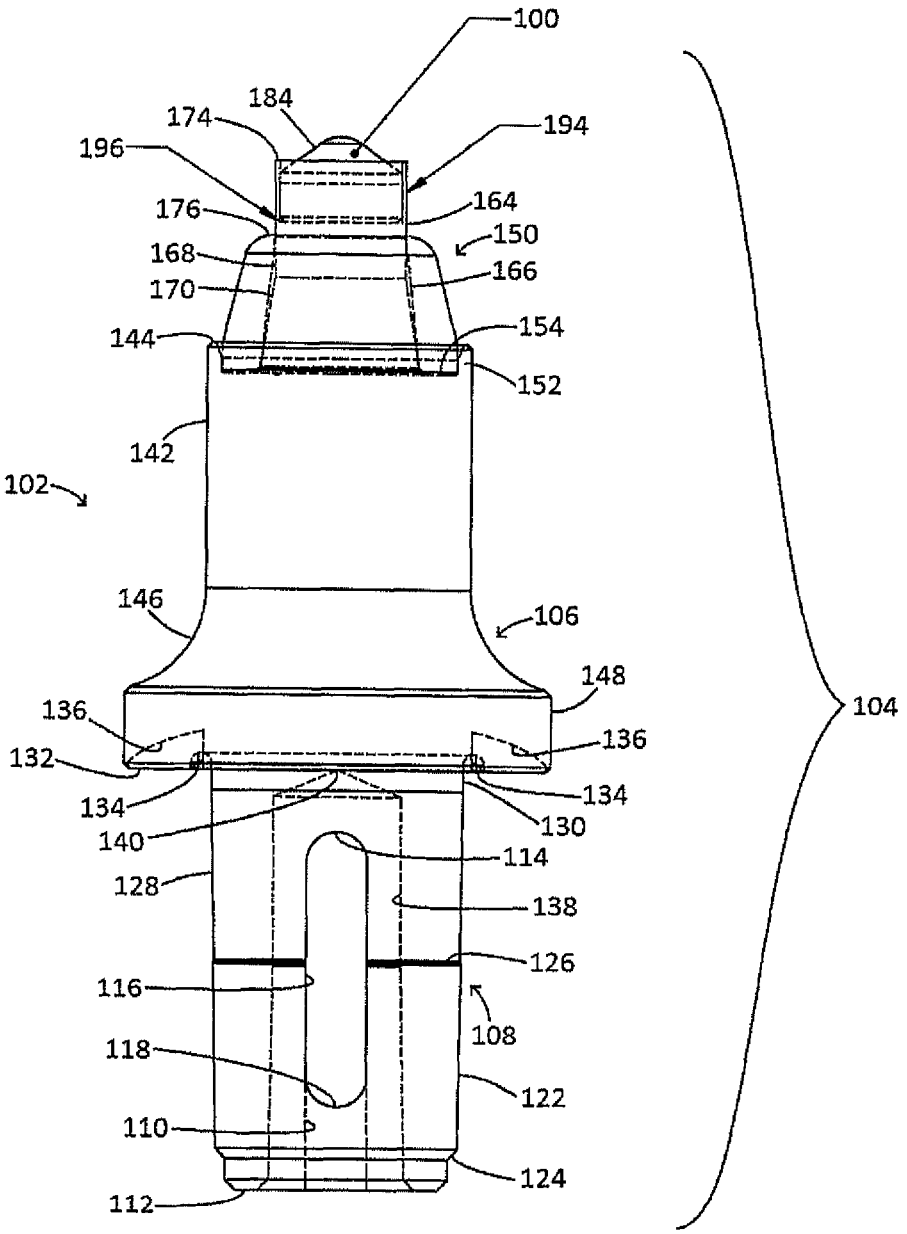
FIG. 13 is an elevation view of the third embodiment of the combination diamond coated bit/holder, showing invisible internal elements in dotted lines, in accordance with implementations of this disclosure.

Referring to FIGS. 12 and 13, a third embodiment of a combination diamond coated axially shortened bit 100 and bit holder 102 of the present disclosure forms a unitary structure bit and bit holder construction of a bit/holder, tool, and/or pick 104 (FIG. 13). The third embodiment of the bit holder 102 comprises a body 106 and a generally cylindrical hollow shank 108 depending from a bottom of the body 106. The shank 108 includes an elongate first slot 110 extending from a generally annular distal end 112 of the shank 108 axially upward or forward to an upper termination 114, which in this embodiment is adjacent the upper or forward end of the shank 108. In this illustrated embodiment, the shank 108 also includes an internally oriented second slot 116 located approximately 180 degrees around the annular shank 108 from the first slot 110. The second slot 116 is generally parallel to the first slot 110 and is an internal slot including a rearward semicircular termination 118 inwardly adjacent the distal end 112 of the shank 108 and a forward semicircular termination 120 (not shown) generally coinciding longitudinally and axially with the upper termination 114 of the first slot 110.

In this third embodiment of the bit holder 102, the shank 108 includes a lower or first tapered portion 122 running axially from a stepped shoulder 124 adjacent the distal end 112 of the shank 108. The stepped shoulder 124 is disposed between the lower tapered portion 122 and the distal end 112. A diameter of the stepped shoulder 124 increases, or steps up, in this embodiment, as it axially extends from the distal end 112 to the lower tapered portion 122. The first tapered portion 122 runs upwardly or axially from the stepped shoulder 124 of the shank 108 and terminates generally mid first slot 110 longitudinally. The shank 108 also includes an annular shoulder 126 separating the lower tapered portion 122 from an upper or second tapered portion 128 which extends from the shoulder 126 to generally adjacent to the top of the shank 108 or forward terminations 114, 120 of slots 110, 116, respectively. The annular shoulder 126 is disposed between the lower tapered portion 122 and the upper tapered portion 128. A diameter of the annular shoulder 126 decreases, or steps down, in this embodiment, as it axially extends from the lower tapered portion 122 to the upper tapered portion 128. In other embodiments, the lower portion 122 and/or the upper portion 128 of the shank 108 may comprise a generally cylindrical shape, a slight draw angle, or a slight draft angle. In yet other embodiments, the shank 108 can comprise many different configurations.

A generally cylindrical top portion 130 of the shank 108 extends from a position adjacent the top or upper terminations 114, 120 of slots 110, 116, respectively, towards a generally annular back flange 132 that denotes the base or the bottom of the body 106 of the bit holder 102. The top of the shank 108 may include a rounded junction 134 between the top portion 130 of the shank 108 and the generally annular flange 132 of the body 106 of the bit holder 102, which is provided to avoid sharp corners which may provide an area for stress cracks to begin. The generally annular flange 132 includes a pair of horizontal slots or wedge extraction notches 136-136 generally perpendicular to the longitudinal axis of the combination bit/holder, one on either side of the generally annular flange 132. The horizontal slots 136-136 are configured to receive a pair of bifurcated fork tines that may be inserted between the base of the body 106 of the bit holder 102 and a base block (not shown) into which the shank 108 of the unitary bit/holder 104 is inserted and retained by outward radial force in use.

A central bore 138 longitudinally and axially extending through the shank 108 of the bit holder 102 terminates at bore termination 140, which in this illustrated embodiment has a conical shape, which is approximately at the upper end of the shank 108. This allows the generally C-shaped annular sidewall of the shank 108 to radially contract when the shank 108 is mounted in a tapered and/or cylindrical bore in a base block (not shown).

In this third illustrated embodiment of the bit holder 102, the bit holder body 106 includes a generally cylindrical or annular upper body portion 142 depending from a forward end 144 of the upper body portion 142. A mediate body portion 146 subjacent the upper body portion 142 generally slopes axially and radially outwardly to a radially extending generally cylindrical tire portion 148.

The bit holder body 106, in order to provide superior brazing of a tungsten carbide ring 150 to the forward end 144 of the upper body portion 142, includes a forwardly extending annular collar 152 that is created on the bit holder body 106 to provide an annular trough 154 around a forward extension 156 of the bit holder body 106 onto which the annular ring 150 is mounted. In this illustrated embodiment, the annular collar 152 includes a cylindrical bottom inner wall 158 and a tapered top inner wall or countersink 160. The vertical outer wall of the collar 152 will keep brazing material from flowing outwardly of the joinder between the base of the ring 150 and the annular trough 154 on which the ring 150 is positioned. The annular trough 154 is therearound positioned perpendicular to the axis of the bit holder 102 from the smaller radially oriented annular upper or forward extension 156 (FIG. 12). Around this forward extension 156 is fitted the annular tungsten carbide ring 150, the forward extension 156 extending through a bore 162 that extends through the annular tungsten carbide ring 150 allowing a bottom of the ring 150 to be seated in the annular trough 154, which may be brazed into unitary construction with the remainder of the bit holder 102. In one exemplary implementation, the bore 162 of the annular tungsten carbide ring 150 may comprise a cylindrical upper section 168 and an outwardly tapered bottom section 170, as shown in FIGS. 12 and 13. An axial length 172 of the ring 150, corresponding to the generally cylindrical top inner portion 168 of the bore 162 of the ring 150, is designed to maintain radial support after being brazed. The clearance between the inner diameter of the bore 162 of the annular tungsten carbide ring 150 and the outer diameter of a cylindrical top portion 164 of the forward extension 156 is, in the exemplary implementation, approximately in the range of 0.003 to 0.012 inch per side depending on where the measurement is axially taken. The top or forwardmost portion of the forward extension 156 of the bit holder body 106 terminates generally at a forward end 174 of the bit holder body 106 of the bit holder 102, located above the forward portion 176 of the annular tungsten carbide ring 150. In another exemplary implementation, the bore 162 of the annular tungsten carbide ring 150 may comprise a continuous taper (not shown) from the bottom of the bore 162 to the forward portion of the annular tungsten carbide ring 150. In other implementations, the forward extension 156 and the bore 162 of the ring 150 can have complementary shaped surfaces. The bit holder 102 may be machined and hardened, or hardened and then machined. The annular tungsten carbide ring 150 may be brazed before or after hardening of the bit holder 102.

In this exemplary implementation of the third embodiment of the bit holder 102, the forward extension 156 includes a generally cylindrical top portion 164 and an outwardly tapered bottom portion 166. The generally cylindrical top portion 164, which forms the unitary steel forward end of the tubular portion of the diamond tool body, includes a bore 178 that axially extends from the forward end 174 to a bore termination 180, which in this exemplary implementation is flat, adjacent the outwardly tapered bottom portion 166. The bore 178 provides a space for receiving the complementary shaped bit 100. The bit tip insert 100 comprises a base 182 and a tip 184 adjacent the base 182 that includes a parabolic curved section below an apex of the bit tip insert 100. This tip 184 can have a frustoconical shape, a flat generally cylindrical puck shape, a parabolic ballistic shape, a conical shape, and/or an arcuate shape. In this third embodiment, the base 182 includes a generally cylindrical sidewall 186 and a tapered section 190 that extends from the cylindrical sidewall 186 to a generally flat distal end 188 of the bit tip insert 100. In an alternate embodiment, the base 182 can include a tapered sidewall and the distal end 188 of the bit tip insert 100 can be conical, frustoconical, arcuate, or have a different configuration. In one exemplary implementation of the third embodiment, the bit tip insert 100 can have a diameter in the range of ½ inch to 1⅜ inches. The bit tip insert 100 may be a tungsten carbide insert or may be a tungsten carbide insert that includes an overlay 192 (FIG. 16) of a polycrystalline diamond structure that is applied to an outer surface of the tip 184. The overlay 192 may be a single coating or outer layer or multiple coatings or outer layers of such industrial diamond material, natural diamond, polycrystalline diamond (PCD) material, and polycrystalline diamond composite or PCD material.

To assemble the combination diamond coated axially shortened bit 100 and bit holder 102 of the present disclosure and to form a unitary structure of a bit and bit holder construction of a bit/holder, tool, and/or pick 104, the annular tungsten carbide ring 150 is positioned around the forward extension 156 and brazed in the annular trough 154 of the bit holder body 106. The base 182 and the sidewall 186 of the bit tip insert 100 is brazed in the bore 178 of the forward extension 156 at the same time as the carbide ring 150 is brazed, using, for example, a disc shaped or ring shaped braze material, and also creating a high strength braze joint 196 (FIG. 13), which may then be optionally hardened. This braze joint secures the bottom of the tungsten carbide base 182 of the bit tip insert 100 to the bore termination 180 of the bore 178 of the cylindrical top portion 164 of the forward extension 156, at the forward end 174 of the diamond tool body 106. In this third embodiment, the annular sidewall 194 of the cylindrical top portion 164 of the forward extension 156 remains in place, as shown in FIG. 13, after brazing the bit tip insert 100 in the bore 178, however, the annular sidewall 194 will be quickly worn away by the abrasive action of the cut material.

Figure 14:
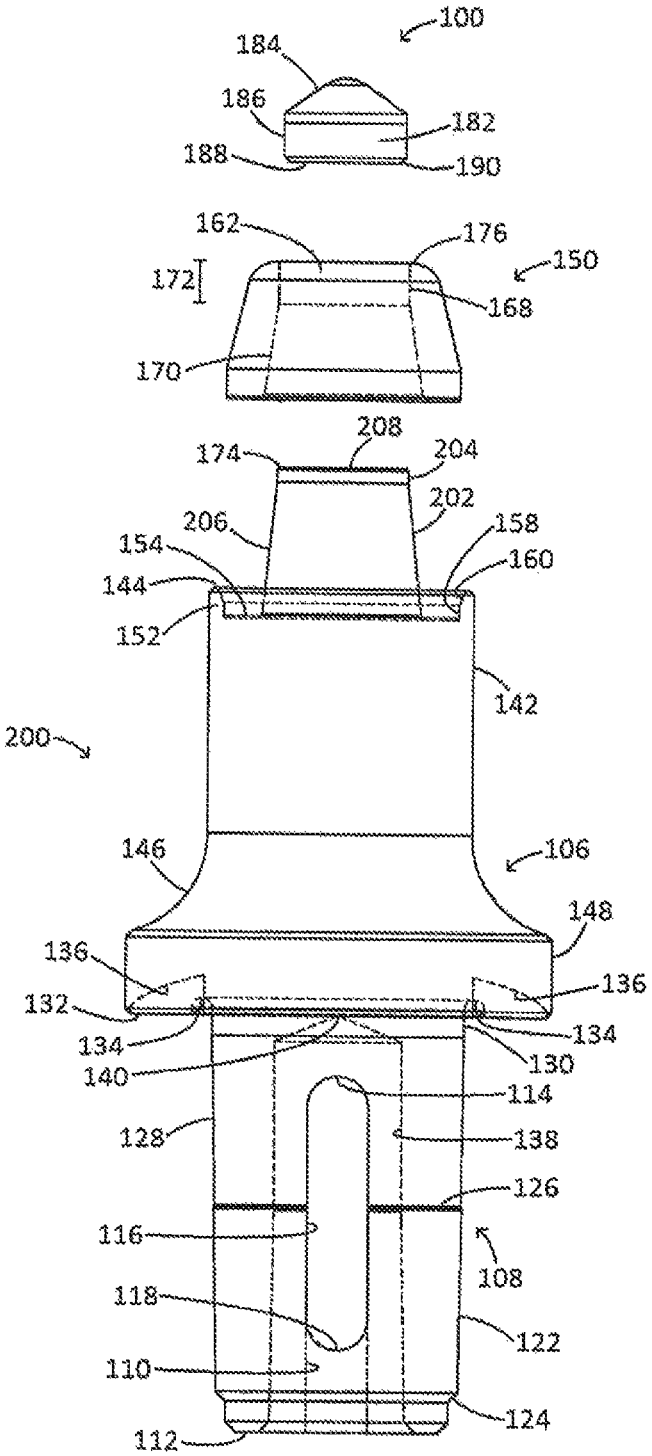
FIG. 14 is an exploded elevation view of a fourth embodiment of a combination diamond coated bit/holder, showing invisible internal elements in dotted lines, in accordance with implementations of this disclosure.
Figure 15:
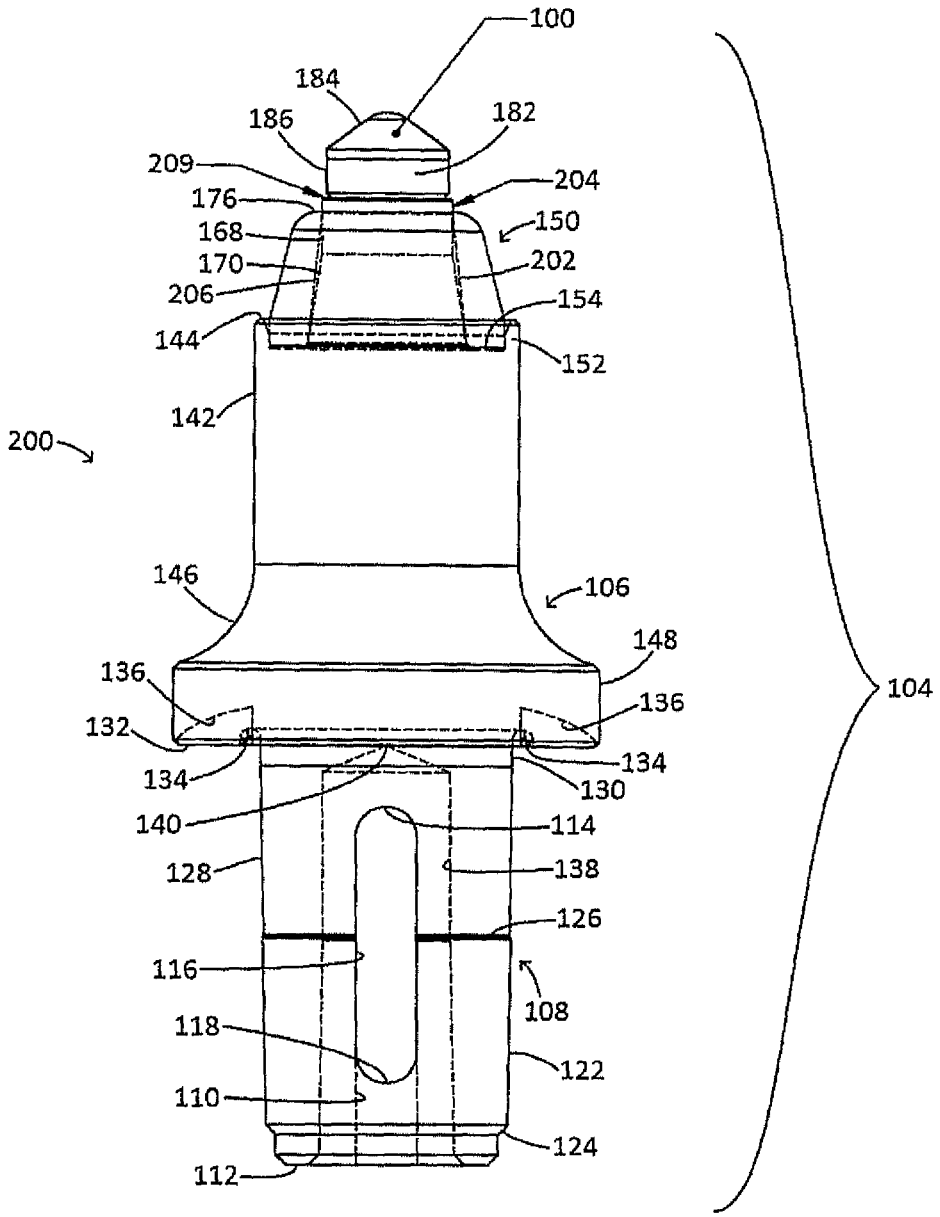
FIG. 15 is an elevation view of the fourth embodiment of the combination diamond coated bit/holder, showing invisible internal elements in dotted lines, in accordance with implementations of this disclosure.

Referring to FIGS. 14 and 15, a fourth embodiment of a combination diamond coated axially shortened bit 100 and bit holder 200 of the present disclosure forms a unitary structure bit and bit holder construction of a bit/holder, tool, and/or pick 104 (FIG. 15). The fourth embodiment of the bit holder 200 comprises a body 106 and a generally cylindrical hollow shank 108 depending from a bottom of the body 106. The shank 108 includes an elongate first slot 110 extending from a generally annular distal end 112 of the shank 108 axially upward or forward to an upper termination 114, which in this embodiment is adjacent the upper or forward end of the shank 108. In this illustrated embodiment, the shank 108 also includes an internally oriented second slot 116 located approximately 180 degrees around the annular shank 108 from the first slot 110. The second slot 116 is generally parallel to the first slot 110 and is an internal slot including a rearward semicircular termination 118 inwardly adjacent the distal end 112 of the shank 108 and a forward semicircular termination 120 (not shown) generally coinciding longitudinally and axially with the upper termination 114 of the first slot 110.

In this fourth embodiment of the bit holder 200, the shank 108 includes a lower or first tapered portion 122 running axially from a stepped shoulder 124 adjacent the distal end 112 of the shank 108. The stepped shoulder 124 is disposed between the lower tapered portion 122 and the distal end 112. A diameter of the stepped shoulder 124 increases, or steps up, in this embodiment, as it axially extends from the distal end 112 to the lower tapered portion 122. The first tapered portion 122 runs upwardly or axially from the stepped shoulder 124 of the shank 108 and terminates generally mid first slot 110 longitudinally. The shank 108 also includes an annular shoulder 126 separating the lower tapered portion 122 from an upper or second tapered portion 128 which extends from the shoulder 126 to generally adjacent to the top of the shank 108 or forward terminations 114, 120 of slots 110, 116, respectively. The annular shoulder 126 is disposed between the lower tapered portion 122 and the upper tapered portion 128. A diameter of the annular shoulder 126 decreases, or steps down, in this embodiment, as it axially extends from the lower tapered portion 122 to the upper tapered portion 128. In other embodiments, the lower portion 122 and/or the upper portion 128 of the shank 108 may comprise a generally cylindrical shape, a slight draw angle, or a slight draft angle. In yet other embodiments, the shank 108 can comprise many different configurations.

A generally cylindrical top portion 130 of the shank 108 extends from a position adjacent the top or upper terminations 114, 120 of slots 110, 116, respectively, towards a generally annular back flange 132 that denotes the base or the bottom of the body 106 of the bit holder 200. The top of the shank 108 may include a rounded junction 134 between the top portion 130 of the shank 108 and the generally annular flange 132 of the body 106 of the bit holder 102, which is provided to avoid sharp corners which may provide an area for stress cracks to begin. The generally annular flange 132 includes a pair of horizontal slots or wedge extraction notches 136-136 generally perpendicular to the longitudinal axis of the combination bit/holder, one on either side of the generally annular flange 132. The horizontal slots 136-136 are configured to receive a pair of bifurcated fork tines that may be inserted between the base of the body 106 of the bit holder 200 and a base block (not shown) into which the shank 108 of the unitary bit/holder 104 is inserted and retained by outward radial force in use.

A central bore 138 longitudinally and axially extending through the shank 108 of the bit holder 200 terminates at bore termination 140, which in this illustrated embodiment has a conical shape, which is approximately at the upper end of the shank 108. This allows the generally C-shaped annular sidewall of the shank 108 to radially contract when the shank 108 is mounted in a tapered and/or cylindrical bore in a base block (not shown).

In this fourth illustrated embodiment of the bit holder 200, the bit holder body 106 includes a generally cylindrical or annular upper body portion 142 depending from a forward end 144 of the upper body portion 142. A mediate body portion 146 subjacent the upper body portion 142 generally slopes axially and radially outwardly to a radially extending generally cylindrical tire portion 148.

The bit holder body 106, in order to provide superior brazing of a tungsten carbide ring 150 to the forward end 144 of the upper body portion 142, includes a forwardly extending annular collar 152 that is created on the bit holder body 106 to provide an annular trough 154 around a forward extension 156 of the bit holder body 106 onto which the annular ring 150 is mounted. In this illustrated embodiment, the annular collar 152 includes a cylindrical bottom inner wall 158 and a tapered top inner wall or countersink 160. The vertical outer wall of the collar 152 will keep brazing material from flowing outwardly of the joinder between the base of the ring 150 and the annular trough 154 on which the ring 150 is positioned. The annular trough 154 is therearound positioned perpendicular to the axis of the bit holder 200 from the smaller radially oriented annular upper or forward extension 202 (FIG. 14). Around this forward extension 202 is fitted the annular tungsten carbide ring 150, the forward extension 202 extending through a bore 162 that extends through the annular tungsten carbide ring 150 allowing a bottom of the ring 150 to be seated in the annular trough 154, which may be brazed into unitary construction with the remainder of the bit holder 200. In one exemplary implementation, the bore 162 of the annular tungsten carbide ring 150 may comprise a cylindrical upper section 168 and an outwardly tapered bottom section 170, as shown in FIGS. 14 and 15. An axial length 172 of the ring 150, corresponding to the generally cylindrical top inner portion 168 of the bore 162 of the ring 150, is designed to maintain radial support after being brazed. The clearance between the inner diameter of the bore 162 of the annular tungsten carbide ring 150 and the outer diameter of the cylindrical top portion 164 of the forward extension 202 is, in the exemplary implementation, approximately in the range of 0.003 to 0.012 inch per side depending on where the measurement is axially taken. The top or forwardmost portion of the forward extension 202 of the bit holder body 106 terminates generally at a forward end 174 of the bit holder body 106 of the bit holder 200, located above the forward portion 176 of the annular tungsten carbide ring 150. In another exemplary implementation, the bore 162 of the annular tungsten carbide ring 150 may comprise a continuous taper (not shown) from the bottom of the bore 162 to the forward portion of the annular tungsten carbide ring 150. In other implementations, the forward extension 202 and the bore 162 of the ring 150 can have complementary shaped surfaces. The bit holder 200 may be machined and hardened, or hardened and then machined. The annular tungsten carbide ring 150 may be brazed before or after hardening of the bit holder 200.

In this exemplary implementation of the fourth embodiment of the bit holder 200, the forward extension 202 includes a generally cylindrical top portion 204 and an outwardly tapered bottom portion 206. The generally cylindrical top portion 204 forms the unitary steel forward end of the tubular portion of the diamond tool body and provides a forward surface 208 for receiving the complementary shaped bit 100. The bit tip insert 100 comprises a base 182 and a tip 184 adjacent the base 182 that includes a parabolic curved section below an apex of the bit tip insert 100. This tip 184 can have a frustoconical shape, a flat generally cylindrical puck shape, a parabolic ballistic shape, a conical shape, and/or an arcuate shape. In this fourth embodiment, the base 182 includes a generally cylindrical sidewall 186 and a tapered section 190 that extends from the cylindrical sidewall 186 to a generally flat distal end 188 of the bit tip insert 100. In an alternate embodiment, the base 182 can include a tapered sidewall and the distal end 188 of the bit tip insert 100 can be conical, frustoconical, arcuate, or have a different configuration. In one exemplary implementation of the fourth embodiment, the bit tip insert 100 can have a diameter in the range of ½ inch to 1⅜ inches. The bit tip insert 100 may be a tungsten carbide insert or may be a tungsten carbide insert that includes an overlay 192 (FIG. 16) of a polycrystalline diamond structure that is applied to an outer surface of the tip 184. The overlay 192 may be a single coating or outer layer or multiple coatings or outer layers of such industrial diamond material, natural diamond, polycrystalline diamond (PCD) material, and polycrystalline diamond composite or PCD material.

To assemble the combination diamond coated axially shortened bit 100 and bit holder 200 of the present disclosure and to form a unitary structure of a bit and bit holder construction of a bit/holder, tool, and/or pick 104, the annular tungsten carbide ring 150 is positioned around the forward extension 202 is brazed in the annular trough 154 of the bit holder body 106. The distal end 188 and the sidewall 186 of the bit tip insert 100 is brazed to the forward surface 208 (FIG. 14) of the forward extension 202 at the same time as the carbide ring 150 is brazed, using, for example, a disc shaped or ring shaped braze material, and also creating a high strength braze joint 209 (FIG. 15), which may then be optionally hardened. This braze joint secures the bottom of the tungsten carbide base 182 and distal end 188 (FIG. 14) of the bit tip insert 100 to the forward surface 208 and cylindrical top portion 204 of the forward extension 202 of the diamond tool body 106.

Figure 16:
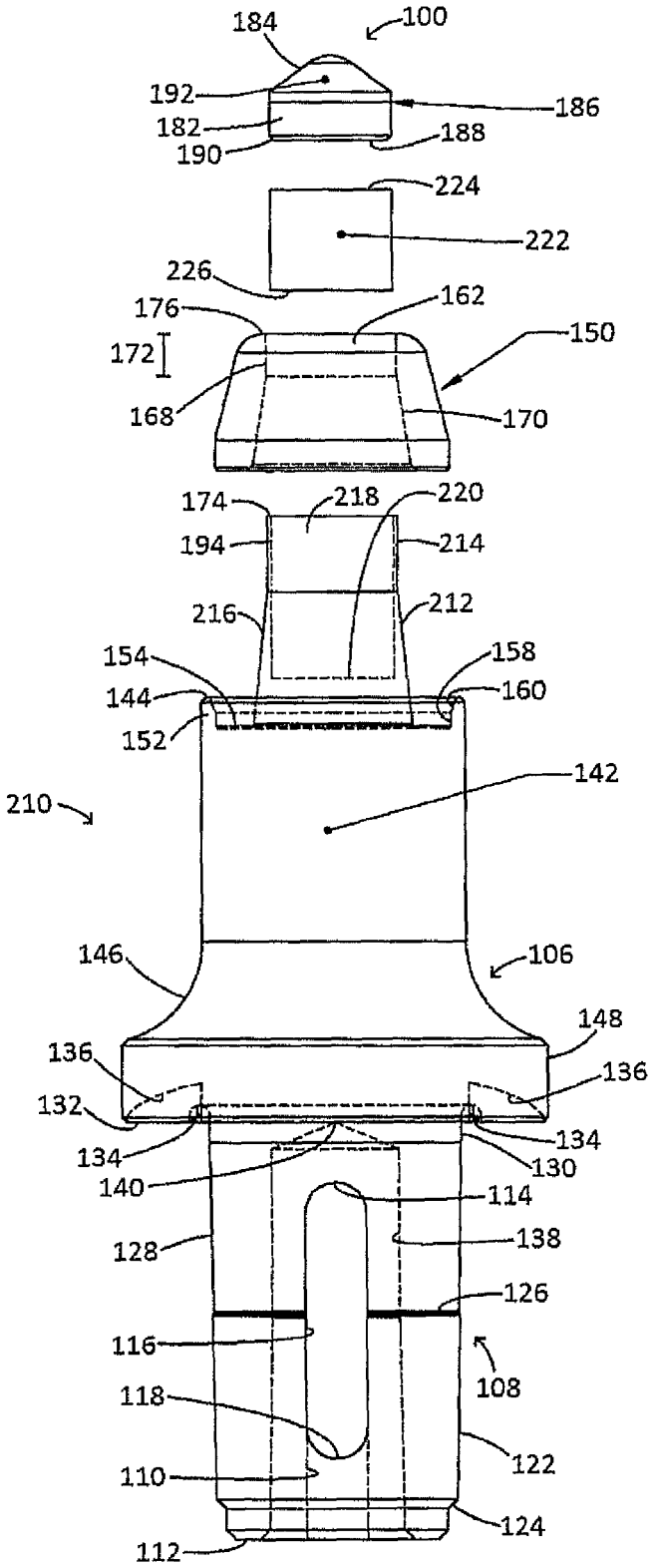
FIG. 16 is an exploded elevation view of a fifth embodiment of a combination diamond coated bit/holder, showing invisible internal elements in dotted lines, in accordance with implementations of this disclosure.
Figure 17:
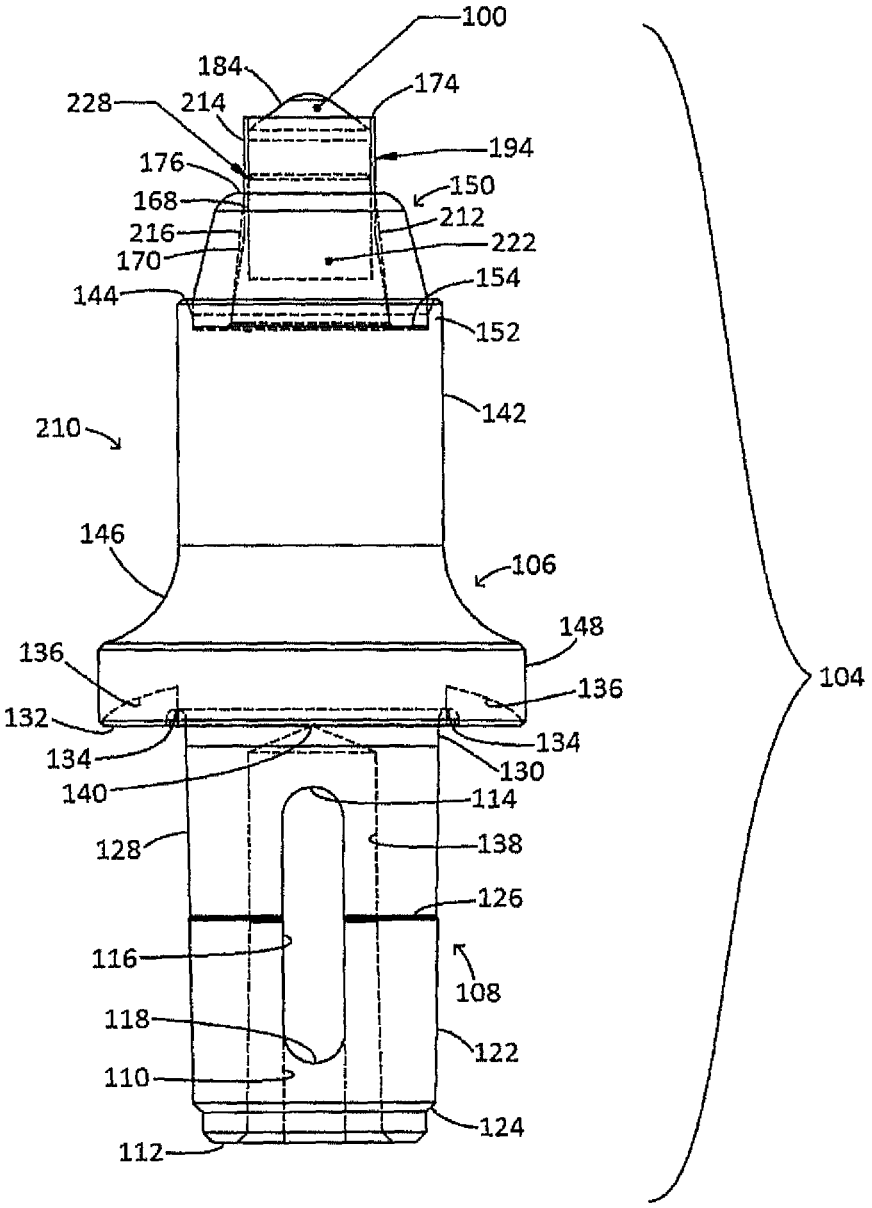
FIG. 17 is an elevation view of the fifth embodiment of the combination diamond coated bit/holder, showing invisible internal elements in dotted lines, in accordance with implementations of this disclosure.

Referring to FIGS. 16 and 17, a fifth embodiment of a combination diamond coated axially shortened bit 100 and bit holder 210 of the present disclosure forms a unitary structure bit and bit holder construction of a bit/holder, tool, and/or pick 104 (FIG. 17). The fifth embodiment of the bit holder 210 comprises a body 106 and a generally cylindrical hollow shank 108 depending from a bottom of the body 106. The shank 108 includes an elongate first slot 110 extending from a generally annular distal end 112 of the shank 108 axially upward or forward to an upper termination 114, which in this embodiment is adjacent the upper or forward end of the shank 108. In this illustrated embodiment, the shank 108 also includes an internally oriented second slot 116 located approximately 180 degrees around the annular shank 108 from the first slot 110. The second slot 116 is generally parallel to the first slot 110 and is an internal slot including a rearward semicircular termination 118 inwardly adjacent the distal end 112 of the shank 108 and a forward semicircular termination 120 (not shown) generally coinciding longitudinally and axially with the upper termination 114 of the first slot 110.

In this fifth embodiment of the bit holder 210, the shank 108 includes a lower or first tapered portion 122 running axially from a stepped shoulder 124 adjacent the distal end 112 of the shank 108. The stepped shoulder 124 is disposed between the lower tapered portion 122 and the distal end 112. A diameter of the stepped shoulder 124 increases, or steps up, in this embodiment, as it axially extends from the distal end 112 to the lower tapered portion 122. The first tapered portion 122 runs upwardly or axially from the stepped shoulder 124 of the shank 108 and terminates generally mid first slot 110 longitudinally. The shank 108 also includes an annular shoulder 126 separating the lower tapered portion 122 from an upper or second tapered portion 128 which extends from the shoulder 126 to generally adjacent to the top of the shank 108 or forward terminations 114, 120 of slots 110, 116, respectively. The annular shoulder 126 is disposed between the lower tapered portion 122 and the upper tapered portion 128. A diameter of the annular shoulder 126 decreases, or steps down, in this embodiment, as it axially extends from the lower tapered portion 122 to the upper tapered portion 128. In other embodiments, the lower portion 122 and/or the upper portion 128 of the shank 108 may comprise a generally cylindrical shape, a slight draw angle, or a slight draft angle. In yet other embodiments, the shank 108 can comprise many different configurations.

A generally cylindrical top portion 130 of the shank 108 extends from a position adjacent the top or upper terminations 114, 120 of slots 110, 116, respectively, towards a generally annular back flange 132 that denotes the base or the bottom of the body 106 of the bit holder 210. The top of the shank 108 may include a rounded junction 134 between the top portion 130 of the shank 108 and the generally annular flange 132 of the body 106 of the bit holder 210, which is provided to avoid sharp corners which may provide an area for stress cracks to begin. The generally annular flange 132 includes a pair of horizontal slots or wedge extraction notches 136-136 generally perpendicular to the longitudinal axis of the combination bit/holder, one on either side of the generally annular flange 132. The horizontal slots 136-136 are configured to receive a pair of bifurcated fork tines that may be inserted between the base of the body 106 of the bit holder 210 and a base block (not shown) into which the shank 108 of the unitary bit/holder 104 is inserted and retained by outward radial force in use.

A central bore 138 longitudinally and axially extending through the shank 108 of the bit holder 210 terminates at bore termination 140, which in this illustrated embodiment has a conical shape, which is approximately at the upper end of the shank 108. This allows the generally C-shaped annular sidewall of the shank 108 to radially contract when the shank 108 is mounted in a tapered and/or cylindrical bore in a base block (not shown).

In this fifth illustrated embodiment of the bit holder 210, the bit holder body 106 includes a generally cylindrical or annular upper body portion 142 depending from a forward end 144 of the upper body portion 142. A mediate body portion 146 subjacent the upper body portion 142 generally slopes axially and radially outwardly to a radially extending generally cylindrical tire portion 148.

The bit holder body 106, in order to provide superior brazing of a tungsten carbide ring 150 to the forward end 144 of the upper body portion 142, includes a forwardly extending annular collar 152 that is created on the bit holder body 106 to provide an annular trough 154 around a forward extension 156 of the bit holder body 106 onto which the annular ring 150 is mounted. In this illustrated embodiment, the annular collar 152 includes a cylindrical bottom inner wall 158 and a tapered top inner wall or countersink 160. The vertical outer wall of the collar 152 will keep brazing material from flowing outwardly of the joinder between the base of the ring 150 and the annular trough 154 on which the ring 150 is positioned. The annular trough 154 is therearound positioned perpendicular to the axis of the bit holder 210 from the smaller radially oriented annular upper or forward extension 212 (FIG. 16). Around this forward extension 212 is fitted the annular tungsten carbide ring 150, the forward extension 212 extending through a bore 162 that extends through the annular tungsten carbide ring 150 allowing a bottom of the ring 150 to be seated in the annular trough 154, which may be brazed into unitary construction with the remainder of the bit holder 210. In one exemplary implementation, the bore 162 of the annular tungsten carbide ring 150 may comprise a cylindrical upper section 168 and an outwardly tapered bottom section 170, as shown in FIGS. 16 and 17. An axial length 172 of the ring 150, corresponding to the generally cylindrical top inner portion 168 of the bore 162 of the ring 150, is designed to maintain radial support after being brazed. The clearance between the inner diameter of the bore 162 of the annular tungsten carbide ring 150 and the outer diameter of a cylindrical top portion 214 of the forward extension 212 is, in the exemplary implementation, approximately in the range of 0.003 to 0.012 inch per side depending on where the measurement is axially taken. The top or forwardmost portion of the forward extension 212 of the bit holder body 106 terminates generally at a forward end 174 of the bit holder body 106 of the bit holder 210, located above the forward portion 176 of the annular tungsten carbide ring 150. In another exemplary implementation, the bore 162 of the annular tungsten carbide ring 150 may comprise a continuous taper (not shown) from the bottom of the bore 162 to the forward portion of the annular tungsten carbide ring 150. In other implementations, the forward extension 212 and the bore 162 of the ring 150 can have complementary shaped surfaces. The bit holder 210 may be machined and hardened, or hardened and then machined. The annular tungsten carbide ring 150 may be brazed before or after hardening of the bit holder 210.

In this exemplary implementation of the fifth embodiment of the bit holder 210, the forward extension 212 includes the generally cylindrical top portion 214 and an outwardly tapered bottom portion 216. The forward extension 212, which forms the unitary steel forward end of the tubular portion of the diamond tool body, includes a bore 218 that axially extends from the forward end 174, through the generally cylindrical top portion 214 and partially through the tapered bottom portion 216, to a bore termination 220, which in this exemplary implementation is flat, adjacent the forward end 144 of the upper body portion 142. The bore 218 provides a space for receiving a generally cylindrical tungsten carbide extension plug 222 and the complementary shaped bit 100. The bit tip insert 100 comprises a base 182 and a tip 184 adjacent the base 182 that includes a parabolic curved section below an apex of the bit tip insert 100. This tip 184 can have a frustoconical shape, a flat generally cylindrical puck shape, a parabolic ballistic shape, a conical shape, and/or an arcuate shape. In this fifth embodiment, the base 182 includes a generally cylindrical sidewall 186 and a tapered section 190 that extends from the cylindrical sidewall 186 to a generally flat distal end 188 of the bit tip insert 100. In an alternate embodiment, the base 182 can include a tapered sidewall and the distal end 188 of the bit tip insert 100 can be conical, frustoconical, arcuate, or have a different configuration. In one exemplary implementation of the fifth embodiment, the bit tip insert 100 can have a diameter in the range of ½ inch to 1⅜ inches. The bit tip insert 100 may be a tungsten carbide insert or may be a tungsten carbide insert that includes an overlay 192 (FIG. 16) of a polycrystalline diamond structure that is applied to an outer surface of the tip 184. The overlay 192 may be a single coating or outer layer or multiple coatings or outer layers of such industrial diamond material, natural diamond, polycrystalline diamond (PCD) material, and polycrystalline diamond composite or PCD material.

To assemble the combination diamond coated axially shortened bit 100 and bit holder 210 of the present disclosure to form a unitary structure bit and bit holder construction of a bit/holder, tool, and/or pick 104 (FIG. 17). The annular tungsten carbide ring 150 is positioned around the forward extension 212 and brazed in the annular trough 154 of the bit holder body 106. The base 182 and the sidewall 186 of the bit tip insert 100 is brazed to a forward end 224 of the tungsten carbide extension plug 222 at the same time as the carbide ring 150 is brazed, using, for example, a disc shaped or ring shaped braze material, and also creating a high strength braze joint 228 (FIG. 17) between the base 182 of the bit tip insert 100 and the forward end 224 of the tungsten carbide extension plug 222, which may then be optionally hardened. A distal end 226 of the tungsten carbide extension plug 222 is brazed in the bore 218 of the forward extension 212 at the same time as the bit tip insert 100 and the carbide ring 150 are brazed, using, for example, a disc shaped or ring shaped braze material, and also creating a high strength braze joint, which may then be optionally hardened. This braze joint secures the distal end 226 of the tungsten carbide extension plug 222 to the bore termination 220 and to the bore 218 of the forward extension 212, adjacent the forward end 174 of the diamond tool body 106. The three parts, the bit tip insert 100, the tungsten carbide ring 150, and the tungsten carbide extension plug 222, are brazed together in a one-step brazing process. In this fifth embodiment, the annular sidewall 194 of the cylindrical top portion 214 of the forward extension 212 remains in place, as shown in FIG. 17, after brazing the combination bit tip insert 100 and tungsten carbide extension plug 222 in the bore 218, however, the annular sidewall 194 will be quickly worn away by the abrasive action of the cut material.

Figure 18:
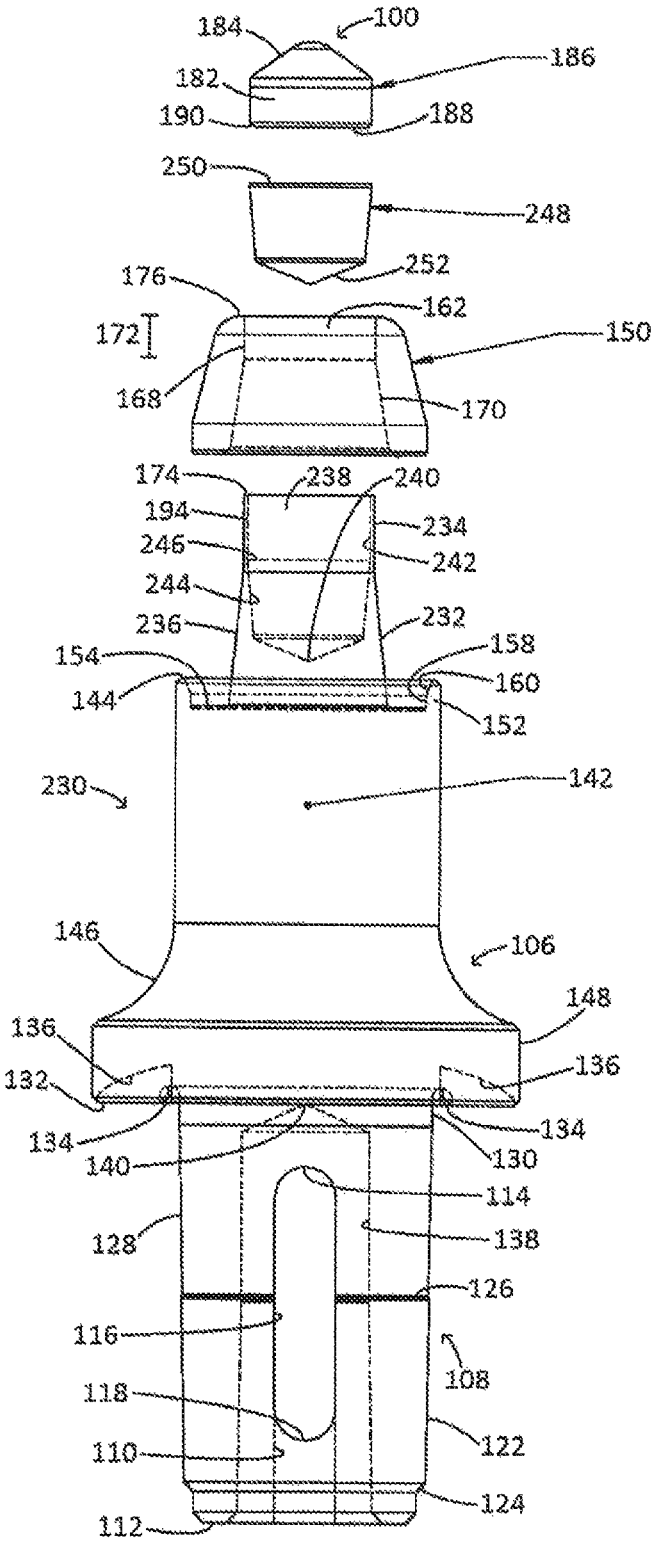
FIG. 18 is an exploded elevation view of a sixth embodiment of a combination diamond coated bit/holder, showing invisible internal elements in dotted lines, in accordance with implementations of this disclosure.
Figure 19:
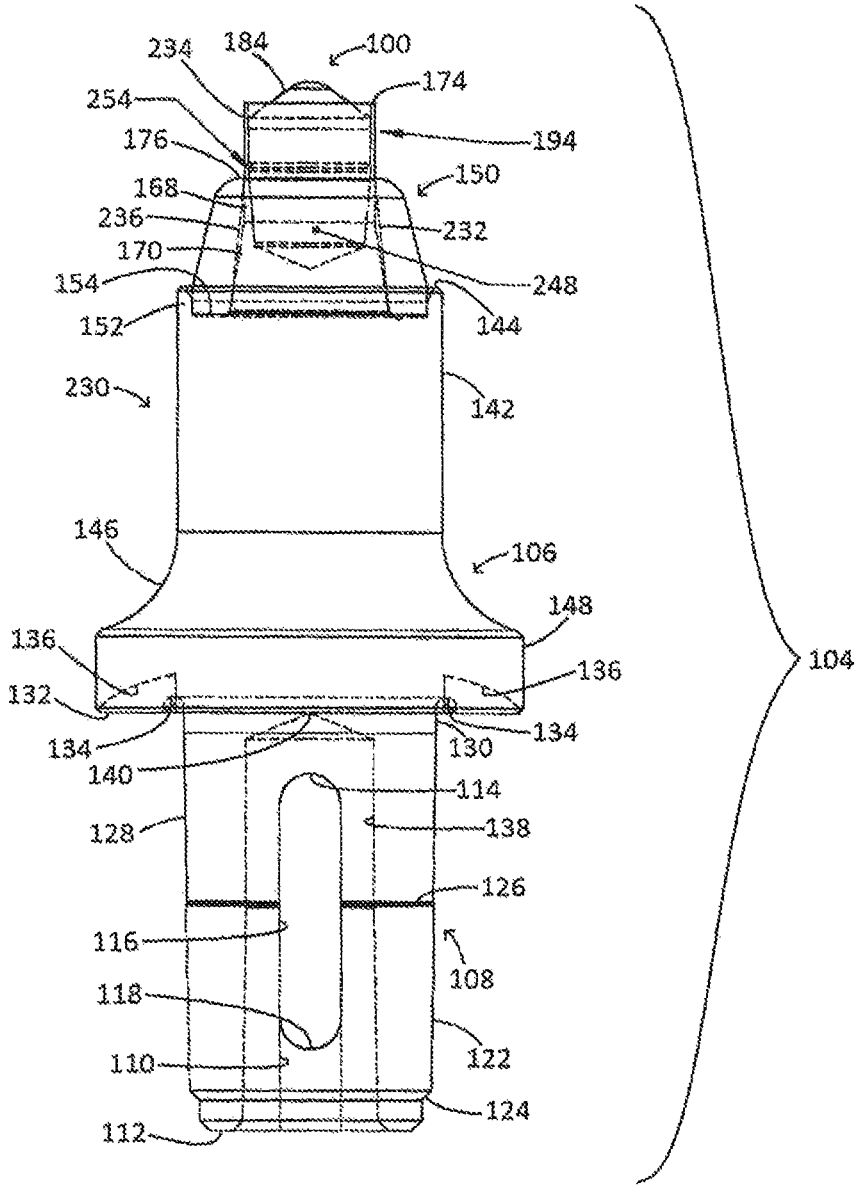
FIG. 19 is an elevation view of the sixth embodiment of the combination diamond coated bit/holder, showing invisible internal elements in dotted lines, in accordance with implementations of this disclosure

Referring to FIGS. 18 and 19, a sixth embodiment of a combination diamond coated axially shortened bit 100 and bit holder 230 of the present disclosure forms a unitary structure bit and bit holder construction of a bit/holder, tool, and/or pick 104 (FIG. 19). The sixth embodiment of the bit holder 230 comprises a body 106 and a generally cylindrical hollow shank 108 depending from a bottom of the body 106. The shank 108 includes an elongate first slot 110 extending from a generally annular distal end 112 of the shank 108 axially upward or forward to an upper termination 114, which in this embodiment is adjacent the upper or forward end of the shank 108. In this illustrated embodiment, the shank 108 also includes an internally oriented second slot 116 located approximately 180 degrees around the annular shank 108 from the first slot 110. The second slot 116 is generally parallel to the first slot 110 and is an internal slot including a rearward semicircular termination 118 inwardly adjacent the distal end 112 of the shank 108 and a forward semicircular termination 120 (not shown) generally coinciding longitudinally and axially with the upper termination 114 of the first slot 110.

In this sixth embodiment of the bit holder 230, the shank 108 includes a lower or first tapered portion 122 running axially from a stepped shoulder 124 adjacent the distal end 112 of the shank 108. The stepped shoulder 124 is disposed between the lower tapered portion 122 and the distal end 112. A diameter of the stepped shoulder 124 increases, or steps up, in this embodiment, as it axially extends from the distal end 112 to the lower tapered portion 122. The first tapered portion 122 runs upwardly or axially from the stepped shoulder 124 of the shank 108 and terminates generally mid first slot 110 longitudinally. The shank 108 also includes an annular shoulder 126 separating the lower tapered portion 122 from an upper or second tapered portion 128 which extends from the shoulder 126 to generally adjacent to the top of the shank 108 or forward terminations 114, 120 of slots 110, 116, respectively. The annular shoulder 126 is disposed between the lower tapered portion 122 and the upper tapered portion 128. A diameter of the annular shoulder 126 decreases, or steps down, in this embodiment, as it axially extends from the lower tapered portion 122 to the upper tapered portion 128. In other embodiments, the lower portion 122 and/or the upper portion 128 of the shank 108 may comprise a generally cylindrical shape, a slight draw angle, or a slight draft angle. In yet other embodiments, the shank 108 can comprise many different configurations.

A generally cylindrical top portion 130 of the shank 108 extends from a position adjacent the top or upper terminations 114, 120 of slots 110, 116, respectively, towards a generally annular back flange 132 that denotes the base or the bottom of the body 106 of the bit holder 230. The top of the shank 108 may include a rounded junction 134 between the top portion 130 of the shank 108 and the generally annular flange 132 of the body 106 of the bit holder 230, which is provided to avoid sharp corners which may provide an area for stress cracks to begin. The generally annular flange 132 includes a pair of horizontal slots or wedge extraction notches 136-136 generally perpendicular to the longitudinal axis of the combination bit/holder, one on either side of the generally annular flange 132. The horizontal slots 136-136 are configured to receive a pair of bifurcated fork tines that may be inserted between the base of the body 106 of the bit holder 230 and a base block (not shown) into which the shank 108 of the unitary bit/holder 104 is inserted and retained by outward radial force in use.

A central bore 138 longitudinally and axially extending through the shank 108 of the bit holder 230 terminates at bore termination 140, which in this illustrated embodiment has a conical shape, which is approximately at the upper end of the shank 108. This allows the generally C-shaped annular sidewall of the shank 108 to radially contract when the shank 108 is mounted in a tapered and/or cylindrical bore in a base block (not shown).

In this sixth illustrated embodiment of the bit holder 230, the bit holder body 106 includes a generally cylindrical or annular upper body portion 142 depending from a forward end 144 of the upper body portion 142. A mediate body portion 146 subjacent the upper body portion 142 generally slopes axially and radially outwardly to a radially extending generally cylindrical tire portion 148.

The bit holder body 106, in order to provide superior brazing of a tungsten carbide ring 150 to the forward end 144 of the upper body portion 142, includes a forwardly extending annular collar 152 that is created on the bit holder body 106 to provide an annular trough 154 around a forward extension 232 of the bit holder body 106 onto which the annular ring 150 is mounted. In this illustrated embodiment, the annular collar 152 includes a cylindrical bottom inner wall 158 and a tapered top inner wall or countersink 160. The vertical outer wall of the collar 152 will keep brazing material from flowing outwardly of the joinder between the base of the ring 150 and the annular trough 154 on which the ring 150 is positioned. The annular trough 154 is therearound positioned perpendicular to the axis of the bit holder 230 from the smaller radially oriented annular upper or forward extension 232 (FIG. 18). Around this forward extension 232 is fitted the annular tungsten carbide ring 150, the forward extension 232 extending through a bore 162 that extends through the annular tungsten carbide ring 150 allowing a bottom of the ring 150 to be seated in the annular trough 154, which is be brazed into unitary construction with the remainder of the bit holder 230 in a one step process. In one exemplary implementation, the bore 162 of the annular tungsten carbide ring 150 may comprise a cylindrical upper section 168 and an outwardly tapered bottom section 170, as shown in FIGS. 18 and 19. An axial length 172 of the ring 150, corresponding to the generally cylindrical top inner portion 168 of the bore 162 of the ring 150, is designed to maintain radial support after being brazed. The clearance between the inner diameter of the bore 162 of the annular tungsten carbide ring 150 and the outer diameter of a cylindrical top portion 234 of the forward extension 232 is, in the exemplary implementation, approximately in the range of 0.003 to 0.012 inch per side depending on where the measurement is axially taken. The top or forwardmost portion of the forward extension 232 of the bit holder body 106 terminates generally at a forward end 174 of the bit holder body 106 of the bit holder 230, located above the forward portion 176 of the annular tungsten carbide ring 150. In another exemplary implementation, the bore 162 of the annular tungsten carbide ring 150 may comprise a continuous taper (not shown) from the bottom of the bore 162 to the forward portion of the annular tungsten carbide ring 150. In other implementations, the forward extension 232 and the bore 162 of the ring 150 can have complementary shaped surfaces. The bit holder 230 may be machined and hardened, or hardened and then machined. The annular tungsten carbide ring 150 may be brazed before or after hardening of the bit holder 230.

In this exemplary implementation of the sixth embodiment of the bit holder 230, the forward extension 232 includes the generally cylindrical top portion 234 and an outwardly tapered bottom portion 236. The forward extension 232, which forms the unitary steel forward end of the tubular portion of the diamond tool body, includes a bore 238 that axially extends from the forward end 174, through the generally cylindrical top portion 234 and partially through the tapered bottom portion 236, to a bore termination 240. In this illustrated exemplary embodiment, the bore 238 includes a generally cylindrical bore section 242 that axially extends from the forward end 174 through the generally cylindrical top portion 234 to a location adjacent the tapered bottom portion 236, a tapered bore section 244 that axially extends from a distal end 246 of the generally cylindrical bore section 242 to the bore termination 240, which in this exemplary implementation is conical, adjacent the forward end 144 of the upper body portion 142. The bore 238 provides a space for receiving a tapered tungsten carbide extension plug 248 and the complementary shaped bit 100. The bit tip insert 100 comprises a base 182 and a tip 184 adjacent the base 182 that includes a parabolic curved section below an apex of the bit tip insert 100. This tip 184 can have a frustoconical shape, a flat generally cylindrical puck shape, a parabolic ballistic shape, a conical shape, and/or an arcuate shape. In this sixth embodiment, the base 182 includes a generally cylindrical sidewall 186 and a tapered section 190 that extends from the cylindrical sidewall 186 to a generally flat distal end 188 of the bit tip insert 100. In an alternate embodiment, the base 182 can include a tapered sidewall and the distal end 188 of the bit tip insert 100 can be conical, frustoconical, arcuate, or have a different configuration. In one exemplary implementation of the sixth embodiment, the bit tip insert 100 can have a diameter in the range of ½ inch to 1⅜ inches. The bit tip insert 100 may be a tungsten carbide insert or may be a tungsten carbide insert that includes an overlay 192 (FIG. 16) of a polycrystalline diamond structure that is applied to an outer surface of the tip 184. The overlay 192 may be a single coating or outer layer or multiple coatings or outer layers of such industrial diamond material, natural diamond, polycrystalline diamond (PCD) material, and polycrystalline diamond composite or PCD material.

To assemble the combination diamond coated axially shortened bit 100 and bit holder 230 of the present disclosure to form a unitary structure bit and bit holder construction of a bit/holder, tool, and/or pick 104, the annular tungsten carbide ring 150 is positioned around the forward extension 232 and brazed in the annular trough 154 of the bit holder body 106. The base 182 and the sidewall 186 of the bit tip insert 100 is brazed to a forward end 250 of the tungsten carbide extension plug 248 at the same time as the carbide ring 150, using, for example, a disc shaped or ring shaped braze material, and also creating a high strength braze joint 254 (FIG. 19) between the base 182 of the bit tip insert 100 and the forward end 250 of the tungsten carbide extension plug 248, which may then be optionally hardened. A distal end 252, which in this illustrated embodiment is conical, of the tungsten carbide extension plug 248 is brazed in the bore 238 of the forward extension 232 at the same time as the bit tip insert 100 and the carbide ring 150 are brazed, using, for example, a disc shaped or ring shaped braze material, and also creating a high strength braze joint, which may then be optionally hardened. This braze joint secures the distal end 252 of the tungsten carbide extension plug 248 to the bore termination 240 and to the bore 238 of the forward extension 232, adjacent the forward end 174 of the diamond tool body 106. The three parts, the bit tip insert 100, the tungsten carbide ring 150, and the tungsten carbide extension plug 248, are brazed together in a one-step brazing process. In this sixth embodiment, the annular sidewall 194 of the cylindrical top portion 234 of the forward extension 232 remains in place, as shown in FIG. 19, after brazing the combination bit tip insert 100 and tungsten carbide extension plug 248 in the bore 238, however, the annular sidewall 194 will be quickly worn away by the abrasive action of the cut material. This sidewall 194 can also be machined away after brazing.

Figure 20:
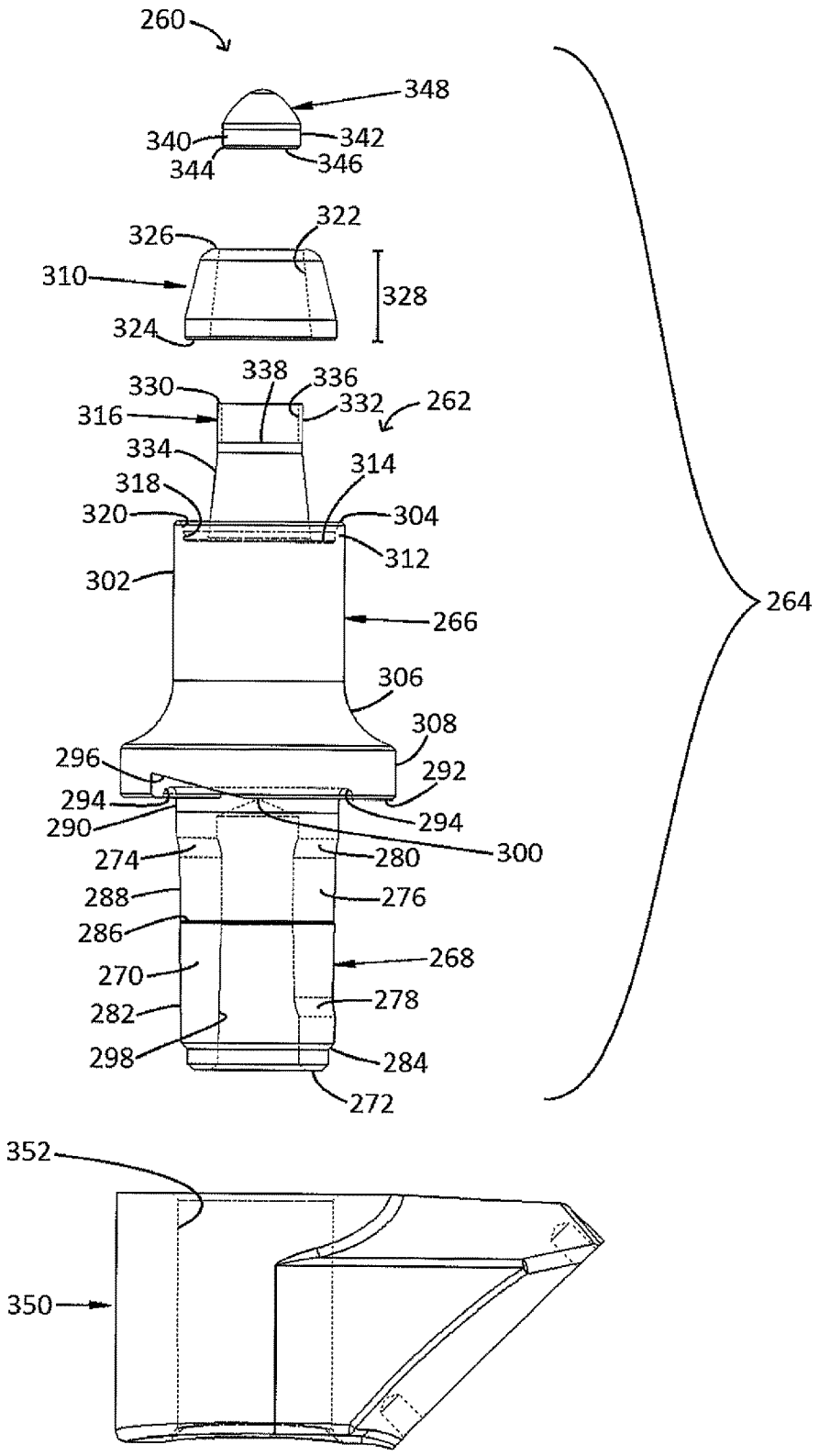
FIG. 20 is an exploded elevation view of a seventh embodiment of a combination diamond coated bit/holder and a first embodiment of a base block, showing invisible internal elements in dotted lines, in accordance with implementations of this disclosure.
Figure 21:
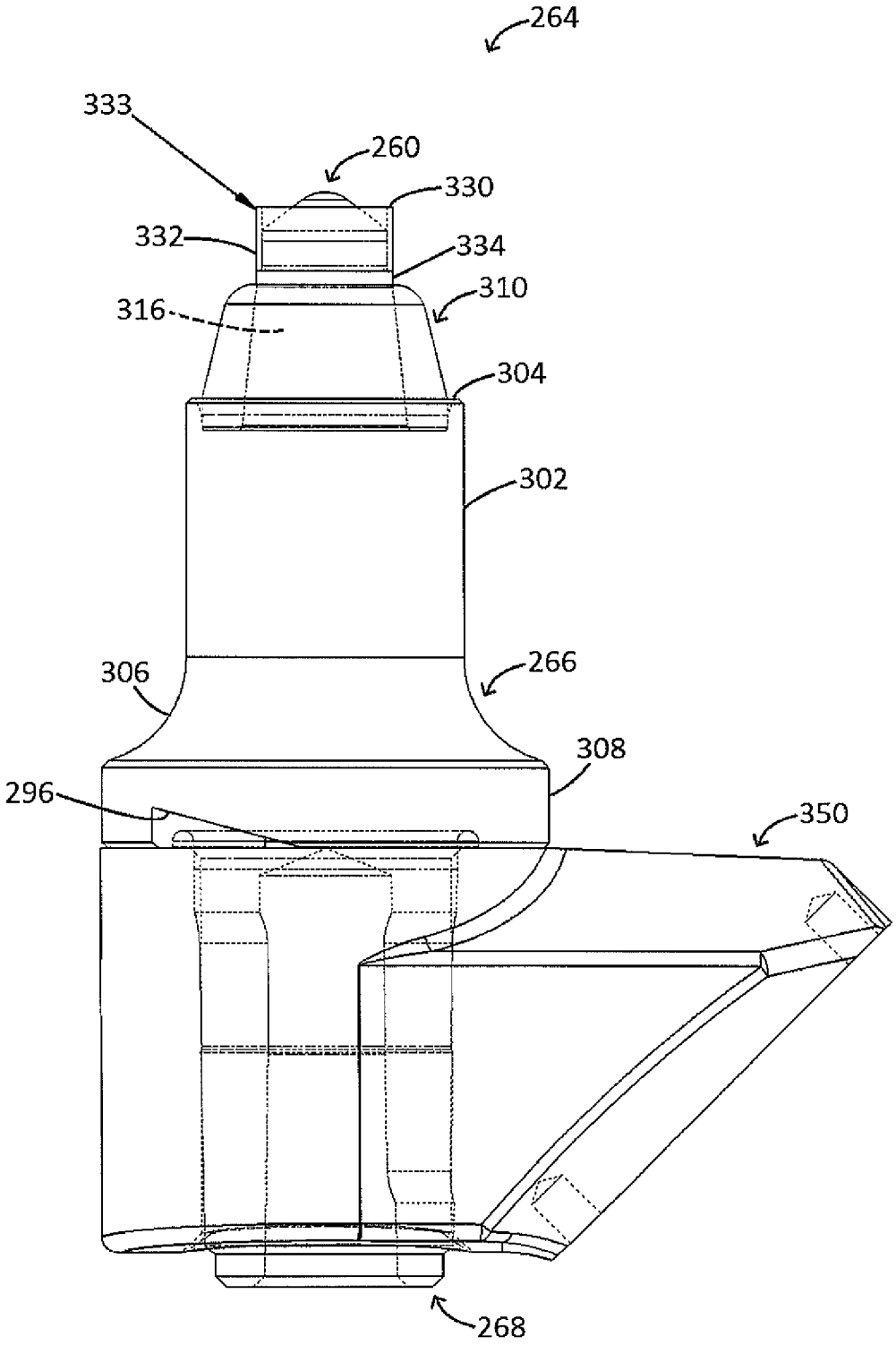
FIG. 21 is an elevation view of the seventh embodiment of the combination diamond coated bit/holder assembled into the first embodiment of the base block, showing invisible internal elements in dotted lines, in accordance with implementations of this disclosure.

Referring to FIGS. 20 and 21, a seventh embodiment of a combination diamond coated axially shortened bit 260 and bit holder 262 of the present disclosure forms a unitary structure bit and bit holder construction of a bit/holder, tool, and/or pick 264 (FIG. 21). The seventh embodiment of the bit holder 262 comprises a body 266 and a generally cylindrical hollow shank 268 depending from a bottom of the body 266. The shank 268 includes an elongate first slot 270 extending from a generally annular distal end 272 of the shank 268 axially upward or forward to an upper termination 274, which in this embodiment is adjacent the upper or forward end of the shank 268. In this illustrated embodiment, the shank 268 also includes an internally oriented second slot 276 located approximately 180 degrees around the annular shank 268 from the first slot 270. The second slot 276 is generally parallel to the first slot 270 and is an internal slot including a rearward semicircular termination 278 inwardly adjacent the distal end 272 of the shank 268 and a forward semicircular termination 280 (not shown) generally coinciding longitudinally and axially with the upper termination 274 of the first slot 270.

In this seventh embodiment of the bit holder 262, the shank 268 includes a lower or first tapered portion 282 running axially from a stepped shoulder 284 adjacent the distal end 272 of the shank 268. The stepped shoulder 284 is disposed between the lower tapered portion 282 and the distal end 272. A diameter of the stepped shoulder 284 increases, or steps up, in this embodiment, as it axially extends from the distal end 272 to the lower tapered portion 282. The first tapered portion 282 runs upwardly or axially from the stepped shoulder 284 of the shank 268 and terminates generally mid first slot 270 longitudinally. The shank 268 also includes an annular shoulder 286 separating the lower tapered portion 282 from an upper or second tapered portion 288 which extends from the shoulder 286 to generally adjacent to the top of the shank 268 or forward terminations 274, 280 of slots 270, 276, respectively. The annular shoulder 286 is disposed between the lower tapered portion 282 and the upper tapered portion 288. A diameter of the annular shoulder 286 decreases, or steps down, in this embodiment, as it axially extends from the lower tapered portion 282 to the upper tapered portion 288. In other embodiments, the lower portion 282 and/or the upper portion 288 of the shank 268 may comprise a generally cylindrical shape, a slight draw angle, or a slight draft angle. In yet other embodiments, the shank 268 can comprise many different configurations.

A generally cylindrical top portion 290 of the shank 268 extends from a position adjacent the top or upper terminations 274, 280 of slots 270, 276, respectively, towards a generally annular back flange 292 that denotes the base or the bottom of the body 266 of the bit holder 262. The top of the shank 268 may include a rounded junction 294 between the top portion 290 of the shank 268 and the generally annular flange 292 of the body 266 of the bit holder 262, which is provided to avoid sharp corners which may provide an area for stress cracks to begin. The generally annular flange 292 includes a pair of horizontal slots or wedge extraction notches 296-296 generally perpendicular to the longitudinal axis of the combination bit/holder, one on either side of the generally annular flange 292. The horizontal slots 296-296 are configured to receive a pair of bifurcated fork tines that may be inserted between the base of the body 266 of the bit holder 262 and a first embodiment of a base block 350 into which the shank 268 of the unitary bit/holder 264 is inserted and retained in a bore 352 of the base block 350 by outward radial force in use.

A central bore 298 longitudinally and axially extending through the shank 268 of the bit holder 262 terminates at bore termination 200, which in this illustrated embodiment has a conical shape, which is approximately at the upper end of the shank 268. This allows the generally C-shaped annular sidewall of the shank 268 to radially contract when the shank 108 is mounted in the tapered and/or generally cylindrical bore 352 in the base block 350.

In this seventh illustrated embodiment of the bit holder 262, the bit holder body 266 includes a generally cylindrical or annular upper body portion 302 depending from a forward end 304 of the upper body portion 302. A mediate body portion 306 subjacent the upper body portion 302 generally slopes axially and radially outwardly to a radially extending generally cylindrical tire portion 308.

The bit holder body 266, in order to provide superior brazing of a tungsten carbide ring 310 to the forward end 304 of the upper body portion 302, includes a forwardly extending annular collar 312 that is created on the bit holder body 266 to provide an annular trough 314 around a forward extension 316 of the bit holder body 266 onto which the annular ring 310 is mounted. In this illustrated embodiment, the annular collar 312 includes a cylindrical bottom inner wall 318 and a tapered top inner wall or countersink 320. The vertical outer wall of the collar 312 will keep brazing material from flowing outwardly of the joinder between the base of the ring 310 and the annular trough 314 on which the ring 310 is positioned. The annular trough 314 is therearound positioned perpendicular to the axis of the bit holder 262 from the smaller radially oriented annular upper or forward extension 316. Around this forward extension 316 is fitted the annular tungsten carbide ring 310, the forward extension 316 extending through a bore 322 that extends through the annular tungsten carbide ring 310 allowing a bottom of the ring 310 to be seated in the annular trough 314, which may be brazed into unitary construction with the remainder of the bit holder 262. In this illustrated embodiment, the bore 322 of the annular tungsten carbide ring 310 is tapered from a distal end 324 of the ring 310 to a forward end 326 of the ring 310, as shown in FIG. 20. In other embodiments, the bore 322 of the annular tungsten carbide ring 310 may comprise a cylindrical upper section and an outwardly tapered bottom section, as shown in FIGS. 12 and 13. An axial length 328 of the ring 310 is designed to maintain radial support after being brazed. The top or forwardmost portion of the forward extension 316 of the bit holder body 266 terminates generally at a forward end 330 of the bit holder body 266 of the bit holder 262, located above the forward portion 326 of the annular tungsten carbide ring 310. The bit holder 262 may be machined and hardened, or hardened and then machined. The annular tungsten carbide ring 310 may be brazed before or after hardening of the bit holder 262.

In this exemplary implementation of the seventh embodiment of the bit holder 262, the forward extension 316 includes a generally cylindrical top portion 332 and an outwardly tapered bottom portion 334. The generally cylindrical top portion 332, which forms the unitary steel forward end of the tubular portion of the diamond tool body, includes a bore 336 that axially extends from the forward end 330 to a bore termination 338, which in this exemplary implementation is flat, adjacent the outwardly tapered bottom portion 334. The bore 336 provides a space for receiving the complementary shaped bit 260. The bit tip insert 260 comprises a base 340 that includes a parabolic curved section below an apex of the bit tip insert 260. This bit tip insert 260 can also have a frustoconical shape, a flat generally cylindrical puck shape, a parabolic ballistic shape, a conical shape, and/or an arcuate shape. In this seventh embodiment, the base 340 includes a generally cylindrical sidewall 342 and a tapered section 344 that extends from the cylindrical sidewall 342 to a generally flat distal end 346 of the bit tip insert 260. In an alternate embodiment, the base 340 can include a tapered sidewall and the distal end 346 of the bit tip insert 260 can be conical, frustoconical, arcuate, or have a different configuration. In one exemplary implementation of the seventh embodiment, the bit tip insert 260 can have a diameter in the range of ½ inch to 1⅜ inches. The bit tip insert 260 may be a tungsten carbide insert or may be a tungsten carbide insert that includes an overlay 348 (FIG. 20) of a polycrystalline diamond structure that is applied to an outer surface of the tip insert 260. The overlay 348 may be a single coating or outer layer or multiple coatings or outer layers of such industrial diamond material, natural diamond, polycrystalline diamond (PCD) material, and polycrystalline diamond composite or compact (PCD) material. The single or multiple coatings or layers may be formed by a high pressure, high temperature process. The overlay 348 occupies a large radial and axial profile of the tip insert 260 which allows faster heat transfer into a region subjacent to the overlay 348 PCD layer. Excessively high heat, such as temperatures above 1300 degrees F., is the greatest cause of PCD failure due to diamond connective failure, the quick heat transfer from the tip of the PCD cutting zone, which is approximately ½ inch depth of cut per tip engagement, to the subjacent region below the PCD drastically reduces the possibility of a temperature of the tip of the PCD reaching temperatures at or above 1300 degrees F. for any extended period of time thereby avoiding failure of the PCD layer.

To assemble the combination diamond coated axially shortened bit 260 and bit holder 262 of the present disclosure and to form a unitary structure of a bit and bit holder construction of a bit/holder, tool, and/or pick 264, the annular tungsten carbide ring 310 is positioned around the forward extension 316 and brazed in the annular trough 314 of the bit holder body 266. The base 340 and the sidewall 342 of the bit tip insert 260 is brazed in the bore 336 of the forward extension 316 at the same time as the carbide ring 310 is brazed, using, for example, a disc shaped or ring shaped braze material and/or flux material, and also creating a high strength braze joint, which may then be optionally hardened. This braze joint secures the bottom of the tungsten carbide base 340 of the bit tip insert 260 to the bore termination 338 of the bore 336 of the cylindrical top portion 332 of the forward extension 316, at the forward end 330 of the diamond tool body 266. In this seventh embodiment, the extended annular sidewall 333 of the cylindrical top portion 332 of the forward extension 316 remains in place, as shown in FIG. 21, after brazing the bit tip insert 260 in the bore 336, however, the annular sidewall 333 will be quickly worn away by the abrasive action of the cut material.

Alternatively, furnace brazing in an atmospherically controlled environment is used to assemble the unitary bit/holder, tool, and/or pick 264, which does not require a flux material to protect the braze joint regions. The atmospherically controlled furnace involves only an inert gas atmosphere, free of oxygen. The diamond unitary bit/holder, tool, and/or pick 264 is vertically positioned, heated, and brazed in this furnace setting. With the flux material removed, the braze material is tightly positioned underneath the base of the PDC insert. The braze material would have a higher melting point that would be closer to the austenitizing temperature, approximately 1,600 degrees Fahrenheit, for hardening the steel body of the bit holder. There is no damaging effect, up to 2,000 degrees Fahrenheit, to the PDC insert diamond layer in an atmospherically controlled furnace at the required temperature to properly harden the diamond tool metal body. A crimped feature on the annular sidewall 333 allows the physical handling of this design and still provides the satisfactory furnace braze joint since the steel crimped feature tightly keeps this assembly together.

The annular tungsten carbide ring 310 is positioned around the forward extension 316 and brazed in the annular trough 314 of the bit holder body 266 and the base 340 and the sidewall 342 of the bit tip insert 260 is brazed in the bore 336 of the forward extension 316 at the same time as the carbide ring 310 is brazed, using, for example, a disc shaped or ring shaped braze material, creating a high strength braze joint, in the atmospherically controlled furnace. This braze joint secures the bottom and sidewall of the tungsten carbide base 340 of the bit tip insert 260 to the bore termination 338 of the bore 336 of the cylindrical top portion 332 of the forward extension 316, at the forward end 330 of the diamond tool body 266. In this seventh embodiment, the crimped extended annular sidewall 333 of the cylindrical top portion 332 of the forward extension 316 remains in place after brazing the bit tip insert 260 in the bore 336, however, the annular sidewall 333 will be quickly worn away by the abrasive action of the cut material.

Figure 22:
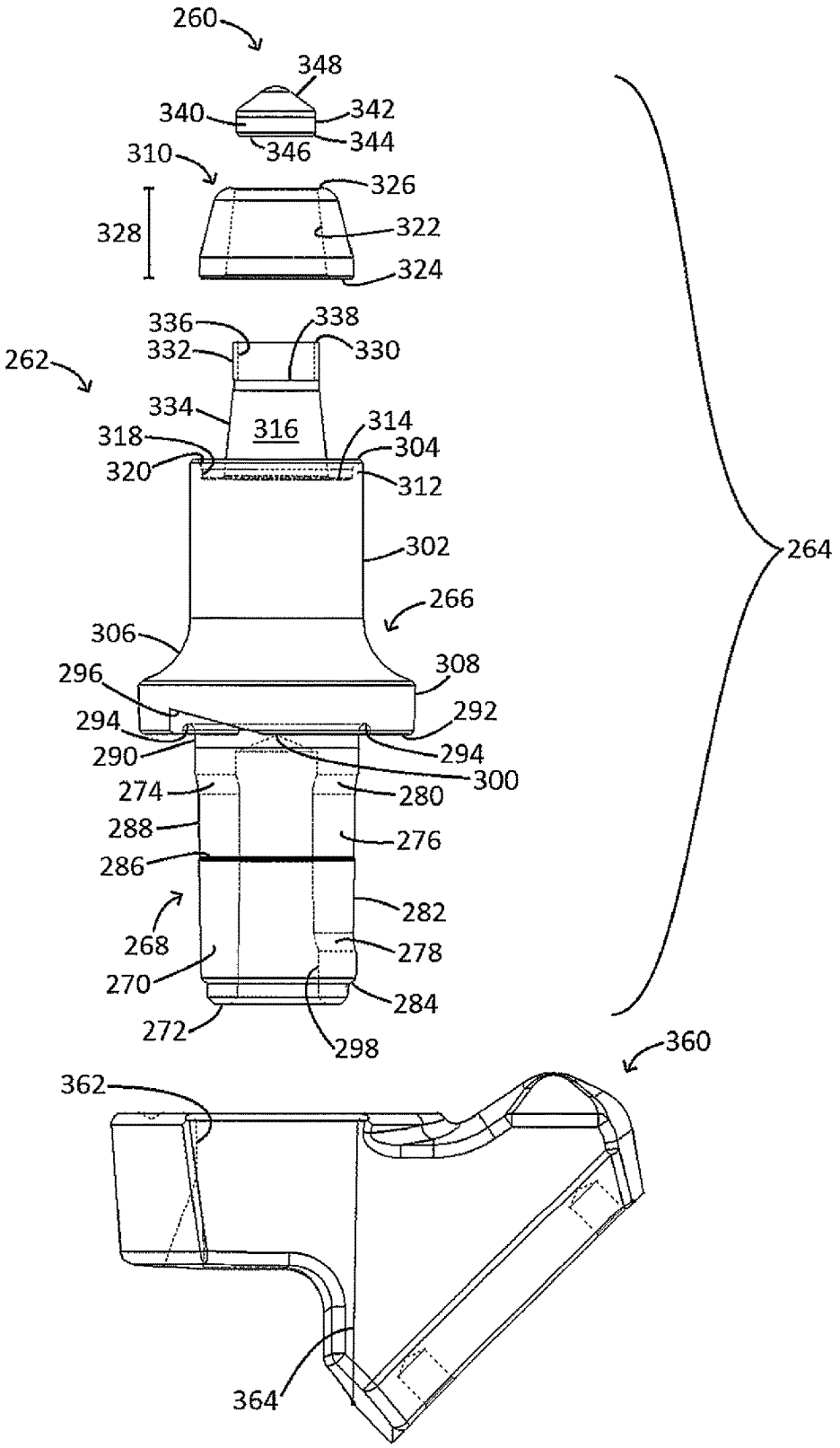
FIG. 22 is an exploded view of the seventh embodiment of the combination diamond coated bit/holder and a second embodiment of a base block, showing invisible internal elements in dotted lines, in accordance with implementations of this disclosure.
Figure 23:
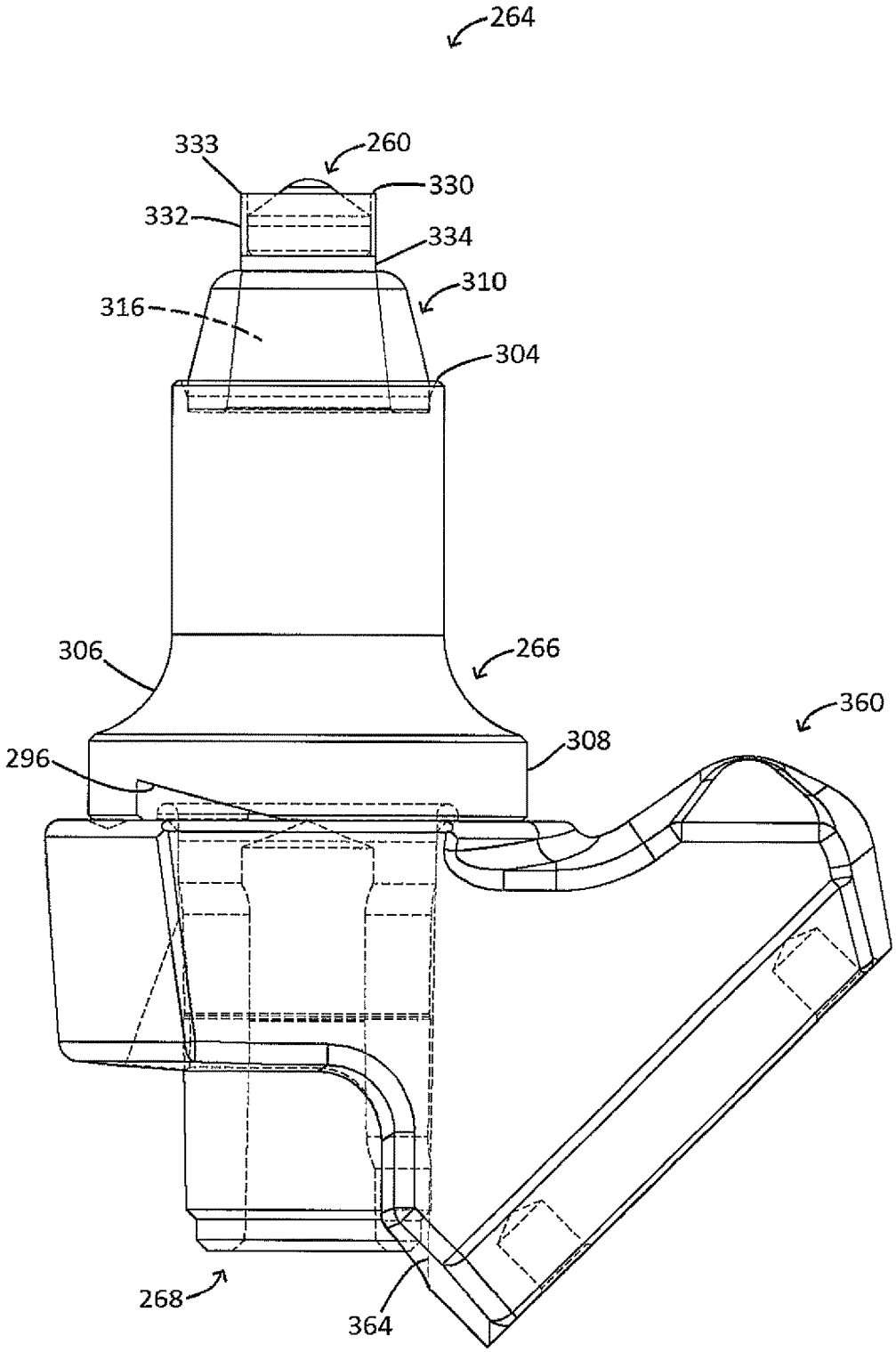
FIG. 23 is an elevation view of the seventh embodiment of the combination diamond coated bit/holder and the second embodiment of the base block, showing invisible internal elements in dotted lines, in accordance with implementations of this disclosure.

Referring to FIGS. 22 and 23, the seventh embodiment of the combination diamond coated axially shortened bit 260 and bit holder 262 of the present disclosure forms a unitary structure bit and bit holder construction of a bit/holder, tool, and/or pick 262 (FIG. 23). In this illustrated embodiment, the shank 268 is inserted and retained by outward radial force in use in a bore 362 and an extension of an arcuate segment 364 of the bore 362 of a second embodiment of a base block 360, as described in Applicant's co-pending Non-provisional application Ser. No. 14/690,679 herein incorporated by reference in its entirety.

Figure 24:
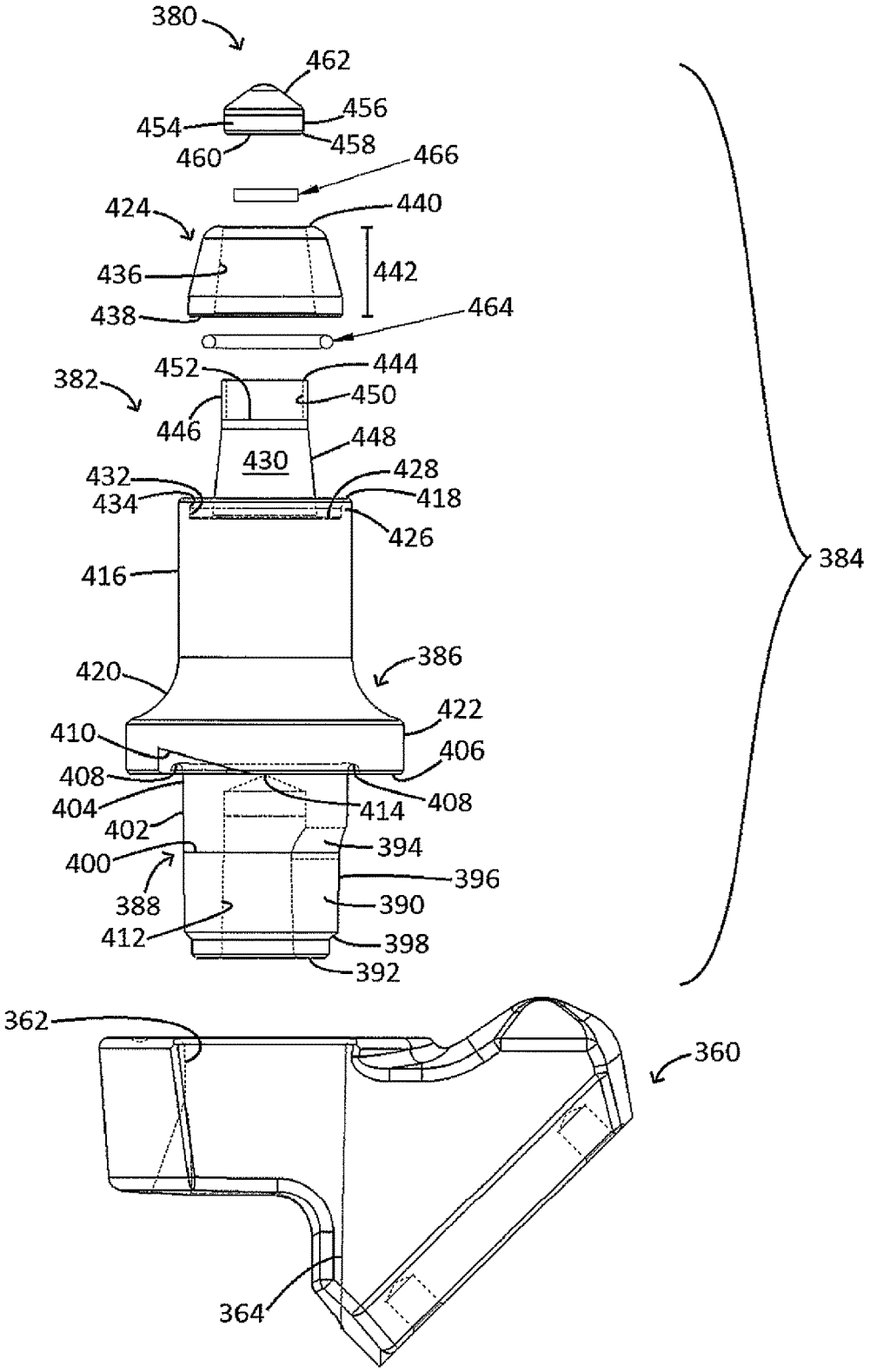
FIG. 24 is an eighth embodiment of a combination diamond coated bit/holder and a second embodiment of a base block, showing invisible internal elements in dotted lines, in accordance with implementations of this disclosure.
Figure 25:
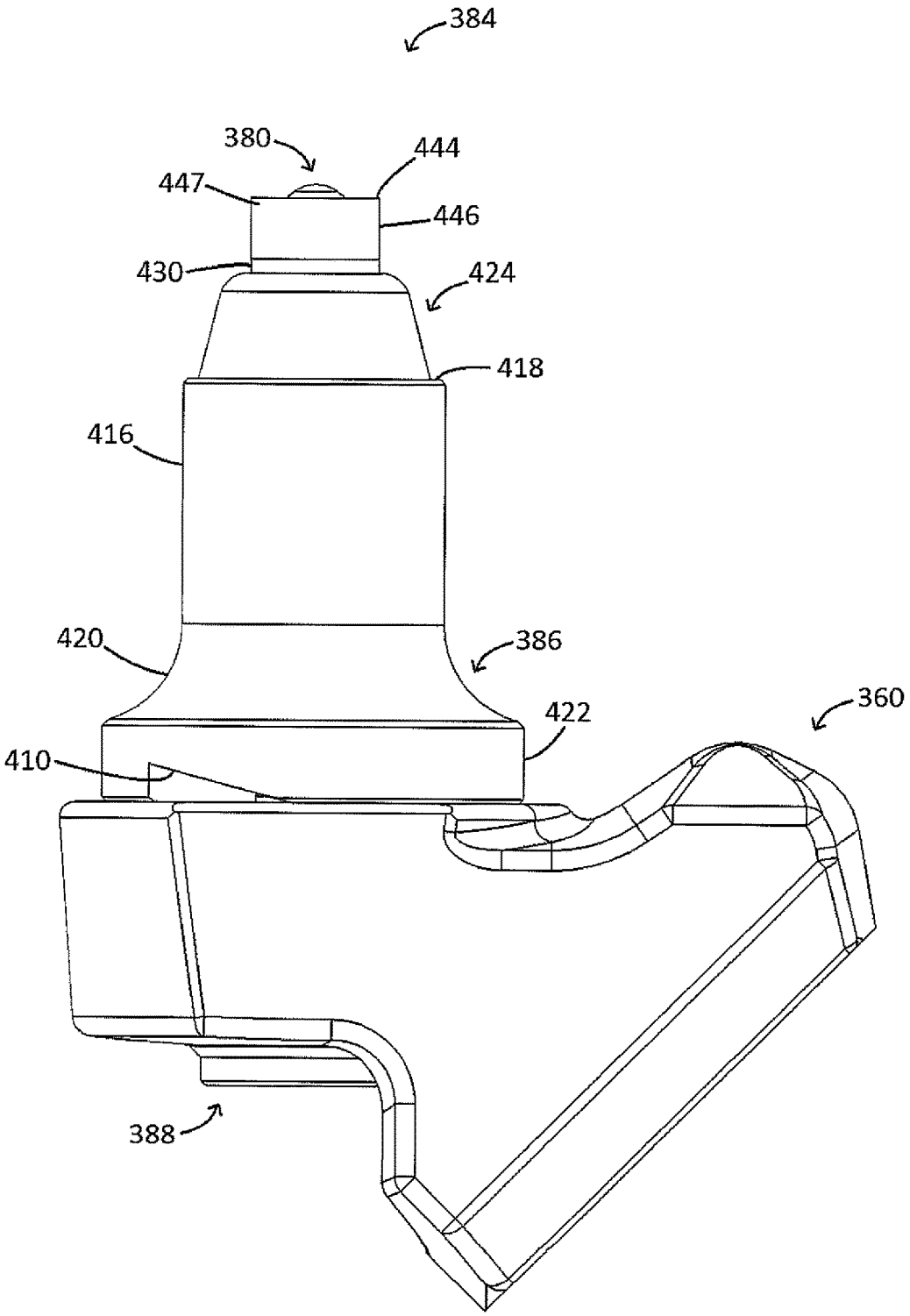
FIG. 25 is an elevation view of the eighth embodiment of the combination diamond coated bit/holder assembled into the second embodiment of the base block in accordance with implementations of this disclosure.
Figure 27:
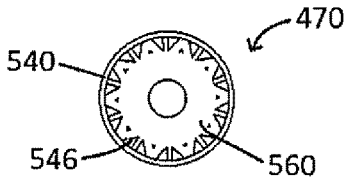
FIG. 27 is a top elevation view of a bit tip insert and a crimped forward portion of the ninth embodiment of the combination diamond coated bit/holder in accordance with implementations of this disclosure.

Referring to FIGS. 24 and 25, an eighth embodiment of a combination diamond coated axially shortened bit 380 and bit holder 382 of the present disclosure forms a unitary structure bit and bit holder construction of a bit/holder, tool, and/or pick 384 (FIG. 25). The eighth embodiment of the bit holder 382 comprises a body 386 and a generally cylindrical hollow shank 388 depending from a bottom of the body 386. The bit holder 382 of the eighth embodiment includes the shank 388 that is shorter than the standard 2¾ inch length shank of a standard bit holder, such as shank 268 of bit holder 266, in which, in this exemplary implementation, the length of the shank 388 of the bit holder 382 is approximately a nominal 1¾ inches. In this embodiment, the shank 388 includes an elongate first slot 390 extending from a generally annular distal end 392 of the shank 388 axially upward or forward to an upper termination 394, which in this embodiment is adjacent the upper or forward end of the shank 388. In other embodiments, the shank may also include an internally oriented second slot located approximately 180 degrees around the annular shank from the first slot.

In this eighth embodiment of the bit holder 382, the shank 388 includes a lower or first tapered portion 396 running axially from a stepped shoulder 398 adjacent the distal end 392 of the shank 388. The stepped shoulder 398 is disposed between the lower tapered portion 396 and the distal end 392. A diameter of the stepped shoulder 398 increases, or steps up, in this embodiment, as it axially extends from the distal end 392 to the lower tapered portion 396. The first tapered portion 396 runs upwardly or axially from the stepped shoulder 398 of the shank 388 and terminates generally mid first slot 390 longitudinally. The shank 388 also includes an annular shoulder 400 separating the lower tapered portion 396 from an upper or second tapered portion 402 which extends from the shoulder 400 to generally adjacent to the top of the shank 388 or forward termination 394 of slot 390. The annular shoulder 400 is disposed between the lower tapered portion 396 and the upper tapered portion 402. A diameter of the annular shoulder 402 decreases, or steps down, in this embodiment, as it axially extends from the lower tapered portion 396 to the upper tapered portion 402. In other embodiments, the lower portion 396 and/or the upper portion 402 of the shank 388 may comprise a generally cylindrical shape, a slight draw angle, or a slight draft angle. In yet other embodiments, the shank 388 can comprise many different configurations.

A generally cylindrical top portion 404 of the shank 388 extends from a position adjacent the top or upper termination 394 of slot 390 towards a generally annular back flange 406 that denotes the base or the bottom of the body 386 of the bit holder 382. The top of the shank 388 may include a rounded junction 408 between the top portion 404 of the shank 388 and the generally annular flange 406 of the body 386 of the bit holder 382, which is provided to avoid sharp corners which may provide an area for stress cracks to begin. The generally annular flange 406 includes a pair of horizontal slots or wedge extraction notches 410-410 generally perpendicular to the longitudinal axis of the combination bit/holder, one on either side of the generally annular flange 406. The horizontal slots 410-410 are configured to receive a pair of bifurcated fork tines that may be inserted between the base of the body 386 of the bit holder 382 and the second embodiment of the base block 360 into which the shank 388 of the unitary bit/holder 384 is inserted and retained in a bore 362 of the bore 360 by outward radial force in use.

A central bore 412 longitudinally and axially extending through the shank 388 of the bit holder 382 terminates at bore termination 414, which in this illustrated embodiment has a conical shape, which is approximately at the upper end of the shank 388. This allows the generally C-shaped annular sidewall of the shank 388 to radially contract when the shank 388 is mounted in the tapered and/or cylindrical bore 362 of the base block 288.

In this eighth illustrated embodiment of the bit holder 382, the bit holder body 386 includes a generally cylindrical or annular upper body portion 416 depending from a forward end 418 of the upper body portion 416. A mediate body portion 420 subjacent the upper body portion 416 generally slopes axially and radially outwardly to a radially extending generally cylindrical tire portion 422.

The bit holder body 386, in order to provide superior brazing of a tungsten carbide ring 424 to the forward end 418 of the upper body portion 416, includes a forwardly extending annular collar 426 that is created on the bit holder body 386 to provide an annular trough 428 around a forward extension 430 of the bit holder body 386 onto which the annular ring 424 is mounted. In this illustrated embodiment, the annular collar 426 includes a cylindrical bottom inner wall 432 and a tapered top inner wall or countersink 434. The vertical outer wall of the collar 426 will keep brazing material from flowing outwardly of the joinder between the base of the ring 424 and the annular trough 428 on which the ring 424 is positioned. The annular trough 428 is therearound positioned perpendicular to the axis of the bit holder 382 from the smaller radially oriented annular upper or forward extension 430. Around this forward extension 430 is fitted the annular tungsten carbide ring 424, the forward extension 430 extending through a bore 436 that extends through the annular tungsten carbide ring 424 allowing a bottom of the ring 424 to be seated in the annular trough 428, which may be brazed into unitary construction with the remainder of the bit holder 382. In this illustrated embodiment, the bore 436 of the annular tungsten carbide ring 424 is tapered from a distal end 438 of the ring 424 to a forward end 440 of the ring 424, as shown in FIG. 24. In other embodiments, the bore 436 of the annular tungsten carbide ring 424 may comprise a cylindrical upper section and an outwardly tapered bottom section, as shown in FIGS. 12 and 13. An axial length 442 of the ring 424 is designed to maintain radial support after being brazed. The top or forwardmost portion of the forward extension 430 of the bit holder body 386 terminates generally at a forward end 444 of the bit holder body 386 of the bit holder 382, located above the forward portion 440 of the annular tungsten carbide ring 424. The bit holder 382 may be machined and hardened, or hardened and then machined. The annular tungsten carbide ring 424 may be brazed before or after hardening of the bit holder 382.

In this exemplary implementation of the eighth embodiment of the bit holder 382, the forward extension 430 includes a generally cylindrical top portion 446 and an outwardly tapered bottom portion 448. The generally cylindrical top portion 446, which forms the unitary steel forward end of the tubular portion of the diamond tool body, includes a bore 450 that axially extends from the forward end 444 to a bore termination 452, which in this exemplary implementation is flat, adjacent the outwardly tapered bottom portion 448. The bore 450 provides a space for receiving the complementary shaped bit 380. The bit tip insert 380 comprises a base 454 that includes a parabolic curved section or frustoconical section below an apex of the bit tip insert 380. This bit tip insert 380 can also have a frustoconical shape, a flat generally cylindrical puck shape, a parabolic ballistic shape, a conical shape, and/or an arcuate shape. In this eighth embodiment, the base 454 includes a generally cylindrical sidewall 456 and a tapered section 458 that extends from the cylindrical sidewall 456 to a generally flat distal end 460 of the bit tip insert 360. In an alternate embodiment, the base 454 can include a tapered sidewall and the distal end 460 of the bit tip insert 380 can be conical, frustoconical, arcuate, or have a different configuration. In one exemplary implementation of the eighth embodiment, the bit tip insert 380 can have a diameter in the range of ½ inch to 1⅜ inches. The bit tip insert 380 may be a tungsten carbide insert or may be a tungsten carbide insert that includes an overlay 462 (FIG. 24) of a polycrystalline diamond structure that is applied to an outer surface of the tip insert 380. The overlay 462 may be a single coating or outer layer or multiple coatings or outer layers of such industrial diamond material, natural diamond, polycrystalline diamond (PCD) material, and polycrystalline diamond composite or compact (PCD) material. The single or multiple coatings or layers may be formed by a high pressure, high temperature process. The overlay 462 occupies a large radial and axial profile of the tip insert 380 which allows faster heat transfer into a region subjacent to the overlay 192 PCD layer. Excessively high heat, such as temperatures above 1300 degrees F., is the greatest cause of PCD failure due to diamond connective failure, the quick heat transfer from the tip of the PCD cutting zone, which is approximately ½ inch depth of cut per tip engagement, to the subjacent region below the PCD drastically reduces the possibility of a temperature of the tip of the PCD reaching temperatures at or above 1300 degrees F. for any extended period of time thereby avoiding failure of the PCD layer.

To assemble the combination diamond coated axially shortened bit 380 and bit holder 382 of the present disclosure and to form a unitary structure of a bit and bit holder construction of a bit/holder, tool, and/or pick 384, a brazing ring 464 (FIG. 24) is positioned around the forward extension 430 and in the annular trough 428. The annular tungsten carbide ring 424 is also positioned around the forward extension 430, the distal end 438 of the carbide ring 424 adjacent to the brazing ring 464, and brazed in the annular trough 428 of the bit holder body 386. A brazing disc 466 (FIG. 24) is positioned in the bore 450 of the forward extension 430 and the bit tip insert 380 is positioned in the bore 450 of the forward extension 430, the distal end 460 of the base 454 if the bit tip insert 380 adjacent the brazing disc 466. The base 454 and the sidewall 456 of the bit tip insert 380 is brazed in the bore 450 of the forward extension 430 at the same time as the carbide ring 424 is brazed, using, for example, the brazing ring 464 shaped or brazing disc 466 shaped braze material and/or flux material, and also creating a high strength braze joint, which may then be optionally hardened. This braze joint secures the bottom of the tungsten carbide base 454 of the bit tip insert 380 to the bore termination 452 of the bore 450 of the cylindrical top portion 446 of the forward extension 430, at the forward end 444 of the diamond tool body 386. In this eighth embodiment, the crimped extended annular sidewall 447 of the cylindrical top portion 446 of the forward extension 430 remains in place, as shown in FIG. 23, after brazing the bit tip insert 380 in the bore 452, however, the annular sidewall 447 will be quickly worn away by the abrasive action of the cut material.

Alternatively, furnace brazing in an atmospherically controlled environment is used to assemble the unitary bit/holder, tool, and/or pick 384, which does not require a flux material to protect the braze joint regions. The atmospherically controlled furnace involves only an inert gas atmosphere, free of oxygen. The diamond unitary bit/holder, tool, and/or pick 384 is vertically positioned, heated, and brazed in this furnace setting. With the flux material removed, the braze material is tightly positioned underneath the base of the PDC insert. The braze material would have a higher melting point that would be closer to the austenitizing temperature, approximately 1,600 degrees Fahrenheit, for hardening the steel body of the bit holder. There is no damaging effect, up to 2,000 degrees Fahrenheit, to the PDC insert diamond layer in an atmospherically controlled furnace at the required temperature to properly harden the diamond tool metal body. A crimped feature on the annular sidewall 447 allows the physical handling of this design and still provides the satisfactory furnace braze joint since the steel crimped feature tightly keeps this assembly together.

The annular tungsten carbide ring 424 is positioned around the forward extension 430 and brazed in the annular trough 428 of the bit holder body 386 and the base 454 and the sidewall 456 of the bit tip insert 380 is brazed in the bore 450 of the forward extension 430 at the same time as the carbide ring 424 is brazed, using, for example, brazing ring 464 and brazing disc 466, creating a high strength braze joint, in the atmospherically controlled furnace. This braze joint secures the bottom and sidewall of the tungsten carbide base 454 of the bit tip insert 380 to the bore termination 452 of the bore 450 of the cylindrical top portion 446 of the forward extension 430, at the forward end 444 of the diamond tool body 386. In this eighth embodiment, the crimped extended annular sidewall 447 of the cylindrical top portion 446 of the forward extension 430 remains in place after brazing the bit tip insert 380 in the bore 450, however, the annular sidewall 447 will be quickly worn away by the abrasive action of the cut material.

Figure 26:
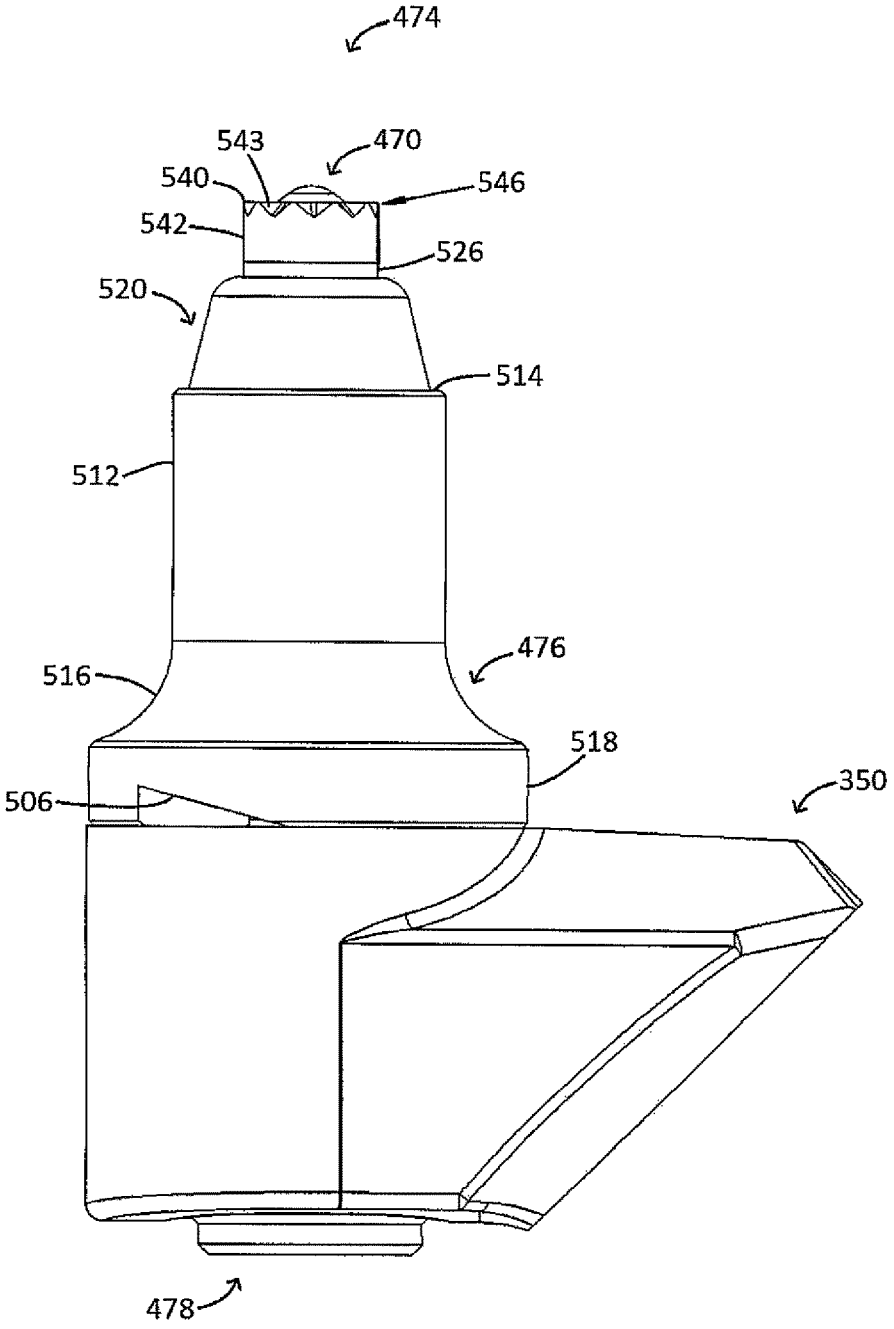
FIG. 26 is an elevation view of a ninth embodiment of a combination diamond coated bit/holder assembled into the first embodiment of the base block in accordance with implementations of this disclosure.
Figure 28:
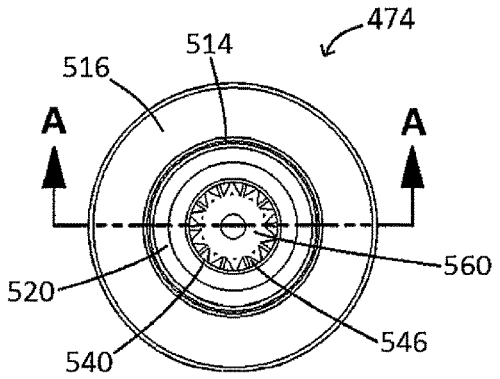
FIG. 28 is a top elevation view of the ninth embodiment of the combination diamond coated bit/holder in accordance with implementations of this disclosure.
Figure 29:
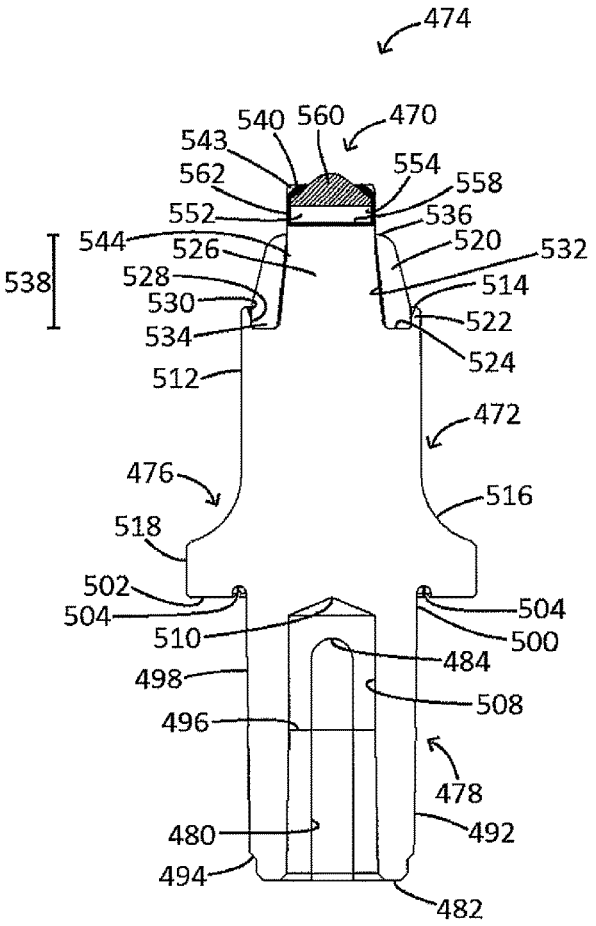
FIG. 29 is a cross-sectional view of the ninth embodiment of the combination diamond coated bit/holder taken along line A-A of FIG. 26 in accordance with implementations of this disclosure.

Referring to FIGS. 26-29, a ninth embodiment of a combination diamond coated axially shortened bit 470 and bit holder 472 (FIG. 29) of the present disclosure forms a unitary structure bit and bit holder construction of a bit/holder, tool, and/or pick 474 (FIGS. 26 and 29). The ninth embodiment of the bit holder 472 comprises a body 476 and a generally cylindrical hollow shank 478 depending from a bottom of the body 476. The shank 478 includes an elongate first slot 480 (FIG. 29) extending from a generally annular distal end 482 (FIG. 29) of the shank 478 axially upward or forward to an upper termination 484 (FIG. 29), which in this embodiment is adjacent the upper or forward end of the shank 478. In this illustrated embodiment, the shank 478 also includes an internally oriented second slot 486 (not shown) located approximately 180 degrees around the annular shank 478 from the first slot 480. The second slot 486 is generally parallel to the first slot 480 and is an internal slot including a rearward semicircular termination 488 (not shown) inwardly adjacent the distal end 482 of the shank 478 and a forward semicircular termination 490 (not shown) generally coinciding longitudinally and axially with the upper termination 484 of the first slot 480.

In this ninth embodiment of the bit holder 472, the shank 478 includes a lower or first tapered portion 492 (FIG. 29) running axially from a stepped shoulder 494 (FIG. 29) adjacent the distal end 482 of the shank 478. The stepped shoulder 494 is disposed between the lower tapered portion 492 and the distal end 482. A diameter of the stepped shoulder 494 increases, or steps up, in this embodiment, as it axially extends from the distal end 482 to the lower tapered portion 492. The first tapered portion 492 runs upwardly or axially from the stepped shoulder 494 of the shank 478 and terminates generally mid first slot 480 longitudinally. The shank 478 also includes an annular shoulder 496 (FIG. 29) separating the lower tapered portion 492 from an upper or second tapered portion 498 (FIG. 29) which extends from the shoulder 496 to generally adjacent to the top of the shank 478 or forward terminations 484, 490 of slots 480, 486, respectively. The annular shoulder 496 is disposed between the lower tapered portion 492 and the upper tapered portion 498. A diameter of the annular shoulder 496 decreases, or steps down, in this embodiment, as it axially extends from the lower tapered portion 492 to the upper tapered portion 498. In other embodiments, the lower portion 492 and/or the upper portion 498 of the shank 478 may comprise a generally cylindrical shape, a slight draw angle, or a slight draft angle. In yet other embodiments, the shank 478 can comprise many different configurations.

A generally cylindrical top portion 500 (FIG. 29) of the shank 478 extends from a position adjacent the top or upper terminations 484, 490 of slots 480, 486, respectively, towards a generally annular back flange 502 (FIG. 29) that denotes the base or the bottom of the body 476 of the bit holder 472. The top of the shank 478 may include a rounded junction 504 (FIG. 29) between the top portion 500 of the shank 478 and the generally annular flange 502 of the body 476 of the bit holder 472, which is provided to avoid sharp corners which may provide an area for stress cracks to begin. The generally annular flange 502 includes a pair of horizontal slots or wedge extraction notches 506-506 (FIG. 29) generally perpendicular to the longitudinal axis of the combination bit/holder, one on either side of the generally annular flange 502. The horizontal slots 506-506 are configured to receive a pair of bifurcated fork tines that may be inserted between the base of the body 476 of the bit holder 472 and the first embodiment of the base block 350 into which the shank 478 of the unitary bit/holder 474 is inserted and retained in the bore 352 of the base block 350 by outward radial force in use.

A central bore 508 (FIG. 29) longitudinally and axially extending through the shank 478 of the bit holder 472 terminates at bore termination 510 (FIG. 29), which in this illustrated embodiment has a conical shape, which is approximately at the upper end of the shank 478. This allows the generally C-shaped annular sidewall of the shank 478 to radially contract when the shank 108 is mounted in the tapered and/or cylindrical bore 352 of the base block 350.

In this ninth illustrated embodiment of the bit holder 472, the bit holder body 476 includes a generally cylindrical or annular upper body portion 512 depending from a forward end 514 of the upper body portion 512. A mediate body portion 516 subjacent the upper body portion 512 generally slopes axially and radially outwardly to a radially extending generally cylindrical tire portion 518.

The bit holder body 476, in order to provide superior brazing of a tungsten carbide ring 520 to the forward end 514 of the upper body portion 512, includes a forwardly extending annular collar 522 (FIG. 29) that is created on the bit holder body 476 to provide an annular trough 524 around a forward extension 526 of the bit holder body 476 onto which the annular ring 520 is mounted. In this illustrated embodiment, the annular collar 522 includes a cylindrical bottom inner wall 528 (FIG. 29) and a tapered top inner wall or countersink 530 (FIG. 29). The vertical outer wall of the collar 522 will keep brazing material from flowing outwardly of the joinder between the base of the ring 520 and the annular trough 524 on which the ring 520 is positioned. The annular trough 524 is therearound positioned perpendicular to the axis of the bit holder 472 from the smaller radially oriented annular upper or forward extension 526. Around this forward extension 526 is fitted the annular tungsten carbide ring 520, the forward extension 526 extending through a bore 532 (FIG. 29) that extends through the annular tungsten carbide ring 520 allowing a bottom of the ring 520 to be seated in the annular trough 524, which may be brazed into unitary construction with the remainder of the bit holder 472. In this illustrated embodiment, the bore 532 of the annular tungsten carbide ring 520 is tapered from a distal end 534 of the ring 520 to a forward end 536 of the ring 520, as shown in FIG. 29. In other embodiments, the bore 532 of the annular tungsten carbide ring 520 may comprise a cylindrical upper section and an outwardly tapered bottom section, as shown in FIGS. 12 and 13. An axial length 538 (FIG. 29) of the ring 520 is designed to maintain radial support after being brazed. The top or forwardmost portion of the forward extension 526 of the bit holder body 476 terminates generally at a forward end 540 of the bit holder body 476 of the bit holder 472, located above the forward portion 536 of the annular tungsten carbide ring 520. The bit holder 472 may be machined and hardened, or hardened and then machined. The annular tungsten carbide ring 520 may be brazed before or after hardening of the bit holder 472.

In this exemplary implementation of the ninth embodiment of the bit holder 472, the forward extension 526 includes a generally cylindrical top portion 542 and an outwardly tapered bottom portion 544 (FIG. 29). The generally cylindrical top portion 542, which forms the unitary steel forward end of the tubular portion of the diamond tool body, includes a crimped forward end 546, shown in FIGS. 26 and 27, that is crimped with a multi-pointed circular die (not shown). The structure forms side-by-side chevrons or saw teeth around the outside circular (annular) top portion. The valleys in the saw teeth are pointed tabs and are bent inwardly to aid in retaining the bit tip insert brazed in the forward end bore 548. The generally cylindrical top portion 542 also includes a bore 548 (not shown) that axially extends from the forward end 540 to a bore termination 550 (not shown), which in this exemplary implementation is flat, adjacent the outwardly tapered bottom portion 544. The bore 548 provides a space for receiving the complementary shaped bit 470.

The bit tip insert 470 comprises a base 552 (FIG. 29) that includes a parabolic curved section below an apex of the bit tip insert 470. This bit tip insert 470 can also have a frustoconical shape, a flat generally cylindrical puck shape, a parabolic ballistic shape, a conical shape, and/or an arcuate shape. In this ninth embodiment, the base 552 includes a generally cylindrical sidewall 554 (FIG. 29) and a tapered section 556 (not shown) that extends from the cylindrical sidewall 554 to a generally flat distal end 558 (FIG. 29) of the bit tip insert 470. In an alternate embodiment, the base 552 can include a tapered sidewall and the distal end 558 of the bit tip insert 470 can be conical, frustoconical, arcuate, or have a different configuration. In one exemplary implementation of the ninth embodiment, the bit tip insert 470 can have a diameter in the range of ½ inch to 1⅜ inches. The bit tip insert 470 may be a tungsten carbide insert or may be a tungsten carbide insert that includes an overlay 560 (FIG. 29) of a polycrystalline diamond structure that is applied to an outer surface of the tip insert 470. The overlay 560 may be a single coating or outer layer or multiple coatings or outer layers of such industrial diamond material, natural diamond, polycrystalline diamond (PCD) material, and polycrystalline diamond composite or compact (PCD) material. The single or multiple coatings or layers may be formed by a high pressure, high temperature process. The overlay 560 occupies a large radial and axial profile of the tip insert 300 which allows faster heat transfer into a region subjacent to the overlay 560 PCD layer. Excessively high heat, such as temperatures above 1300 degrees F., is the greatest cause of PCD failure due to diamond connective failure, the quick heat transfer from the tip of the PCD cutting zone, which is approximately ½ inch depth of cut per tip engagement, to the subjacent region below the PCD drastically reduces the possibility of a temperature of the tip of the PCD reaching temperatures at or above 1300 degrees F. for any extended period of time thereby avoiding failure of the PCD layer.

To assemble the combination diamond coated axially shortened bit 470 and bit holder 472 of the present disclosure and to form a unitary structure of a bit and bit holder construction of a bit/holder, tool, and/or pick 474, the annular tungsten carbide ring 520 is positioned around the forward extension 526 and brazed in the annular trough 524 of the bit holder body 476. The base 552 and the sidewall 554 of the bit tip insert 470 is brazed in the bore 548 of the forward extension 526 at the same time as the carbide ring 520 is brazed, using, for example, a disc shaped or ring shaped braze material and/or flux material, and also creating a high strength braze joint, which may then be optionally hardened. The braze material 562 covers the base 552 and sidewall 554 of the bit tip insert 470, as shown in FIG. 29 in the finished brazed condition. This braze joint secures the bottom of the tungsten carbide base 552 of the bit tip insert 470 to the bore termination 550 of the bore 548 of the cylindrical top portion 542 (FIG. 26) of the forward extension 526, at the forward end 540 of the diamond tool body 476. The forward end 476 of the generally cylindrical top portion 542 is then crimped with a multi-pointed or saw tooth shaped circular die (not shown). The structure forms side-by-side chevrons or saw teeth around the outside circular (annular) top portion. The valleys in the saw teeth are pointed tabs and are bent inwardly to aid in retaining the bit tip insert brazed in the forward end bore 548. In this ninth embodiment, the crimped extended annular sidewall 543 of the cylindrical top portion 542 of the forward extension 526 remains in place, as shown in FIGS. 26 and 29, after brazing the bit tip insert 470 in the bore 548, however, the annular sidewall 543 will be quickly worn away by the abrasive action of the cut material.

Alternatively, furnace brazing in an atmospherically controlled environment is used to assemble the unitary bit/holder, tool, and/or pick 474, which does not require a flux material to protect the braze joint regions. The atmospherically controlled furnace involves only an inert gas atmosphere, free of oxygen. The diamond unitary bit/holder, tool, and/or pick 474 is vertically positioned, heated, and brazed in this furnace setting. With the flux material removed, the braze material is tightly positioned underneath the base of the PDC insert. The braze material would have a higher melting point that would be closer to the austenitizing temperature, approximately 1,600 degrees Fahrenheit, for hardening the steel body of the bit holder. There is no damaging effect, up to 2,000 degrees Fahrenheit, to the PDC insert diamond layer in an atmospherically controlled furnace at the required temperature to properly harden the diamond tool metal body. The crimped forward end 546 allows the physical handling of this design and still provides the satisfactory furnace braze joint since the steel crimped feature tightly keeps this assembly together.

The annular tungsten carbide ring 520 is positioned around the forward extension 526 and brazed in the annular trough 524 of the bit holder body 476 and the base 552 and the sidewall 554 of the bit tip insert 470 is brazed in the bore 548 of the forward extension 526 at the same time as the carbide ring 520 is brazed, using, for example, a disc shaped or ring shaped braze material, creating a high strength braze joint, in the atmospherically controlled furnace. This braze joint secures the bottom and sidewall of the tungsten carbide base 552 of the bit tip insert 470 to the bore termination 550 of the bore 548 of the cylindrical top portion 542 of the forward extension 526, at the forward end 540 of the diamond tool body 476. In this ninth embodiment, the crimped extended annular sidewall 543 of the cylindrical top portion 542 of the forward extension 526 remains in place after brazing the bit tip insert 470 in the bore 548, however, the annular sidewall 526 will be quickly worn away by the abrasive action of the cut material.

Figure 30:
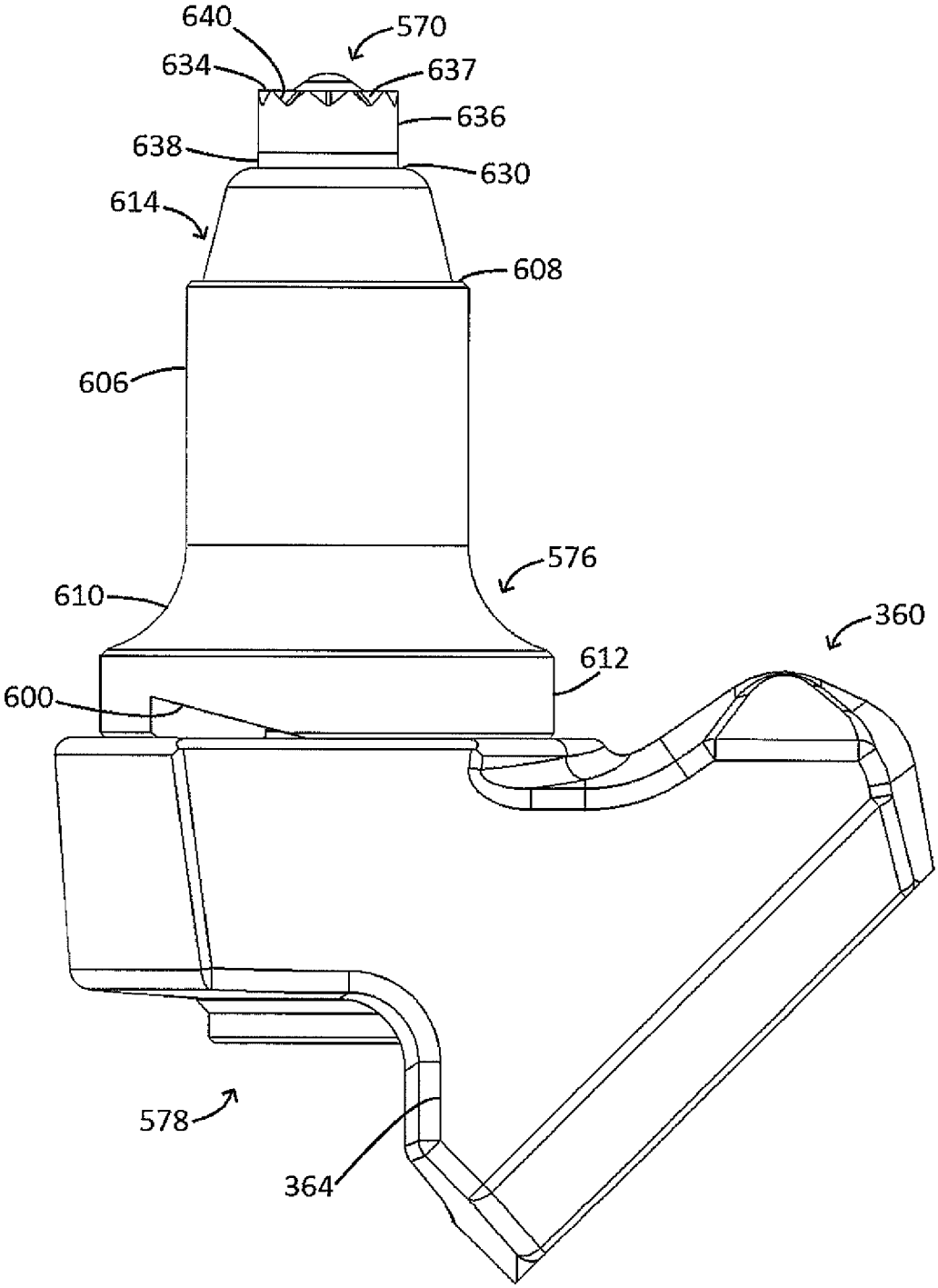
FIG. 30 is an elevation view of a tenth embodiment of a combination diamond coated bit/holder assembled into the second embodiment of the base block in accordance with implementations of this disclosure.
Figure 31:
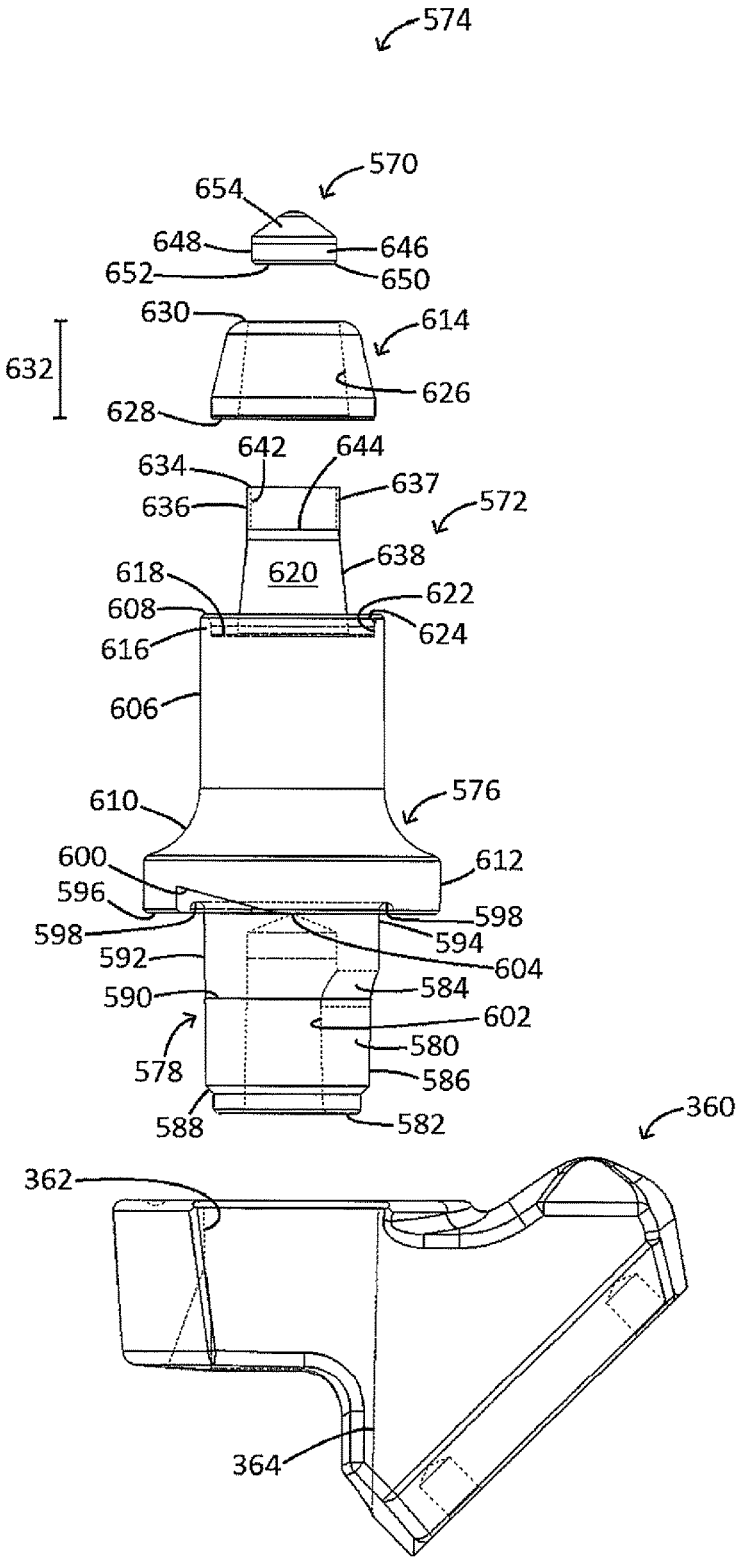
FIG. 31 is an exploded elevation view of the tenth embodiment of the combination diamond coated bit/holder and the second embodiment of the base block, showing invisible internal elements in dotted lines, in accordance with implementations of this disclosure.

Referring to FIGS. 30 and 31, a tenth embodiment of a combination diamond coated axially shortened bit 570 and bit holder 572 (FIG. 31) of the present disclosure forms a unitary structure bit and bit holder construction of a bit/holder, tool, and/or pick 574 (FIG. 30). The tenth embodiment of the bit holder 572 comprises a body 576 and a generally cylindrical hollow shank 578 depending from a bottom of the body 576. The bit holder 572 of the tenth embodiment includes a shank 576 that is shorter than the standard 2¾ inch length shank of a standard bit holder, such as shank 268 of bit holder 262, in which, in this exemplary implementation, the length of the shank 576 of the bit holder 572 is approximately a nominal 1¾ inches. In this embodiment, the shank 576 includes an elongate first slot 580 (FIG. 31) extending from a generally annular distal end 582 (FIG. 31) of the shank 576 axially upward or forward to an upper termination 584 (FIG. 31), which in this embodiment is adjacent the upper or forward end of the shank 576. In other embodiments, the shank may also include an internally oriented second slot located approximately 180 degrees around the annular shank from the first slot.

In this tenth embodiment of the bit holder 572, the shank 576 includes a lower or first tapered portion 586 (FIG. 31) running axially from a stepped shoulder 588 (FIG. 31) adjacent the distal end 582 of the shank 576. The stepped shoulder 588 is disposed between the lower tapered portion 586 and the distal end 582. A diameter of the stepped shoulder 588 increases, or steps up, in this embodiment, as it axially extends from the distal end 582 to the lower tapered portion 586. The first tapered portion 586 runs upwardly or axially from the stepped shoulder 588 of the shank 576 and terminates generally mid first slot 580 longitudinally. The shank 576 also includes an annular shoulder 590 (FIG. 31) separating the lower tapered portion 586 from an upper or second tapered portion 592 (FIG. 31) which extends from the shoulder 590 to generally adjacent to the top of the shank 576 or forward termination 584 of slot 580. The annular shoulder 590 is disposed between the lower tapered portion 586 and the upper tapered portion 592. A diameter of the annular shoulder 590 decreases, or steps down, in this embodiment, as it axially extends from the lower tapered portion 586 to the upper tapered portion 592. In other embodiments, the lower portion 586 and/or the upper portion 592 of the shank 576 may comprise a generally cylindrical shape, a slight draw angle, or a slight draft angle. In yet other embodiments, the shank 576 can comprise many different configurations.

A generally cylindrical top portion 594 (FIG. 31) of the shank 576 extends from a position adjacent the top or upper termination 584 of slot 580 towards a generally annular back flange 596 (FIG. 31) that denotes the base or the bottom of the body 576 of the bit holder 572. The top of the shank 576 may include a rounded junction 598 (FIG. 31) between the top portion 594 of the shank 576 and the generally annular flange 596 of the body 576 of the bit holder 572, which is provided to avoid sharp corners which may provide an area for stress cracks to begin. The generally annular flange 596 includes a pair of horizontal slots or wedge extraction notches 600-600 generally perpendicular to the longitudinal axis of the combination bit/holder, one on either side of the generally annular flange 596. The horizontal slots 600-600 are configured to receive a pair of bifurcated fork tines that may be inserted between the base of the body 576 of the bit holder 572 and the second embodiment of the base block 360 into which the shank 576 of the unitary bit/holder 574 is inserted and retained in the bore 362 of the base block 360 by outward radial force in use.

A central bore 602 (FIG. 31) longitudinally and axially extending through the shank 576 of the bit holder 572 terminates at bore termination 604 (FIG. 31), which in this illustrated embodiment has a conical shape, which is approximately at the upper end of the shank 576. This allows the generally C-shaped annular sidewall of the shank 576 to radially contract when the shank 286 is mounted in the tapered and/or cylindrical bore 362 of the base block 360.

In this tenth illustrated embodiment of the bit holder 572, the bit holder body 576 includes a generally cylindrical or annular upper body portion 606 depending from a forward end 608 of the upper body portion 606. A mediate body portion 610 subjacent the upper body portion 606 generally slopes axially and radially outwardly to a radially extending generally cylindrical tire portion 612.

The bit holder body 576, in order to provide superior brazing of a tungsten carbide ring 614 to the forward end 608 of the upper body portion 606, includes a forwardly extending annular collar 616 (FIG. 31) that is created on the bit holder body 576 to provide an annular trough 618 (FIG. 31) around a forward extension 620 (FIG. 31) of the bit holder body 576 onto which the annular ring 614 is mounted. In this illustrated embodiment, the annular collar 616 includes a cylindrical bottom inner wall 622 (FIG. 31) and a tapered top inner wall or countersink 624 (FIG. 31). The vertical outer wall of the collar 616 will keep brazing material from flowing outwardly of the joinder between the base of the ring 614 and the annular trough 618 on which the ring 614 is positioned. The annular trough 618 is thereabout positioned perpendicular to the axis of the bit holder 572 from the smaller radially oriented annular upper or forward extension 620. Around this forward extension 620 is fitted the annular tungsten carbide ring 614, the forward extension 620 extending through a bore 626 (FIG. 31) that extends through the annular tungsten carbide ring 614 allowing a bottom of the ring 614 to be seated in the annular trough 618, which may be brazed into unitary construction with the remainder of the bit holder 572. In this illustrated embodiment, the bore 626 of the annular tungsten carbide ring 614 is tapered from a distal end 628 of the ring 614 to a forward end 630 of the ring 614, as shown in FIG. 31. In other embodiments, the bore 626 of the annular tungsten carbide ring 614 may comprise a cylindrical upper section and an outwardly tapered bottom section, as shown in FIGS. 12 and 13. An axial length 632 (FIG. 31) of the ring 614 is designed to maintain radial support after being brazed. The top or forwardmost portion of the forward extension 620 of the bit holder body 576 terminates generally at a forward end 634 of the bit holder body 576 of the bit holder 572, located above the forward portion 176 of the annular tungsten carbide ring 614. The bit holder 572 may be machined and hardened, or hardened and then machined. The annular tungsten carbide ring 614 may be brazed before or after hardening of the bit holder 572.

In this exemplary implementation of the tenth embodiment of the bit holder 572, the forward extension 620 includes a generally cylindrical top portion 636 and an outwardly tapered bottom portion 638. The generally cylindrical top portion 636, which forms the unitary steel forward end of the tubular portion of the diamond tool body, includes a crimped forward end 640, shown in FIG. 30, that is crimped with a multi-pointed circular die (not shown). The structure forms side-by-side chevrons or saw teeth around the outside circular (annular) top portion. The valleys in the saw teeth are pointed tabs and are bent inwardly to aid in retaining the bit tip insert brazed in the forward end bore 642. The generally cylindrical top portion 636 also includes a bore 642 (FIG. 31) that axially extends from the forward end 634 to a bore termination 644 (FIG. 31), which in this exemplary implementation is flat, adjacent the outwardly tapered bottom portion 638. The bore 642 provides a space for receiving the complementary shaped bit 570.

The bit tip insert 570 comprises a base 646 (FIG. 31) that includes a parabolic curved section or frustoconical section below an apex of the bit tip insert 570. This bit tip insert 570 can also have a frustoconical shape, a flat generally cylindrical puck shape, a parabolic ballistic shape, a conical shape, and/or an arcuate shape. In this tenth embodiment, the base 646 includes a generally cylindrical sidewall 648 (FIG. 31) and a tapered section 650 (FIG. 31) that extends from the cylindrical sidewall 648 to a generally flat distal end 652 (FIG. 31) of the bit tip insert 570. In an alternate embodiment, the base 646 can include a tapered sidewall and the distal end 652 of the bit tip insert 570 can be conical, frustoconical, arcuate, or have a different configuration. In one exemplary implementation of the tenth embodiment, the bit tip insert 570 can have a diameter in the range of ½ inch to 1⅜ inches. The bit tip insert 570 may be a tungsten carbide insert or may be a tungsten carbide insert that includes an overlay 654 (FIG. 31) of a polycrystalline diamond structure that is applied to an outer surface of the tip insert 570. The overlay 654 may be a single coating or outer layer or multiple coatings or outer layers of such industrial diamond material, natural diamond, polycrystalline diamond (PCD) material, and polycrystalline diamond composite or compact (PCD) material. The single or multiple coatings or layers may be formed by a high pressure, high temperature process. The overlay 654 occupies a large radial and axial profile of the tip insert 570 which allows faster heat transfer into a region subjacent to the overlay 654 PCD layer. Excessively high heat, such as temperatures above 1300 degrees F., is the greatest cause of PCD failure due to diamond connective failure, the quick heat transfer from the tip of the PCD cutting zone, which is approximately ½ inch depth of cut per tip engagement, to the subjacent region below the PCD drastically reduces the possibility of a temperature of the tip of the PCD reaching temperatures at or above 1300 degrees F. for any extended period of time thereby avoiding failure of the PCD layer.

To assemble the combination diamond coated axially shortened bit 570 and bit holder 572 of the present disclosure and to form a unitary structure of a bit and bit holder construction of a bit/holder, tool, and/or pick 574, the annular tungsten carbide ring 614 is positioned around the forward extension 620 and brazed in the annular trough 618 of the bit holder body 576. The base 646 and the sidewall 648 of the bit tip insert 570 is brazed in the bore 642 of the forward extension 620 at the same time as the carbide ring 614 is brazed, using, for example, a disc shaped or ring shaped braze material and/or flux material, and also creating a high strength braze joint, which may then be optionally hardened. The braze material covers the base 646 and sidewall 648 of the bit tip insert 570 in the finished condition. This braze joint secures the bottom of the tungsten carbide base 646 of the bit tip insert 570 to the bore termination 644 of the bore 642 of the cylindrical top portion 636 of the forward extension 620, at the forward end 634 of the diamond tool body 576. The forward end 634 of the generally cylindrical top portion 636 is then crimped with a multi-pointed circular die (not shown). The structure forms side-by-side chevrons or saw teeth around the outside circular (annular) top portion. The valleys in the saw teeth are pointed tabs and are bent inwardly to aid in retaining the bit tip insert brazed in the forward end bore 642. In this tenth embodiment, the extended annular sidewall 637 of the cylindrical top portion 636 of the forward extension 620 remains in place, as shown in FIG. 30, after brazing the bit tip insert 570 in the bore 642, however, the annular sidewall 637 will be quickly worn away by the abrasive action of the cut material.

Alternatively, furnace brazing in an atmospherically controlled environment is used to assemble the unitary bit/holder, tool, and/or pick 574, which does not require a flux material to protect the braze joint regions. The atmospherically controlled furnace involves only an inert gas atmosphere, free of oxygen. The diamond unitary bit/holder, tool, and/or pick 574 is vertically positioned, heated, and brazed in this furnace setting. With the flux material removed, the braze material is tightly positioned underneath the base of the PDC insert. The braze material would have a higher melting point that would be closer to the austenitizing temperature, approximately 1,600 degrees Fahrenheit, for hardening the steel body of the bit holder. There is no damaging effect, up to 2,000 degrees Fahrenheit, to the PDC insert diamond layer in an atmospherically controlled furnace at the required temperature to properly harden the diamond tool metal body. The crimped forward end 640 allows the physical handling of this design and still provides the satisfactory furnace braze joint since the steel crimped feature tightly keeps this assembly together.

The annular tungsten carbide ring 614 is positioned around the forward extension 620 and brazed in the annular trough 618 of the bit holder body 576 and the base 646 and the sidewall 648 of the bit tip insert 570 is brazed in the bore 642 of the forward extension 620 at the same time as the carbide ring 614 is brazed, using, for example, a disc shaped or ring shaped braze material, creating a high strength braze joint, in the atmospherically controlled furnace. This braze joint secures the bottom and sidewall of the tungsten carbide base 646 of the bit tip insert 570 to the bore termination 644 of the bore 642 of the cylindrical top portion 636 of the forward extension 620, at the forward end 634 of the diamond tool body 576. In this tenth embodiment, the crimped extended annular sidewall 637 of the cylindrical top portion 636 of the forward extension 620 remains in place after brazing the bit tip insert 570 in the bore 642, however, the annular sidewall 637 will be quickly worn away by the abrasive action of the cut material.

Figure 32:
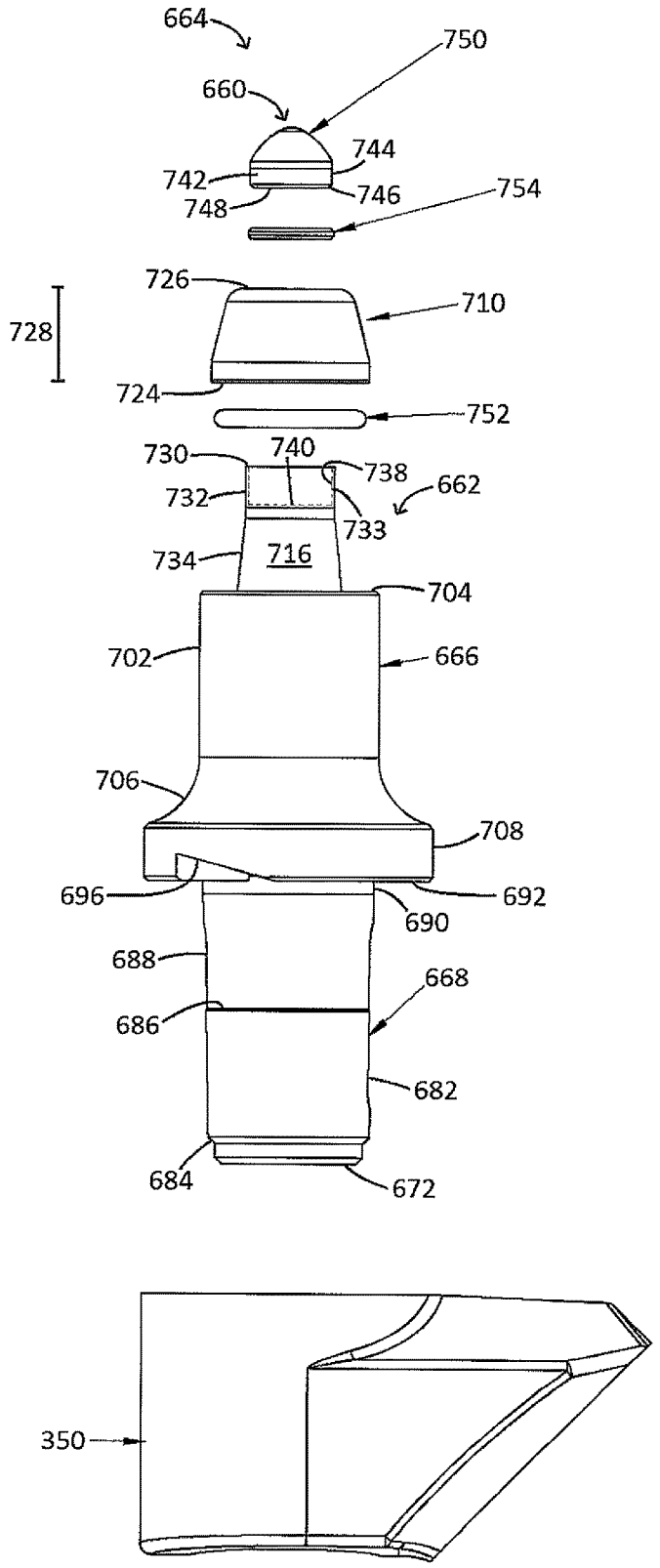
FIG. 32 is an exploded view of an eleventh embodiment of a combination diamond coated bit/holder and the second embodiment of the base block in accordance with implementations of this disclosure.
Figure 34:
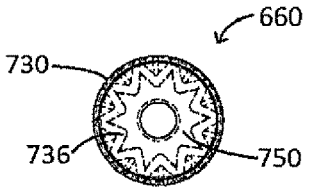
FIG. 34 is a top elevation view of a bit tip insert and a crimped forward portion of the eleventh embodiment of the combination diamond coated bit/holder in accordance with implementations of this disclosure.
Figure 33:
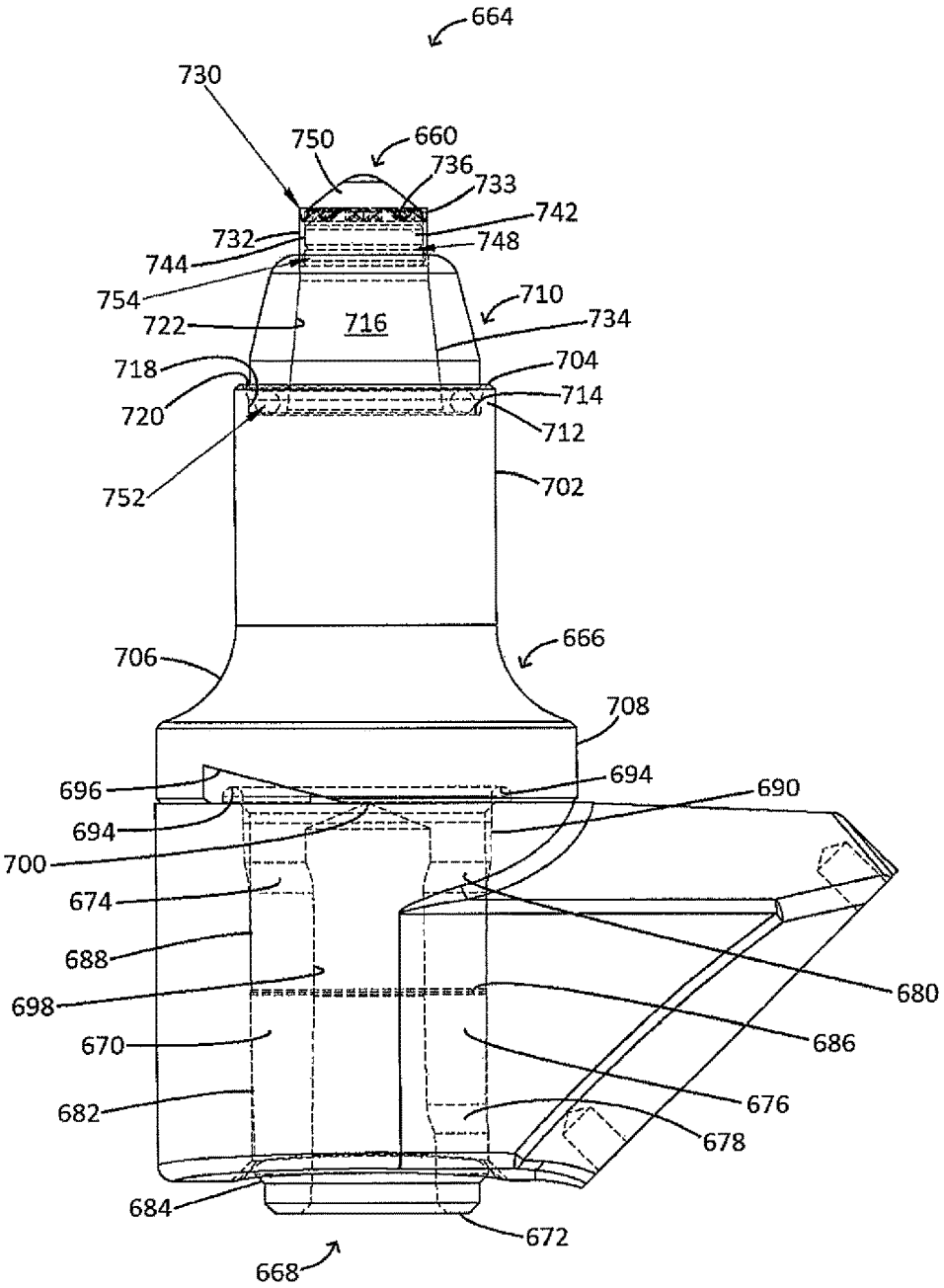
FIG. 33 is an elevation view of the eleventh embodiment of the combination diamond coated bit/holder assembled into the first embodiment of the base block, showing invisible internal elements in dotted lines, in accordance with implementations of this disclosure.

Referring to FIGS. 32-34, an eleventh embodiment of a combination diamond coated axially shortened bit 660 and bit holder 662 (FIG. 32) of the present disclosure forms a unitary structure bit and bit holder construction of a bit/holder, tool, and/or pick 664. The eleventh embodiment of the bit holder 662 comprises a body 666 and a generally cylindrical hollow shank 668 depending from a bottom of the body 666. The shank 668 includes an elongate first slot 670 (FIG. 33) extending from a generally annular distal end 672 of the shank 668 axially upward or forward to an upper termination 674 (FIG. 33), which in this embodiment is adjacent the upper or forward end of the shank 668. In this illustrated embodiment, the shank 668 also includes an internally oriented second slot 676 (FIG. 33) located approximately 180 degrees around the annular shank 668 from the first slot 670. The second slot 676 is generally parallel to the first slot 670 and is an internal slot including a rearward semicircular termination 678 (FIG. 33) inwardly adjacent the distal end 672 of the shank 668 and a forward semicircular termination 680 (FIG. 33) generally coinciding longitudinally and axially with the upper termination 674 of the first slot 670.

In this eleventh embodiment of the bit holder 662, the shank 668 includes a lower or first tapered portion 682 running axially from a stepped shoulder 684 adjacent the distal end 672 of the shank 668. The stepped shoulder 684 is disposed between the lower tapered portion 682 and the distal end 672. A diameter of the stepped shoulder 684 increases, or steps up, in this embodiment, as it axially extends from the distal end 672 to the lower tapered portion 682. The first tapered portion 682 runs upwardly or axially from the stepped shoulder 684 of the shank 668 and terminates generally mid first slot 670 longitudinally. The shank 668 also includes an annular shoulder 686 separating the lower tapered portion 682 from an upper or second tapered portion 688 which extends from the shoulder 686 to generally adjacent to the top of the shank 668 or forward terminations 674, 680 of slots 670, 676, respectively. The annular shoulder 686 is disposed between the lower tapered portion 682 and the upper tapered portion 688. A diameter of the annular shoulder 686 decreases, or steps down, in this embodiment, as it axially extends from the lower tapered portion 682 to the upper tapered portion 688. In other embodiments, the lower portion 682 and/or the upper portion 688 of the shank 668 may comprise a generally cylindrical shape, a slight draw angle, or a slight draft angle. In yet other embodiments, the shank 668 can comprise many different configurations.

A generally cylindrical top portion 690 of the shank 668 extends from a position adjacent the top or upper terminations 674, 680 of slots 670, 676, respectively, towards a generally annular back flange 692 (FIG. 32) that denotes the base or the bottom of the body 666 of the bit holder 662. The top of the shank 668 may include a rounded junction 694 (FIG. 33) between the top portion 690 of the shank 668 and the generally annular flange 692 of the body 666 of the bit holder 662, which is provided to avoid sharp corners which may provide an area for stress cracks to begin. The generally annular flange 692 includes a pair of horizontal slots or wedge extraction notches 696-696 generally perpendicular to the longitudinal axis of the combination bit/holder, one on either side of the generally annular flange 692. The horizontal slots 696-696 are configured to receive a pair of bifurcated fork tines that may be inserted between the base of the body 666 of the bit holder 662 and the first embodiment of the base block 350 into which the shank 668 of the unitary bit/holder 664 is inserted and retained by outward radial force in use.

A central bore 698 (FIG. 33) longitudinally and axially extending through the shank 668 of the bit holder 662 terminates at bore termination 700 (FIG. 33), which in this illustrated embodiment has a conical shape, which is approximately at the upper end of the shank 668. This allows the generally C-shaped annular sidewall of the shank 668 to radially contract when the shank 668 is mounted in a tapered and/or cylindrical bore in the base block 350.

In this eleventh illustrated embodiment of the bit holder 662, the bit holder body 666 includes a generally cylindrical or annular upper body portion 702 depending from a forward end 704 of the upper body portion 702. A mediate body portion 706 subjacent the upper body portion 702 generally slopes axially and radially outwardly to a radially extending generally cylindrical tire portion 708.

The bit holder body 666, in order to provide superior brazing of a tungsten carbide ring 710 to the forward end 704 of the upper body portion 702, includes a forwardly extending annular collar 712 (FIG. 33) that is created on the bit holder body 666 to provide an annular trough 714 (FIG. 33) around a forward extension 716 of the bit holder body 666 onto which the annular ring 710 is mounted. In this illustrated embodiment, the annular collar 712 includes a cylindrical bottom inner wall 718 (FIG. 33) and a tapered top inner wall or countersink 720 (FIG. 33). The vertical outer wall of the collar 712 will keep brazing material from flowing outwardly of the joinder between the base of the ring 710 and the annular trough 714 on which the ring 710 is positioned. The annular trough 714 is therearound positioned perpendicular to the axis of the bit holder 662 from the smaller radially oriented annular upper or forward extension 716. Around this forward extension 716 is fitted the annular tungsten carbide ring 710, the forward extension 716 extending through a bore 722 (FIG. 33) that extends through the annular tungsten carbide ring 710 allowing a bottom of the ring 710 to be seated in the annular trough 714, which may be brazed into unitary construction with the remainder of the bit holder 662. In this illustrated embodiment, the bore 722 of the annular tungsten carbide ring 710 is tapered from a distal end 724 (FIG. 32) of the ring 710 to a forward end 726 (FIG. 32) of the ring 710, as shown in FIG. 33. In other embodiments, the bore 722 of the annular tungsten carbide ring 710 may comprise a cylindrical upper section and an outwardly tapered bottom section, as shown in FIGS. 12 and 13. An axial length 728 (FIG. 32) of the ring 710 is designed to maintain radial support after being brazed. The top or forwardmost portion of the forward extension 716 of the bit holder body 666 terminates generally at a forward end 730 of the bit holder body 666 of the bit holder 662, located above the forward portion 726 of the annular tungsten carbide ring 710. The bit holder 662 may be machined and hardened, or hardened and then machined. The annular tungsten carbide ring 710 may be brazed before or after hardening of the bit holder 662.

In this exemplary implementation of the eleventh embodiment of the bit holder 662, the forward extension 716 includes a generally cylindrical top portion 732 and an outwardly tapered bottom portion 734. The generally cylindrical top portion 732, which forms the unitary steel forward end of the tubular portion of the diamond tool body, includes a crimped forward end 736, shown in FIGS. 33 and 34, that is crimped with a multi-pointed circular die (not shown). The structure forms side-by-side chevrons or saw teeth around the outside circular (annular) top portion. The valleys in the saw teeth are pointed tabs and are bent inwardly to aid in retaining the bit tip insert brazed in the forward end bore 738. The generally cylindrical top portion 732 also includes a bore 738 (FIG. 32) that axially extends from the forward end 730 to a bore termination 740 (FIG. 32), which in this exemplary implementation is flat, adjacent the outwardly tapered bottom portion 734. The bore 738 provides a space for receiving the complementary shaped bit 660.

The bit tip insert 660 comprises a base 742 that includes a parabolic curved section below an apex of the bit tip insert 660. This bit tip insert 660 can also have a frustoconical shape, a flat generally cylindrical puck shape, a parabolic ballistic shape, a conical shape, and/or an arcuate shape. In this eleventh embodiment, the base 742 includes a generally cylindrical sidewall 744 and a tapered section 746 that extends from the cylindrical sidewall 744 to a generally flat distal end 748 of the bit tip insert 660, as shown in FIG. 32. In an alternate embodiment, the base 742 can include a tapered sidewall and the distal end 748 of the bit tip insert 660 can be conical, frustoconical, arcuate, or have a different configuration. In one exemplary implementation of the eleventh embodiment, the bit tip insert 660 can have a diameter in the range of ½ inch to 1⅜ inches. The bit tip insert 660 may be a tungsten carbide insert or may be a tungsten carbide insert that includes an overlay 750 of a polycrystalline diamond structure that is applied to an outer surface of the tip insert 660. The overlay 750 may be a single coating or outer layer or multiple coatings or outer layers of such industrial diamond material, natural diamond, polycrystalline diamond (PCD) material, and polycrystalline diamond composite or compact (PCD) material. The single or multiple coatings or layers may be formed by a high pressure, high temperature process. The overlay 750 occupies a large radial and axial profile of the tip insert 660 which allows faster heat transfer into a region subjacent to the overlay 750 PCD layer. Excessively high heat, such as temperatures above 1300 degrees F., is the greatest cause of PCD failure due to diamond connective failure, the quick heat transfer from the tip of the PCD cutting zone, which is approximately ½ inch depth of cut per tip engagement, to the subjacent region below the PCD drastically reduces the possibility of a temperature of the tip of the PCD reaching temperatures at or above 1300 degrees F. for any extended period of time thereby avoiding failure of the PCD layer.

To assemble the combination diamond coated axially shortened bit 660 and bit holder 662 of the present disclosure and to form a unitary structure of a bit and bit holder construction of a bit/holder, tool, and/or pick 664, a brazing ring 752 with flux (FIG. 32) is positioned around the forward extension 716 and in the annular trough 714. The annular tungsten carbide ring 710 is also positioned around the forward extension 716, the distal end 724 of the carbide ring 710 adjacent to the brazing ring 752, and brazed in the annular trough 714 of the bit holder body 666. A brazing disc 754 with flux (FIG. 32) is added to all surfaces that braze material will wet or be attached to. The brazing disc 754 is positioned in the bore 738 of the forward extension 716 and the bit tip insert 660 is positioned in the bore 738 of the forward extension 716, the distal end 748 of the base 742 of the bit tip insert 660 adjacent the brazing disc 754. The bottom surface of the bit tip insert 660 is positioned above or at the same level of the forward end or top surface 726 of the carbide ring 710. The bit tip insert 660, in this embodiment, is less than ¾ inch in overall length for the distal end or flat bottom 748 of the bit tip insert 660. The base 742 and the sidewall 744 of the bit tip insert 660 is brazed in the bore 738 of the forward extension 716 at the same time as the carbide ring 710 is brazed, using, for example, the brazing ring 752 shaped or brazing disc 754 shaped braze material and/or flux material, and also creating a high strength braze joint, which may then be optionally hardened. The braze material disc 754 covers the base 742 and sidewall 744 of the bit tip insert 660 in the finished condition. This braze joint secures the bottom of the tungsten carbide base 742 of the bit tip insert 660 to the bore termination 740 of the bore 738 of the cylindrical top portion 732 of the forward extension 716, at the forward end 730 of the diamond tool body 666. In this eleventh embodiment, the crimped extended annular sidewall 733 of the cylindrical top portion 732 of the forward extension 716 remains in place, as shown in FIG. 33, after brazing the bit tip insert 660 in the bore 738, however, the annular sidewall 733 will be quickly worn away by the abrasive action of the cut material.

Alternatively, furnace brazing in an atmospherically controlled environment is used to assemble the unitary bit/holder, tool, and/or pick 664, which does not require a flux material to protect the braze joint regions. The atmospherically controlled furnace involves only an inert gas atmosphere, free of oxygen. The diamond unitary bit/holder, tool, and/or pick 664 is vertically positioned, heated, and brazed in this furnace setting. With the flux material removed, the braze material is tightly positioned underneath the base of the PDC insert. The braze material would have a higher melting point that would be closer to the austenitizing temperature, approximately 1,600 degrees Fahrenheit, for hardening the steel body of the bit holder. There is no damaging effect, up to 2,000 degrees Fahrenheit, to the PDC insert diamond layer in an atmospherically controlled furnace at the required temperature to properly harden the diamond tool metal body. The crimped forward end 736 allows the physical handling of this design and still provides the satisfactory furnace braze joint since the steel crimped feature tightly keeps this assembly together.

As described above, the annular tungsten carbide ring 710 is positioned around the forward extension 716 and brazed in the annular trough 714 of the bit holder body 666 and the base 742 and the sidewall 744 of the bit tip insert 660 is brazed in the bore 738 of the forward extension 716 at the same time as the carbide ring 710 is brazed, using, for example, brazing ring 752 and brazing disc 754, creating a high strength braze joint, in the atmospherically controlled furnace. This braze joint secures the bottom and sidewall of the tungsten carbide base 742 of the bit tip insert 660 to the bore termination 740 of the bore 738 of the cylindrical top portion 732 of the forward extension 716, at the forward end 730 of the diamond tool body 666. In this tenth embodiment, the crimped extended annular sidewall 733 of the cylindrical top portion 732 of the forward extension 716 remains in place after brazing the bit tip insert 660 in the bore 738, however, the annular sidewall 733 will be quickly worn away by the abrasive action of the cut material.

As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, "X includes at least one of A and B" is intended to mean any of the natural inclusive permutations. That is, if X includes A; X includes B; or X includes both A and B, then "X includes at least one of A and B" is satisfied under any of the foregoing instances. The articles "a" and "an" as used in this application and the appended claims should generally be construed to mean "one or more" unless specified otherwise or clear from context to be directed to a singular form. Moreover, use of the term "an implementation" or "one implementation" throughout is not intended to mean the same embodiment, aspect or implementation unless described as such.

While the present disclosure has been described in connection with certain embodiments and measurements, it is to be understood that the present disclosure is not to be limited to the disclosed embodiments and measurements but, on the contrary, is intended to cover various modifications and equivalent arrangements included within the scope of the appended claims, which scope is to be accorded the broadest interpretation so as to encompass all such modifications and equivalent structures as is permitted under the law.

What is claimed:

1. A tool comprising:

a body comprising an annular trough and a forward extension axially extending from the annular trough to a forward end of the body;

a shank extending axially from a bottom of the body;

an annular ring comprising a ring bore, the forward extension extending through the ring bore and axially above a forward end of the annular ring, and the annular ring adapted to be seated and brazed in the annular trough of the body;

an outwardly tapered distal section of the forward extension extending axially outwardly from the annular trough; and a forward extension bore of the forward extension extending axially inwardly from the forward end of the body to a bore termination within the forward extension.

2. The tool of claim 1, further comprising:

a generally cylindrical section of the forward extension including an annular wall extending through the ring bore and axially above the forward end of the annular ring, the generally cylindrical section axially extending inwardly from the forward end of the body, the forward extension bore extending axially through the generally cylindrical section of the forward extension to the bore termination adjacent the outwardly tapered section of the forward extension; and the outwardly tapered section subjacent the generally cylindrical section of the forward extension.

3. The tool of claim 1, further comprising:

a bit tip insert comprising a tip, a base subjacent the tip, and a distal end opposite the tip, the bit tip insert adapted to be seated and brazed in the forward extension bore.

4. The tool of claim 3, further comprising:

an overlay applied to an outer surface of the tip of the bit tip insert, the overlay comprising at least one of a:

single coating of at least one of industrial diamond material, natural diamond, polycrystalline diamond (PCD) material, and polycrystalline diamond composite or PCD material;

single outer layer of at least one of industrial diamond material, natural diamond, polycrystalline diamond (PCD) material, and polycrystalline diamond composite or PCD material;

multiple coatings of at least one of industrial diamond material, natural diamond, polycrystalline diamond (PCD) material, and polycrystalline diamond composite or PCD material; and multiple layers of at least one of industrial diamond material, natural diamond, polycrystalline diamond (PCD) material, and polycrystalline diamond composite or PCD material.

5. The tool of claim 3, wherein the forward end of the body is bent radially inward covering an outer circumferential portion of the bit tip insert.

6. The tool of claim 1, wherein the bore termination comprises one of a flat shape, a conical shape, and a frustoconical shape.

7. The tool of claim 1, further comprising:

a brazing ring disposed in the annular trough; and a brazing disc disposed in the forward extension bore.

8. The tool of claim 1, further comprising:

a generally cylindrical section of the forward extension including an annular wall extending through the ring bore and axially above the forward end of the annular ring, the generally cylindrical section axially extending inwardly from the forward end of the body;

the outwardly tapered section subjacent the generally cylindrical section of the forward extension; and the forward extension bore extending axially through the generally cylindrical section of the forward extension to the bore termination adjacent a distal end of the outwardly tapered section of the forward extension.

9. The tool of claim 8, further comprising:

a forward bore section of the forward extension bore extending inwardly from the forward end of the body; and a distal bore section of the forward extension bore subjacent the forward bore section of the forward extension.

10. The tool of claim 9, the forward bore section comprising one of a generally cylindrical bore and a tapered bore.

11. The tool of claim 9, the distal bore section comprising one of a generally cylindrical bore and a tapered bore.

12. The tool of claim 9, further comprising:

a plug disposed in the distal bore section of the forward extension, the plug comprising an outer surface complementary shaped to distal bore section of the forward extension.

13. The tool of claim 12, the plug comprising a tungsten carbide plug.

14. The tool of claim 1, further comprising:

a bit tip insert comprising a tip and a base subjacent the tip, the bit tip insert adapted to be seated and brazed in the forward extension bore; and an annular wall of the forward extension adjacent the forward end of the body, the annular wall extending through the ring bore and axially above the base of the bit tip insert.

15. The tool of claim 14, further comprising:

an overlay applied to an outer surface of the tip of the bit tip insert, the overlay comprising at least one of a:

single coating of at least one of industrial diamond material, natural diamond, polycrystalline diamond (PCD) material, and polycrystalline diamond composite or PCD material;

single outer layer of at least one of industrial diamond material, natural diamond, polycrystalline diamond (PCD) material, and polycrystalline diamond composite or PCD material;

multiple coatings of at least one of industrial diamond material, natural diamond, polycrystalline diamond (PCD) material, and polycrystalline diamond composite or PCD material; and multiple layers of at least one of industrial diamond material, natural diamond, polycrystalline diamond (PCD) material, and polycrystalline diamond composite or PCD material.

16. The tool of claim 14, wherein the annular wall of the forward extension is bent radially inward covering an outer circumferential portion of the bit tip insert.

17. The tool of claim 14, wherein substantially diametrically opposed portions of the annular wall of the forward extension include tabs.

18. The tool of claim 17, a plurality of said tabs are positioned in spatial array around said forward end of the body.

19. The tool of claim 18, wherein the tabs include pointed inner ends and portions of said forward end of the body between said tabs forms a saw tooth configuration.

20. The tool of claim 1, wherein a length of the shank is less than a nominal 2⅝ inches.

21. The tool of claim 1, wherein a length of the shank is one of a nominal 1½ inches, a nominal 2⅜ inches, and a nominal 2⅝ inches.

22. The tool of claim 1, wherein substantially diametrically opposed portions of the forward end of the body include tabs.

23. The tool of claim 22, a plurality of said tabs are positioned in spatial array around said forward end of the body.

24. The tool of claim 23, wherein the tabs include pointed inner ends and portions of said forward end of the body between said tabs forms a saw tooth configuration.

* * * * *